US012011065B2

(12) United States Patent
Joseph

(10) Patent No.: US 12,011,065 B2
(45) Date of Patent: Jun. 18, 2024

(54) SHOES AND SHOE ASSEMBLIES AND METHODS OF MAKING AND USING THE SAME

(71) Applicant: MCIROA INC., North Miami, FL (US)

(72) Inventor: Gina Joseph, North Miami, FL (US)

(73) Assignee: MCIROA INC., North Miami, FL (US)

( * ) Notice: Subject to any disclaimer, the term of this patent is extended or adjusted under 35 U.S.C. 154(b) by 204 days.

(21) Appl. No.: 17/151,043

(22) Filed: Jan. 15, 2021

(65) Prior Publication Data

US 2021/0127792 A1 May 6, 2021

Related U.S. Application Data

(63) Continuation-in-part of application No. 16/510,809, filed on Jul. 12, 2019, now Pat. No. 11,213,096.

(60) Provisional application No. 62/711,378, filed on Jul. 27, 2018, provisional application No. 62/698,011, filed on Jul. 13, 2018.

(51) Int. Cl.

| | |
|---|---|
| ***A43B 21/24*** | (2006.01) |
| ***A43B 21/36*** | (2006.01) |
| ***A43B 23/02*** | (2006.01) |
| ***A43B 23/24*** | (2006.01) |

(52) U.S. Cl.

CPC ..... *A43B 23/24* (2013.01); *A43B 21/24* (2013.01); *A43B 23/0215* (2013.01); *A43B 23/0245* (2013.01)

(58) Field of Classification Search

CPC ..... A43B 23/24; A43B 23/25; A43B 23/30; A43B 21/54; A43B 21/52

See application file for complete search history.

(56) References Cited

U.S. PATENT DOCUMENTS

| | | | | |
|---|---|---|---|---|
| 1,514,706 | A | 11/1924 | Colvin | |
| 1,701,018 | A | 2/1929 | Smart | |
| 1,708,964 | A | 4/1929 | Boomer | |
| 1,903,004 | A | 3/1933 | Mariani | |
| 2,076,514 | A | 4/1937 | Huffman | |
| 4,026,047 | A | 5/1977 | Ahmer | |
| 4,441,264 | A | 4/1984 | Hantz-Guibas | |
| 4,461,100 | A | 7/1984 | Minor | |
| 5,042,119 | A * | 8/1991 | Williams | A43B 3/0031 24/442 |
| 5,257,469 | A | 11/1993 | Beasley | |

(Continued)

*Primary Examiner* — Jila M Mohandesi

(74) *Attorney, Agent, or Firm* — KENEALY VAIDYA LLP

(57) ABSTRACT

The disclosure is directed to shoe accoutrements and methods of making and using the same. A shoe assembly for a shoe, can include an inner layer of first material; a support layer of second material, and the support layer including a slit, and a pocket being provided between the inner layer and the support layer. The shoe assembly can further include a first attachment plate attached to the inner layer; a second attachment plate, and the second attachment plate being magnetically attracted to the first attachment plate and positioned on the first attachment plate, and the second attachment plate being slidably removable out a top of the pocket, and the slit running along a back side of the pocket; a connection assembly attached to the second attachment plate; and an accoutrement, and the accoutrement supported by the connection assembly.

20 Claims, 44 Drawing Sheets

(56) References Cited

U.S. PATENT DOCUMENTS 5,649,342 A * 7/1997 D'Andrade ..... A43C 7/005 24/712.2
5,671,517 A * 9/1997 Gourley ..... A43B 3/0078 24/712.1
5,800,900 A * 9/1998 Mitchell ..... A43B 1/0054 2/244
6,052,924 A 4/2000 Sabat
6,588,078 B2 * 7/2003 Writt ..... A43B 23/26 24/712.2
6,952,864 B2 * 10/2005 Moreno ..... A43C 7/02 24/306
7,059,070 B2 6/2006 Omstead
7,444,724 B1 * 11/2008 Perler ..... A43B 23/24 24/712.3
7,600,334 B2 * 10/2009 Cox ..... A43B 3/24 36/100
8,161,664 B1 * 4/2012 Dawson ..... A43B 3/0031 36/99
8,387,284 B2 3/2013 Baum
8,397,357 B1 * 3/2013 Madey ..... A43C 7/04 24/306
8,667,712 B2 * 3/2014 Baum ..... A43B 1/0027 36/72 B
9,015,963 B1 4/2015 Dominguez
9,474,329 B1 10/2016 Harvey
9,609,924 B1 4/2017 Silverman
9,615,629 B2 * 4/2017 Cashel ..... A43B 23/26
D824,658 S * 8/2018 Gabbidon ..... A43B 3/0031 D2/978
11,213,096 B2 1/2022 Joseph
2005/0005478 A1 1/2005 James
2005/0138846 A1 6/2005 O'Conner
2010/0000126 A1 1/2010 Ortner
2011/0083341 A1 4/2011 Baum
2013/0042503 A1 2/2013 Larson
2014/0000126 A1 1/2014 Nelson-Warren
2014/0202032 A1 7/2014 Alas
2014/0360054 A1 12/2014 Leslie
2016/0015130 A1 1/2016 Knox
2018/0310668 A1 11/2018 Morales
2021/0127792 A1 5/2021 Joseph
2022/0117357 A1 4/2022 Joseph

* cited by examiner

SHOES AND SHOE ASSEMBLIES AND METHODS OF MAKING AND USING THE SAME

RELATED PATENT APPLICATIONS AND PRIORITY

This application is a continuation-in-part application of U.S. patent application Ser. No. 16/510,809 filed Jul. 12, 2019, the content of which is incorporated herein by reference in its entirety.

Such U.S. patent application Ser. No. 16/510,809 claims priority to U.S. Provisional Patent Application 62/698,011 filed Jul. 13, 2018, the content of which is incorporated herein by reference in its entirety.

U.S. patent application Ser. No. 16/510,809 claims priority to U.S. Provisional Patent Application 62/711,378 filed Jul. 27, 2018, the content of which is incorporated herein by reference in its entirety.

BACKGROUND

The disclosure relates to shoe accoutrements for shoes and related items.

Various devices and arrangements have been used in the past to provide decoration to shoes. However, known devices and arrangements for providing decoration and/or ornamentation to shoes have deficiencies. The embodiments of the disclosure address these and other deficiencies in known technology.

BRIEF SUMMARY

The disclosure is directed to shoe accoutrements and methods of making and using the same. A shoe assembly for a shoe can be provided. The shoe assembly can include an inner layer of first material; a support layer of second material, and the support layer including a slit, and a pocket being provided between the inner layer and the support layer. The shoe assembly can further include a first attachment plate attached to the inner layer; a second attachment plate, and the second attachment plate being magnetically attracted to the first attachment plate and positioned on the first attachment plate, and the second attachment plate being slidably removable out a top of the pocket, and the slit running along a back side of the pocket; a connection assembly attached to the second attachment plate; and an accoutrement, and the accoutrement supported by the connection assembly.

BRIEF DESCRIPTION OF THE DRAWINGS

The present disclosure can be more fully understood by reading the following detailed description together with the accompanying drawings, in which like reference indicators are used to designate like or similar elements, and in which.

DETAILED DESCRIPTION

Hereinafter, aspects of the disclosure in accordance with various embodiments will be described. As used herein absent context to the contrary, any term in the singular may be interpreted to be in the plural, and alternatively, any term in the plural may be interpreted to be in the singular.

The disclosure provides shoe accoutrements and methods of making and using the same.

A shoe accoutrement assembly in accord with embodiments of the disclosure provides fashionable and desirable improvements to shoes. Shoes, including shoes of women, men and children, come in a wide variety of types, shapes, colors, designs and sizes. Oftentimes, a particular type of shoe is appropriate or desired for a particular type of event. Additionally, it is often desirable to wear a particular type of shoe or color of shoe with a particular type or color of outfit. Even for those persons who have substantial number of shoes, he or she may still fall short of having the desired shoe for a particular occasion, i.e. the "perfect shoe" for the particular occasion. The various embodiments of the disclosure address this problem, which known technology fails to effectively address.

In particular, the various embodiments of the disclosure provide a mechanism by which one may easily and affordably attain shoes having different appearance and features, for example, without incurring the cost of purchasing additional shoes. The disclosure provides for shoes to be "accessorized" in varied ways. As a result, a particular pair of shoes can be easily adapted to different events and/or situations. Such adaptability is provided by embodiments of a shoe accoutrement assembly of this disclosure.

As is well known in the art, a shoe is a type of footwear that is commonly worn to comfort, protect, stabilize and adorn human feet while walking and engaging in a wide variety of activities. Shoes, come in innumerable types, shapes, colors, designs and sizes. As is well known, a particular shoe is often sized to the wearer.

In many circumstances, shoes may be utilized as an item of fashion, style and decoration. Shoes may vary widely in functionality. Relatedly, shoes may vary widely in cost. Yet further, shoes may vary widely in the quality of materials utilized in construction of the shoe. Additionally, some shoes may be very simple in construction while other shoes are very complex in construction. Oftentimes, a particular type of shoe is crafted or constructed for a particular activity or use—or for a particular event or type of event.

Figure 37:
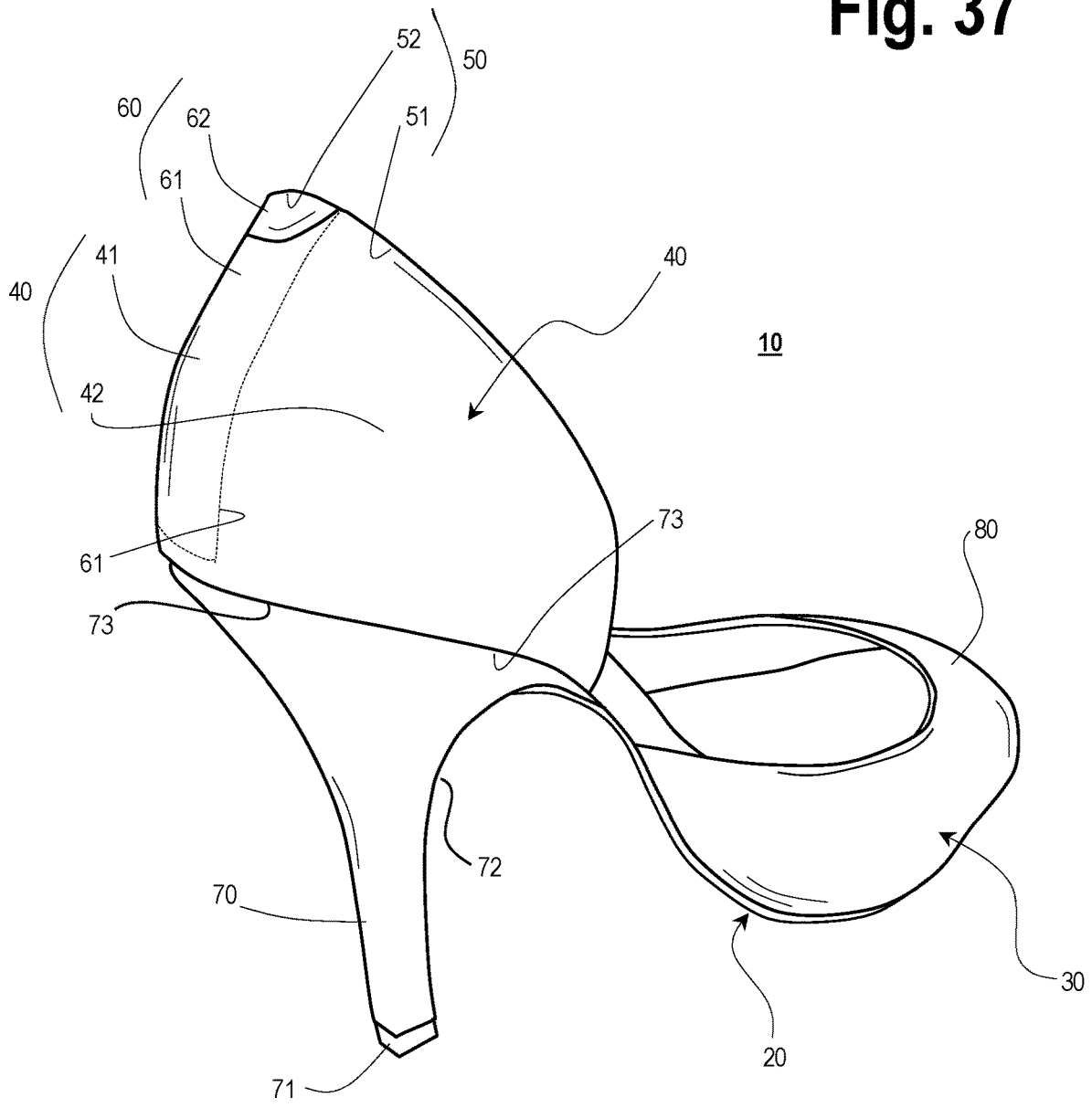
FIG. 37 is a perspective view of a known shoe 10 provided to show parts of a shoe.

A shoe accoutrement assembly of the disclosure may be utilized with a wide variety of types and constructs of shoes including shoes for women, men and children. For purposes of reference and explanation of embodiments of the disclosure, FIG. 37 is a perspective view of a known shoe. In particular, the shoe as shown in FIG. 37 may be characterized as a "high-heeled" shoe 10. While various embodiments and features of the disclosure are described in the context of such a "high-heeled" shoe, the disclosure is not limited to such particular type of shoe.

Hereinafter, construct of the shoe 10, as shown in FIG. 37, will be described. Structure of the shoe that is of particular relevance to the features of the disclosure will be described with further detail than less related portions of the shoe. It is appreciated that terminology in shoe construct does vary. For purposes of this disclosure, the following terms will be used for purposes of description.

Shoe 10—a shoe may be characterized as including a sole and upper. The sole may include a heel.

Sole 20—the sole is the bottom part of the shoe. The sole of the shoe is in contact with the ground. The sole may be characterized as including the heel of the shoe.

Upper 30—the upper is the portion of the shoe that is above the sole, i.e. the top half of the shoe.

The upper may serve to hold the shoe onto the human foot.

Quarter 40—the shoe back 41 and sides 42 of the upper that cover and enclose the heel of the foot. The quarter is behind the vamp 80.

Collar 50—the top edge of the quarter, i.e. where the foot is inserted. As described herein, the collar may include opposing side collars 51 that are separated by a back collar 52, with the back collar being at the back of the shoe.

Counter 60—a back or rear portion or piece of the quarter that may include or be constituted by a separate piece of material for reinforcement. As described herein and shown in FIG. 37, the counter may include a back counter 61 and an upper counter 62. For example, the upper counter 62 may be an exterior portion or piece at the top back of the shoe. The back counter 61 may be interior (such as between different layers or linings of the shoe) and be provided along the height of the quarter at the back of the shoe.

Heel 70—the heel is the bottom back part of the shoe. The heel supports the back of the foot and ankle. The heel may or may not be constructed integrally and/or of the same material as the other portions of the sole, including the portion of the sole at the front of the shoe.

Top piece 71—a piece of material, such as leather or rubber, that is attached to the bottom of the heel. The top piece is the part that touches the ground. The top piece may be constructed for traction on the ground and for durability.

Heel breast 72—the front or forward facing part of the heel that is under the arch of the sole. The heel breast may be characterized as the front face of the heel.

Heel seat 73—the top of the heel that is attached to the upper.

Vamp 80—The portion of the upper that covers the front of the foot.

In this disclosure, a shoe accoutrement assembly is described for attaching onto a shoe. In particular, the shoe accoutrement assembly provides for enhancing versatility, for example for different events, and look of a shoe by attaching fashionable embellishments to the shoe. As described herein, one or more embellishments may be provided upon an accoutrement. One or more accoutrements may be provided upon a shoe.

In accordance with at least one embodiment of the disclosure, the shoe accoutrement assembly includes what is herein characterized as a spine, at least one securement device, and at least one accoutrement. The spine may be curved to be positioned along or adjacent a back surface of the shoe 10. For example, the spine may extend from a bottom portion of the heel, i.e. from the top piece 71 of the heel, upwardly passed the heel seat 73 of the shoe, and along a back central surface of the shoe counter 60. The spine may extend up to the upper counter 62 of the shoe.

The structure of the spine of the disclosure may vary between embodiments. In some embodiments of the disclosure, the spine may extend along only a portion of the back of the heel, such as extending upwardly from a mid-portion of the heel. In some embodiments of the disclosure, the spine may extend past the top of the shoe, i.e. past the upper counter 62 of the shoe. Various other arrangements in addition to those described herein are within the purview of the disclosure.

The structure of the spine of the shoe accoutrement assembly may also vary. For example, the structure of the spine may curve, between concave and convex curvatures, so as to run substantially in parallel with a contour or curvature of the back of the shoe. On the other hand, the curvature of the spine may deviate from the particular contour or curvature of the back of the shoe.

At least one securement device may be attached onto the spine. The at least one securement device is provided to secure the shoe accoutrement assembly onto the particular shoe.

At least one accoutrement may be attached onto the spine. The at least one accoutrement may include a mount portion and an embellishment. The mount portion may be provided to attach the at least one accoutrement to the spine. The at least one embellishment is provided to embellish the shoe accoutrement assembly. There may be multiple accoutrements provided on the spine. Relatedly, there may be multiple embellishments provided on a particular accoutrement.

The at least one securement device may include an upper securement device and a lower securement device. The upper securement device may be provided on an upper spine portion.

The upper securement device may be adapted to secure onto an upper portion of the shoe. On the other hand, the lower securement device may be provided on a lower spine portion. The lower securement device may be adapted to secure onto a lower portion of the shoe.

As described above, the shoe accoutrement assembly may include multiple accoutrements. Illustratively, the multiple accoutrements may be constituted by a pair of accoutrement side parts, each respectively extending on opposing sides of the shoe from the spine. The angle, shape, orientation and other attributes of an accoutrement, as well as any embellishments provided on the accoutrement, may vary as desired.

As described above, the shoe accoutrement assembly may include at least one accoutrement that includes a mount portion. For example, the mount portion may include an end of a strap or strip that goes to form the accoutrement and/or may include other structure that goes to form the accoutrement. The mount portion may include a mount member that is attached to the spine.

For example, the mount member may be constituted by hook and loop fasteners. For example, the mount member may be constituted by an adhesive.

The shoe accoutrement assembly, in accordance with embodiments, includes an upper securement device. For example, the upper securement device may include at least one hook or hook device. The hook may be constituted by a single hook that hooks over the back of the shoe. On the other hand, the hook may be constituted by a pair of hooks that extend on opposing sides of the shoe—and that extend over the edge of opposing sides of the shoe so as to secure the shoe accoutrement assembly onto the shoe. Further details are described below.

As described above, the shoe accoutrement assembly may further include a lower securement device. The lower securement device secures a lower portion of the shoe accoutrement assembly onto the shoe. Accordingly, the upper securement device and the lower securement device may provide a two-point attachment arrangement so as to stably and securely attach the shoe accoutrement assembly to the shoe. Illustratively, the lower securement device may be constituted by a strap. The strap may include an attachment portion that is positioned on the spine. The attachment portion may include an attachment member that secures the attachment portion to the spine. For example, the attachment member may be constituted by a pin. The pin may pass through an opening in the lower spine portion. The strap may be adapted to secure to the heel of the shoe.

Further features and characteristics of embodiments of the shoe accoutrement assembly are described below.

With regard to one aspect of the disclosure, the shoe accoutrement assembly includes at least one securement device that is provided to secure the spine onto the shoe. Such a securement device may be of various structure such as in the form of a hook, for example. As described herein, the at least one securement device may include an attachment portion that serves to attach the securement device to the spine. In turn, the attachment portion may include an attachment member. Accordingly, for example, the attachment portion might be in the form of a flat portion of the securement device that is adapted or configured to mate with the shape of the spine, e.g. a flat portion of the spine.

Hand-in-hand, the attachment portion may include an attachment member such as an adhesive. Accordingly, in an embodiment, the attachment portion is attached to the spine via an attachment member, such as adhesive. In accordance with at least one embodiment of the disclosure, the attachment portion, including the attachment member provides structure so as to attach the securement device to the spine. Other structure may be provided so as to attach the securement device to the shoe itself. Indeed, in accordance with at least one embodiment of the disclosure, a primary function of the securement device, may be to attach the securement device, and thus the spine, to the shoe.

Relatedly, with regard to a least one aspect of the disclosure, the shoe accoutrement assembly includes at least one accoutrement. Each of the accoutrements may include at least one embellishment. Each accoutrements may be provided with a mount portion for attaching the accoutrement to the spine. For example, the mount portion may include a particular area or surface of the accoutrement. The mount portion may also be characterized as including a mount member. For example, the mount member might be adhesive. Accordingly, an embodiment of the disclosure might be characterized as including an accoutrement of which a mount portion, of the accoutrement, is attached to the spine via a mount member—and the mount member being an adhesive.

Figure 1:
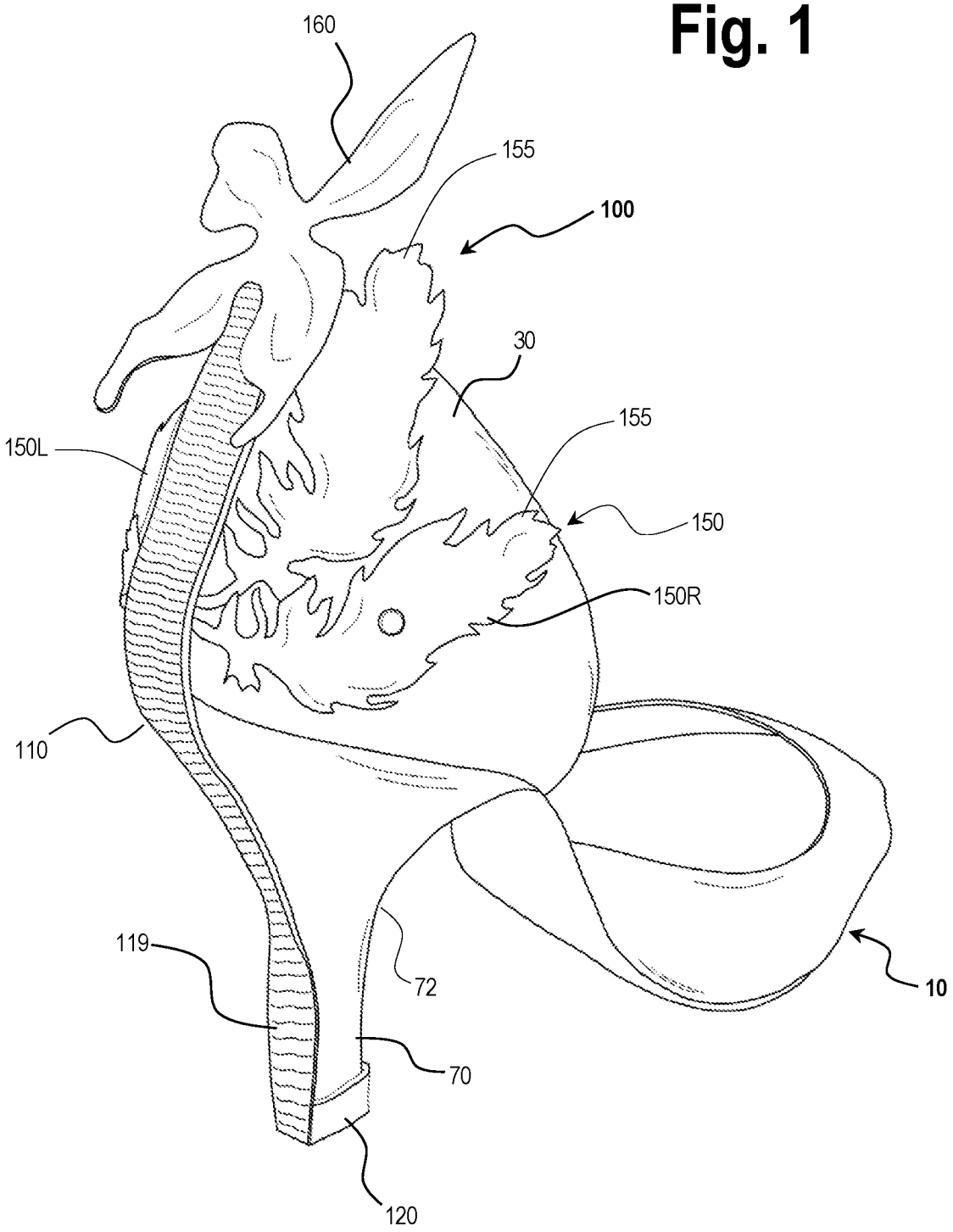
FIG. 1 is a perspective view showing a shoe accoutrement assembly on a shoe, in accordance with at least one embodiment of the disclosure.

FIG. 1 is a perspective view showing a shoe accoutrement assembly 100 on a shoe 10, in accordance with at least one embodiment of the disclosure. The shoe accoutrement assembly 100 includes a spine 110, securement device and multiple accoutrements. More specifically, the shoe accoutrement assembly 100 includes a lower securement device constituted by heel strap 120, in accordance with at least one embodiment of the disclosure. The shoe accoutrement assembly may also include an upper securement device (not shown in FIG. 1). The upper securement device and the lower securement device 120 serve to attach the shoe accoutrement assembly 160 to the shoe 10.

Both the upper securement device and the lower securement device 120 may be connected to the spine 110—and serve to attach the spine to the shoe. In turn, the accoutrement 150 and the accoutrement 160 are both attached to the spine, in accordance with at least one embodiment of the disclosure. The accoutrement 150 may include opposing accoutrement side parts 150R, 150L. Further, each accoutrement side part may include multiple parts, i.e. embellishments 155, as shown in FIG. 1. The accoutrement side parts 150R, 150L may be provided and oriented so as to wrap around the shoe upper 30, as shown in FIG. 1. However, it is appreciated that the features and structure of the various embodiments of the disclosure provide for a wide variety of arrangements of accoutrements, and embellishments that ornate such accoutrements, as may be desired.

In the embodiment of FIG. 1, the lower securement device 120 is constituted by a heel strap. The heel strap 120 is attached to a lower extent of the spine 110 and wraps around at least a portion of the heel 70, including wrapping around a portion of the heel breast 72. While the arrangement of FIG. 1 shows the heel strap 120 provided at a lowermost portion of the heel 70, it is appreciated that the heel strap 120 (or other lower securement device) may be positioned around or at other portions of the heel. For example, a lower securement device may be attached to a midportion of the heel. In one aspect of the disclosure, it may be preferable to provide the lower securement device, such as a heel strap 120, at a lower portion of the heel as opposed to a high portion of the heel. Such may be desirable due to the changing curvature of the heel breast 72. That is, at a higher portion of the heel, a lower securement device may need to adapt to the changing curvature of the heel breast. With different shaped heel structure, different securement devices and structure of securement devices may be utilized so as to adapt to the different shaped heel structure.

As described herein, the spine 110 provides what may be characterized as base or a core structure. While providing such functionality, the spine 110 itself may be adorned or ornamented or embellished as may be desired. Illustratively, FIG. 1 shows ornamentation 119 provided on the spine 110. Also, it is appreciated that accoutrements may be provided at any location and any surface of the spine as may be desired.

Figure 2:
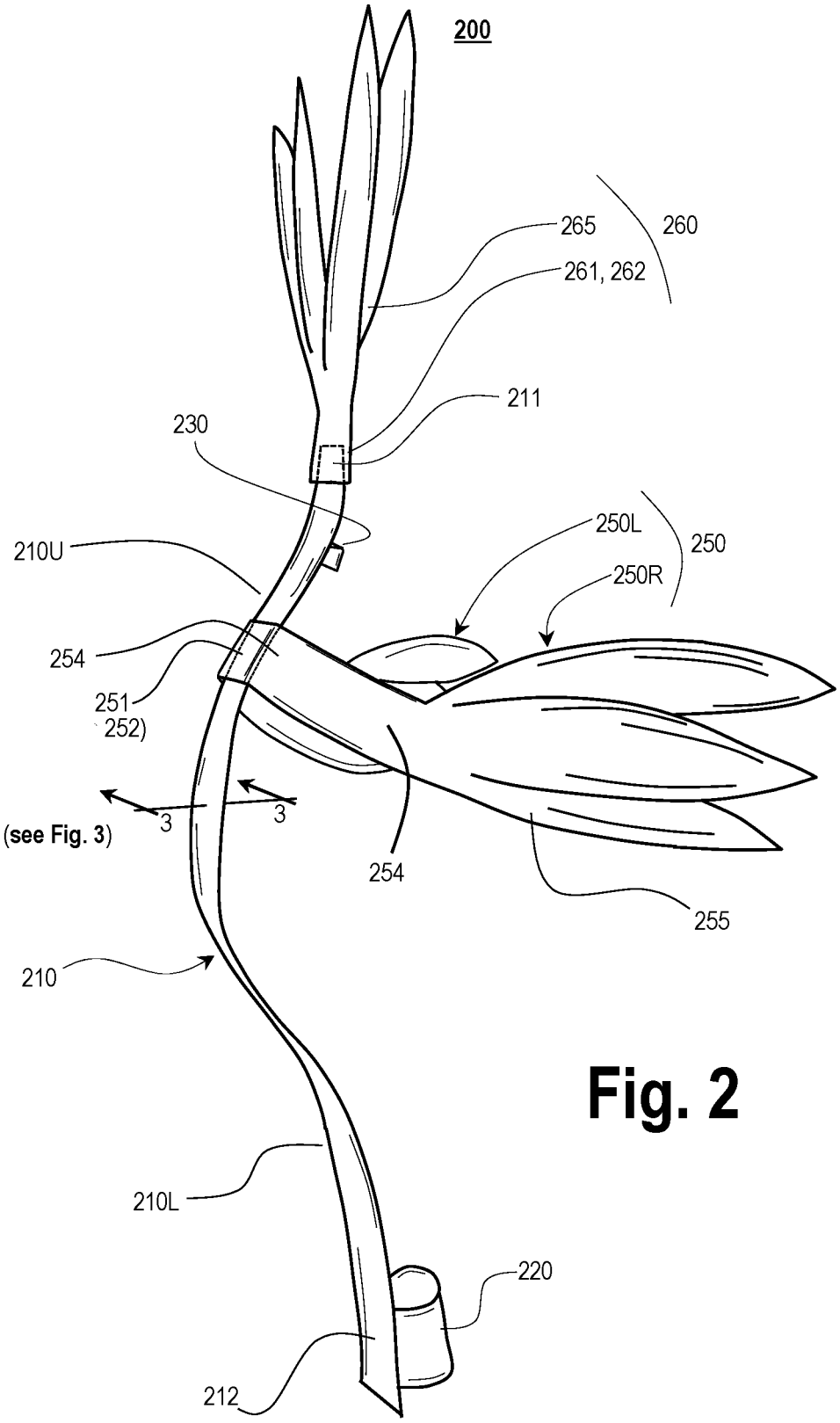
FIG. 2 is a perspective view showing a further shoe accoutrement assembly, in accordance with at least one embodiment of the disclosure.

FIG. 2 is a perspective view showing a further shoe accoutrement assembly 200, in accordance with at least one embodiment of the disclosure. As shown, the shoe accoutrement assembly 200 includes a spine 210, an upper securement device 230, and a lower securement device 220. The shoe accoutrement assembly further includes an accoutrement 250 and an accoutrement 260. The spine 210 may be characterized as including an upper spine portion 210U and a lower spine portion 210L.

The lower securement device 220 may be constituted by a strap. The upper securement device 230 may be constituted by a hook or hook device, in accordance with an embodiment of the disclosure. The spine 210 may include an attachment end 211 and an attachment end 212. The lower securement device 220 may be secured to the attachment end 212. The upper securement device 230 may be attached adjacent or proximate to the attachment end 211, at an upper end of the spine.

In general, the particular location of attachment of the securement devices and the location of attachment of the accoutrements may vary as desired. Such variability may be performed both in manufacture of the particular shoe accoutrement assembly in a manner that is not changeable by the ultimate end user. On the other hand, variability may also be afforded, in manufacture, to the end-user. For example, a Velcro, i.e. hook-and-loop, type attachment or magnet, for example, might be utilized so as to provide adaptability to an end-user of the shoe accoutrement assembly.

As shown in FIG. 2, both the accoutrement 250 and the accoutrement 260 are provided on the upper spine portion. In addition, the upper securement device 230 is provided on the upper spine portion 210U. The lower securement device 220 is provided on the lower spine portion 210L.

The accoutrement 250 includes accoutrement side part 250L and accoutrement side part 250R. Each of such accoutrement side parts may be provided with one or more embellishments 255. The accoutrement 250 may include a mount portion 251. The mount portion 251 may include an attachment member that serves to attach the mount portion 251 to the spine 210. For example, the attachment member may be constituted by hook and loop fastener or adhesive, for example.

The accoutrement 250 may also be characterized as including an extension portion 254. The extension portion 254 serves to separate one or more embellishments 255 from the mount portion 251. The extension portion 254 may be in the form of a strip of material or wire, for example. Dimensions of the extension portion 254 may vary as desired. Illustratively, the extension portion 254 may serve the function of separating embellishments (provided on the particular accoutrement) from the mount portion 251 for either aesthetic reasons and/or for functional reasons. For example, such arrangement may be desirable in the situation where the user is wearing pants. That is, the extension portion 254 may serve to space an embellishment so as to not interfere with desired movement of a lower portion of the pants or cuff.

With further reference to FIG. 2, the shoe accoutrement assembly 200 also includes accoutrement 260. The accoutrement 260 includes mount portion 261. For example, the mount portion 261 may be attached to the attachment end 211 (of the spine 210) utilizing a suitable mount member. Such a mount member may be constituted by Velcro, for example. The accoutrement 260 may be provided with embellishments 265. The embellishments 265 may be of shape and other attributes as may be desired.

Figure 3:
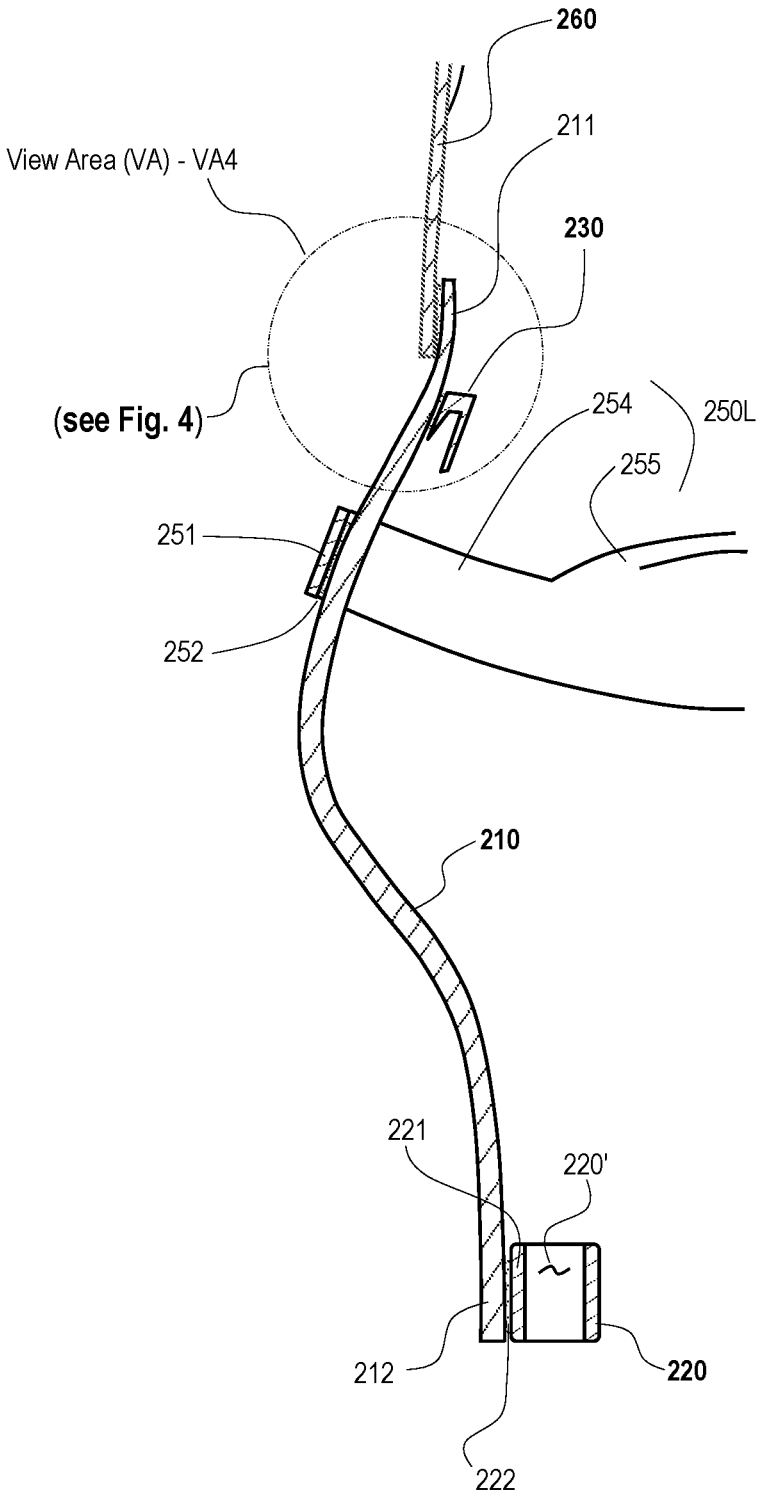
FIG. 3 is a cross-sectional view of a shoe accoutrement assembly, along line 3-3 of FIG. 2, the same as or similar to the shoe accoutrement assembly of FIG. 2, in accordance with at least one embodiment of the disclosure.

FIG. 3 is a cross-sectional view of a shoe accoutrement assembly 200, along line 3-3 of FIG. 2, the same as or similar to the shoe accoutrement assembly of FIG. 2, in accordance with at least one embodiment of the disclosure. FIG. 3 shows further details of mount portion 251. Illustratively, the mount portion 251 may be in the form of a flat or curved structure that conforms or substantially conforms to the shape of spine 210. While variance in this respect is within the purview of the disclosure, it is appreciated that as the shape or contour of the mount portion 251 varies more and more from the shape or contour of the spine 210—it may be the case that securement or attachment of the mount portion 251 to the spine 210 becomes problematic. The mount portion 251 may be attached onto the spine 210 utilizing a mount member 252. For example, the mount member 252 may be constituted by adhesive or an adhesive pad 252.

FIG. 3 also shows further detail of the manner in which the lower securement device 220 is attached to the spine 210. In particular, the lower securement device 220 may be attached to the lower attachment end 212 of the spine 210. Specifically, a side of the lower securement device 220, i.e. a segment of the strap, may constitute an attachment portion 221. The attachment portion 221 is attached to the spine 210 utilizing adhesive or adhesive pad 222. Accordingly, the adhesive or adhesive pad constitutes an attachment member 222.

Figure 4:
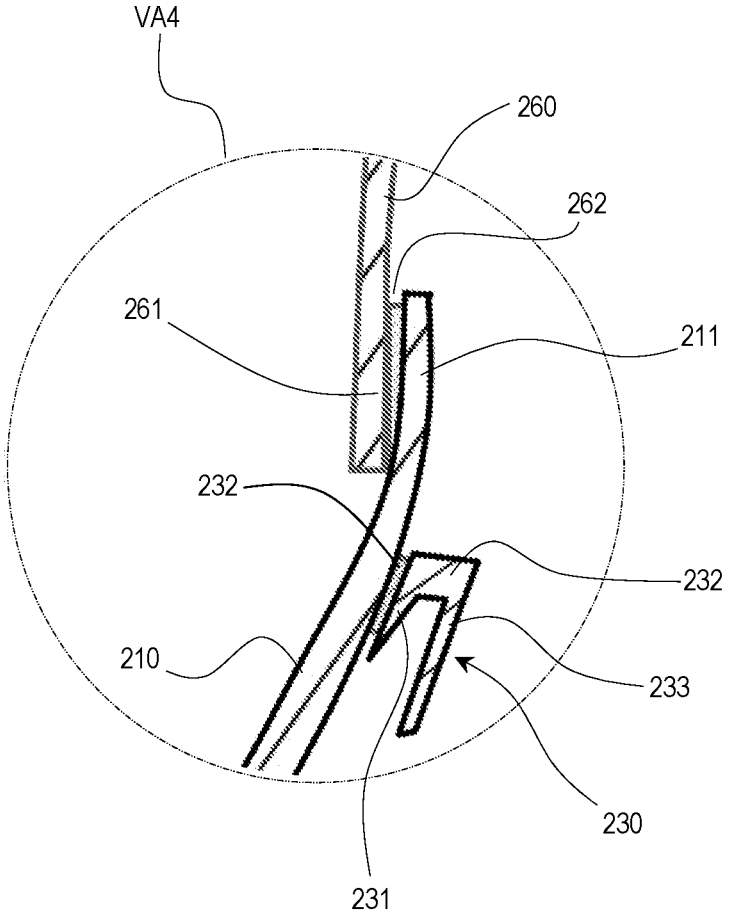
FIG. 4 is a cross-sectional view of view area 4 (VA4) of the shoe accoutrement assembly of FIG. 3, in accordance with at least one embodiment of the disclosure.

FIG. 4 is a cross-sectional view of view area 4 (VA4) of the shoe accoutrement assembly of FIG. 3, in accordance with at least one embodiment of the disclosure. FIG. 4 is provided to show further details of the manner in which upper securement device 230 and accoutrement 260 are attached to the spine 210.

As shown in FIG. 4, the upper securement device 230 may be attached onto an upper portion of the spine 210. As shown, the attachment portion 231 may be constituted by a segment of material or what might be constituted as a "leg". It is appreciated that attributes of the attachment portion 231 such as height, dimension, strength, and overall size, may vary as desired. The attachment portion 231 may be attached to or onto the spine 210 utilizing an adhesive or adhesive pad 232. Accordingly, in such arrangement, the adhesive pad 232 constitutes an attachment member. The upper securement device 230 may also include, in this embodiment, an interior engagement tab 233 and an extension portion 232. The extension portion 232 may be provided so as to span across the upper counter 62 and/or back collar 52 of a shoe 10. Such structure effectively spaces the interior engagement tab 233 away from the spine 210—so that the interior engagement tab 233 may well extend along a portion interior to the upper counter 62 and/or back counter 61 of the shoe, i.e. along the inside back of the shoe. Attributes of the interior engagement tab 233, including dimensional attributes, may vary as desired.

As also shown in FIG. 4, the accoutrement 260 may be attached to spine 210 at a mount portion 261 of the accoutrement 260. Further, the mount portion 261 may include a mount member constituted by, in this embodiment, an adhesive pad 262.

Accordingly, the securement device may include an attachment portion. The attachment portion may be, for example, a portion of the securement device and include an attachment member. The attachment member may be adhesive, a snap or hook-and-loop fastener, for example. Further, as shown in FIG. 4, the accoutrement may include a mount portion. The mount portion may be, for example, a portion of the accoutrement and include a mount member. The mount member may be adhesive, a snap or hook-and-loop fastener, for example.

Figure 5:
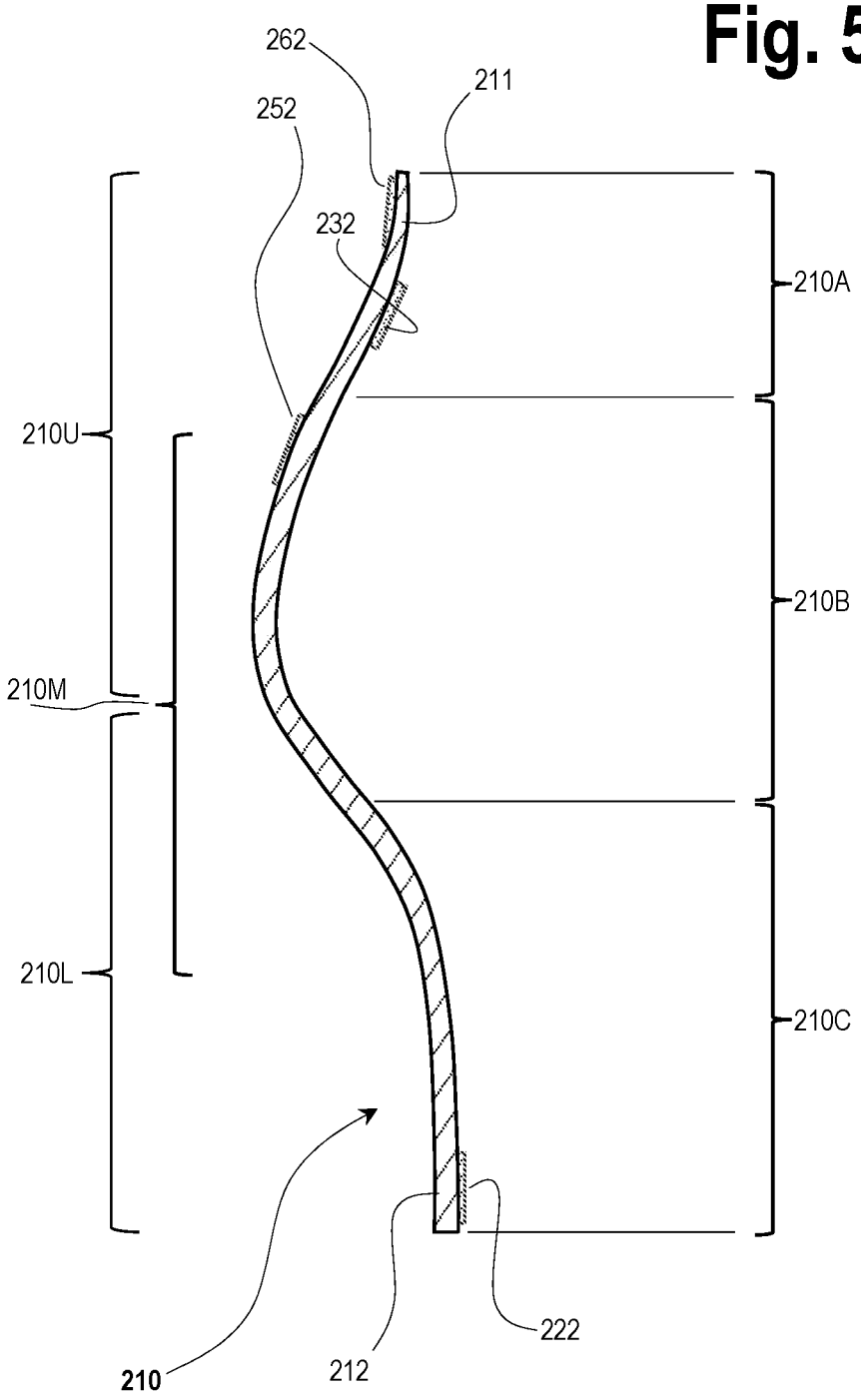
FIG. 5 is a further cross-sectional view of a shoe accoutrement assembly the same as or similar to the shoe accoutrement assembly of FIG. 2, in accordance with at least one embodiment of the disclosure.

FIG. 5 is a further cross-sectional view of a shoe accoutrement assembly 200 the same as or similar to the shoe accoutrement assembly of FIG. 2, in accordance with at least one embodiment of the disclosure.

As described above, attributes of spine 210, in accordance with the embodiments of the disclosure, may vary. FIG. 5 is provided with a focus on variance in the shape of the spine 210 as well as to describe characterizations of portions of the spine 210.

As described above, the spine 210 may be characterized as including an upper spine portion 210U and a lower spine portion 210L. As is shown in FIG. 5, the spine 210 may also be characterized as including a middle spine portion 210M. The middle spine portion 210M may overlap, as shown, with the upper spine portion 210U and a lower spine portion 210L. In this embodiment, adhesive pad 252 for connecting an accoutrement; adhesive pad 262 for connecting a further accoutrement; and adhesive pad 232 for connection to the upper securement device may all be provided in the upper spine portion 210U. On the other hand, adhesive pad 222, for connection to a lower securement device, is provided on the lower spine portion 210 L. It is appreciated that such attachment locations may be varied along the length of the spine 210 as may be desired. Such variance may depend on the structure of the particular shoe or type of shoe upon which the shoe accoutrement assembly is to be mounted. Such variance may also depend on the manner of attachment of the shoe accoutrement assembly to the shoe, i.e. the particular structure that is utilized as the securement devices. Such a variance may also depend on the particular accoutrements and/or embellishments provided in the shoe accoutrement assembly.

Relatedly, it is appreciated that any number of securement devices may be utilized to secure the shoe accoutrement assembly to a particular shoe. For example, one securement device may be utilized. On the other hand, 2, 3 or more securement devices may be utilized so as to secure the shoe accoutrement assembly to the shoe. Further, it is appreciated that any number of accoutrements and embellishments may be provided on a shoe accoutrement assembly of the disclosure, as may be desired.

As otherwise described herein, the shape or contour of a side profile of the spine 210, as such side profile is shown in FIG. 5, may vary depending on the profile of the shoe upon which the shoe accoutrement assembly will be worn. In the illustrated example of FIG. 5, it is shown that the spine 210 may include conjoined convex and concave portions as viewed in the side profile of FIG. 5. While not notably shown in FIG. 5, it is appreciated that the shape of the profile of the spine 210 may also include straight sections if such is desired. The spine 210 may be constructed of metal, plastic or other bendable material that may be bent so as to conform to the back of the shoe. In other words, the spine 210 may be constructed of material that will bend so as to conform to the shape of a particular shoe, but return to its original shape upon securement devices being disengaged from the particular shoe. On the other hand, with other shoe assemblies, the spine 210 may be constructed of bendable or malleable material that will indeed retain its shape after being bent into a particular shape. Such bendable or malleable material might be constituted by a bendable metal strap or strip, for example. Yet further, the spine may be constructed of material that is substantially not bendable. It is appreciated that a wide variety of materials may be utilized in construction of the spine 210 of the shoe accoutrement assembly, as well as in construction of the various other components of the shoe accoutrement assembly.

Accordingly, with further reference to FIG. 5, the spine 210 may include a forward facing convex portion 210A, a forward facing concave portion 210B, and an additional forward facing convex portion 210C. Such shape or shapes, including the degree of concavity and/or convexity, may be varied desired, such as varied in manufacture and/or variable by the user.

Figure 6:
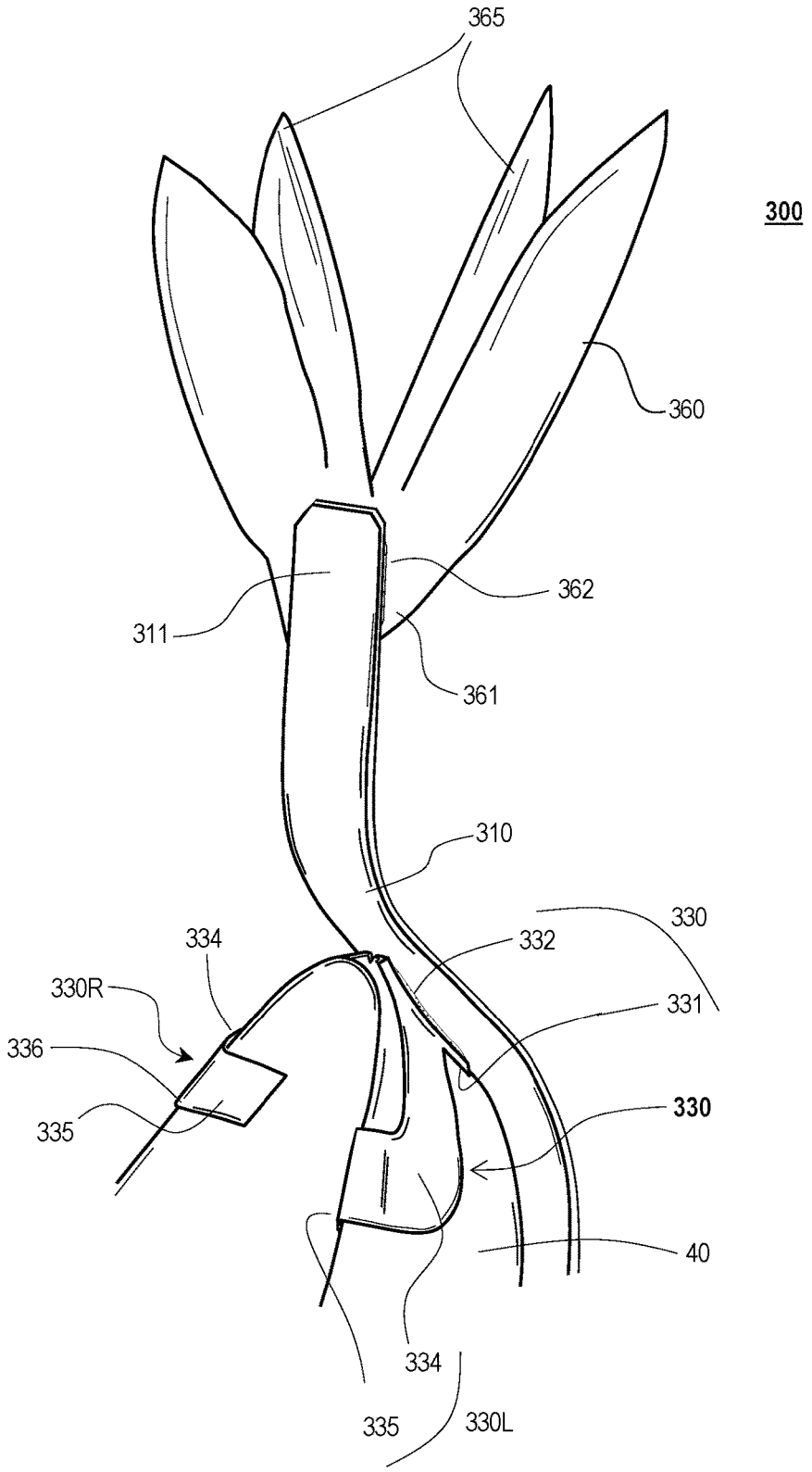
FIG. 6 is a perspective view showing a further shoe accoutrement assembly, in accordance with at least one embodiment of the disclosure.

FIG. 6 is a perspective view showing a further shoe accoutrement assembly 300, in accordance with at least one embodiment of the disclosure.

As shown in FIG. 6, the shoe accoutrement assembly 300 includes a spine 310, an upper securement device 330 and an accoutrement 360. The accoutrement 360 may be provided with a plurality of embellishments 365. The accoutrement 360, as shown, includes mount portion 361. The mount portion 361 may be constituted by a lower area or portion of the accoutrement 360. The mount portion 361 may be attached to the spine 310 (at an attachment end 311 of the spine 310) via a mount member 362. In the arrangement of FIG. 6, the mount member 362 is constituted by an adhesive pad. Other construct may be utilized for the mount member 362, such as Velcro.

FIG. 6 shows an arrangement in which accoutrement 360 includes embellishments 365 that extend above and passed an upper end of the spine 310. However, as otherwise described herein, it is appreciated that other arrangements may be provided. For example, accoutrements along with embellishments on those accoutrements may be provided as separate units on opposing sides of the spine 310, have different shape, different design, vary in number, and/or vary in other attributes.

The shoe accoutrement assembly 300 of FIG. 6 also includes the upper securement device 330. The upper securement device 330 may include side extensions 330L and 330R. As shown, the side extension 330L extends on the left-hand side of the shoe quarter 40. On the other hand, the side extension 330R extends on the right-hand side of the shoe quarter 40. Accordingly, in the arrangement of FIG. 6, the side extensions of the upper securement device are wrapped around opposing sides of the shoe.

Figure 7:
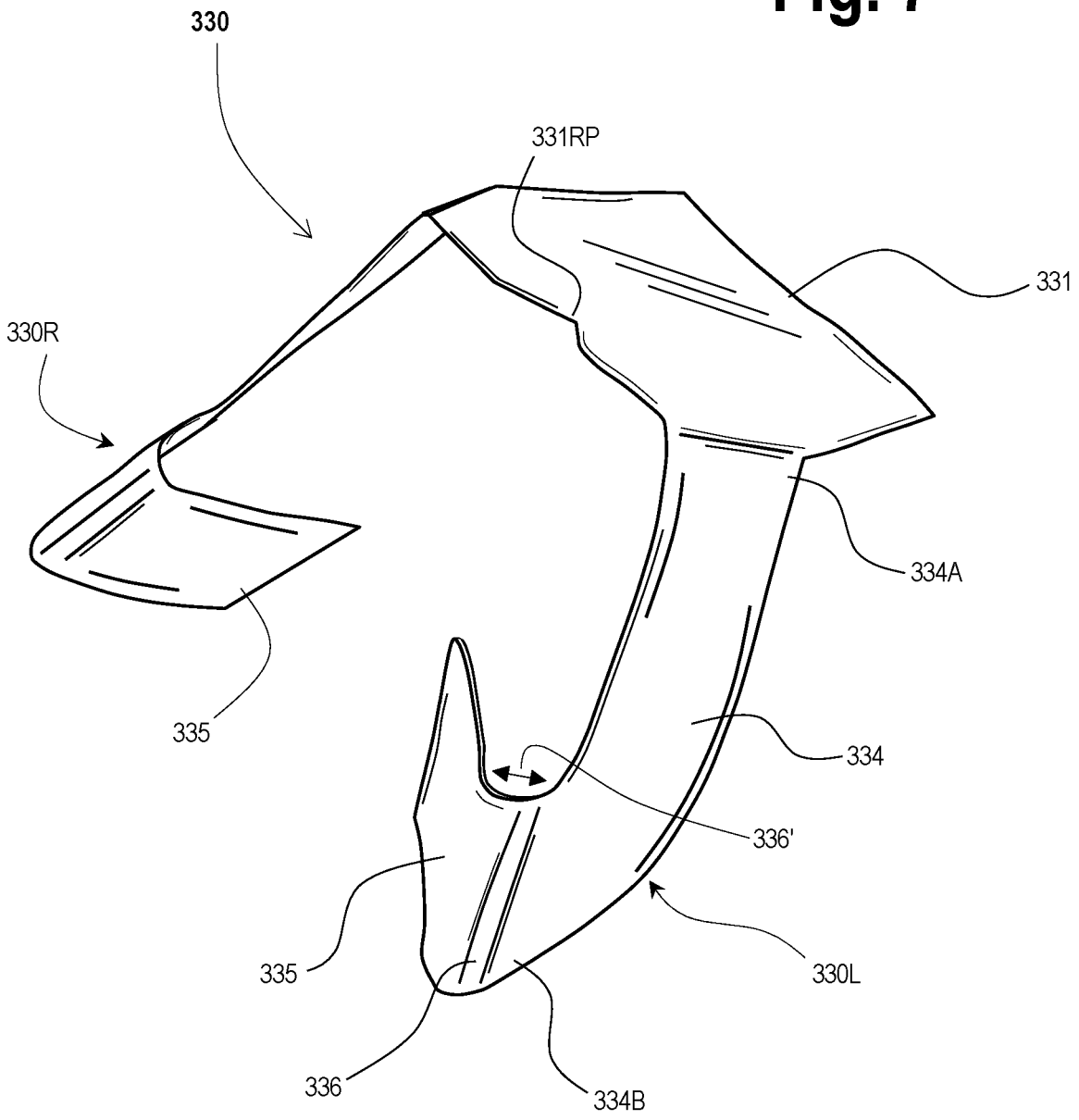
FIG. 7 is a perspective view showing an upper securement device, in accordance with at least one embodiment of the disclosure.

Each side extension 330L and 330R includes an extension portion 334 and an interior engagement 335. Each extension portion extends, from an attachment portion 331, forward a desired length or distance along the side and/or top of the shoe. The extension portion 334 connects with an interior engagement tab 335, in accordance with one or more embodiments. A bend portion 336 may demarcate the extension portion 334 and the interior engagement tab 335. Further details are also shown in FIG. 7. Each interior engagement tab 335 extends into the shoe at or adjacent to the side collar 51 of the shoe. It is appreciated that the interior engagement tabs 335 may be provided with a low profile and/or possess thinness in structure so as to be minimally intrusive to feel and comfort of the shoe during wear of the shoe.

The securement device 330 includes attachment portion 331 and attachment member 332. The attachment member 332 may be constituted by an adhesive pad 332.

FIG. 7 is a perspective view showing an upper securement device, in accordance with at least one embodiment of the disclosure. The upper securement device 330 of FIG. 7 is the same as or similar to the upper securement device shown in FIG. 6. As shown in FIG. 7, the upper securement device 330 includes side extensions 330L and 330R. Such side extensions may be of similar structure to each other and be of mirror image to each other.

With illustrative reference to the side extension 330L, such side extension includes the extension portion 334 which extends between an outer end 334B and an inner end 334A. The inner end 334A is attached to the attachment portion 331. The outer end 334B extends out to (and is connected to) the interior engagement tab 335. As shown in FIG. 7, a bend portion 336 may connect the interior engagement tab 335 to the extension portion 334. Accordingly, the extension portion 334 may include an outer end 334B that is directly connected to a bend portion 336. In turn, the bend portion 336 may be directly connected to the interior engagement tab 335.

The bend portion 336 may be provided with a bend having a diameter 336' or other bend dimension(s) or attributes so as to afford a suitable gap or opening between the extension portion 334 and the interior engagement tab 335 into which the side collar 51 of a shoe may be received.

As shown in FIG. 7, the attachment portion 331 may be constituted by a substantially flat or planar portion. A relief portion 331RP may be provided on the attachment portion 331. The relief portion 331 RP may be provided so as to be removed or spaced from the top of the shoe, i.e. so as to disrupt lines of the existing shoe to a lesser extent.

In contrast to the flat construction of the attachment portion 331, the attachment portion 441 (of the upper securement device 440 shown in FIG. 8) may include an attachment portion 441 that is bent or folded along a fold line 441FL.

Figure 8:
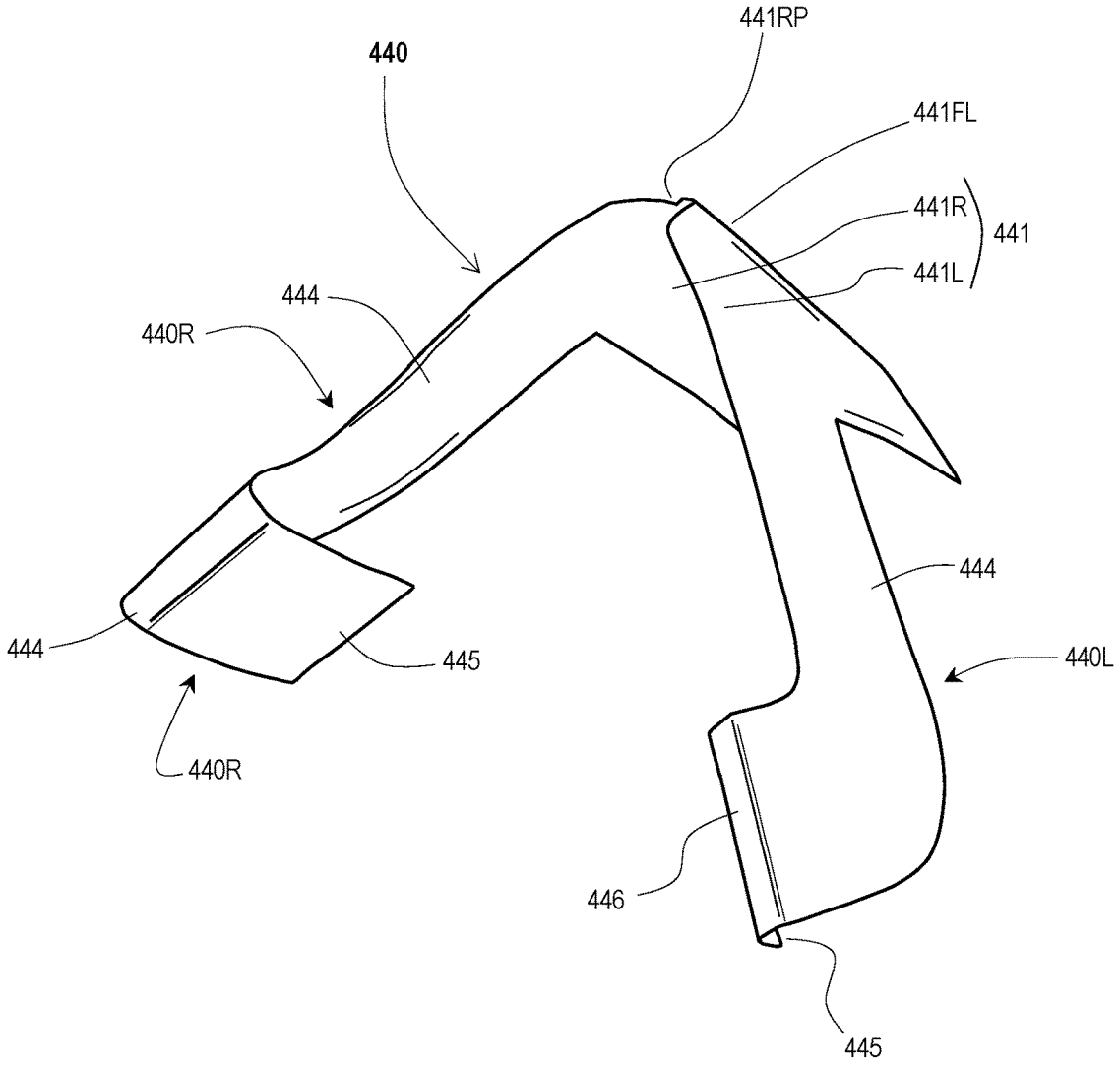
FIG. 8 is a perspective view showing a further upper securement device, in accordance with at least one embodiment of the disclosure.
Figure 9:
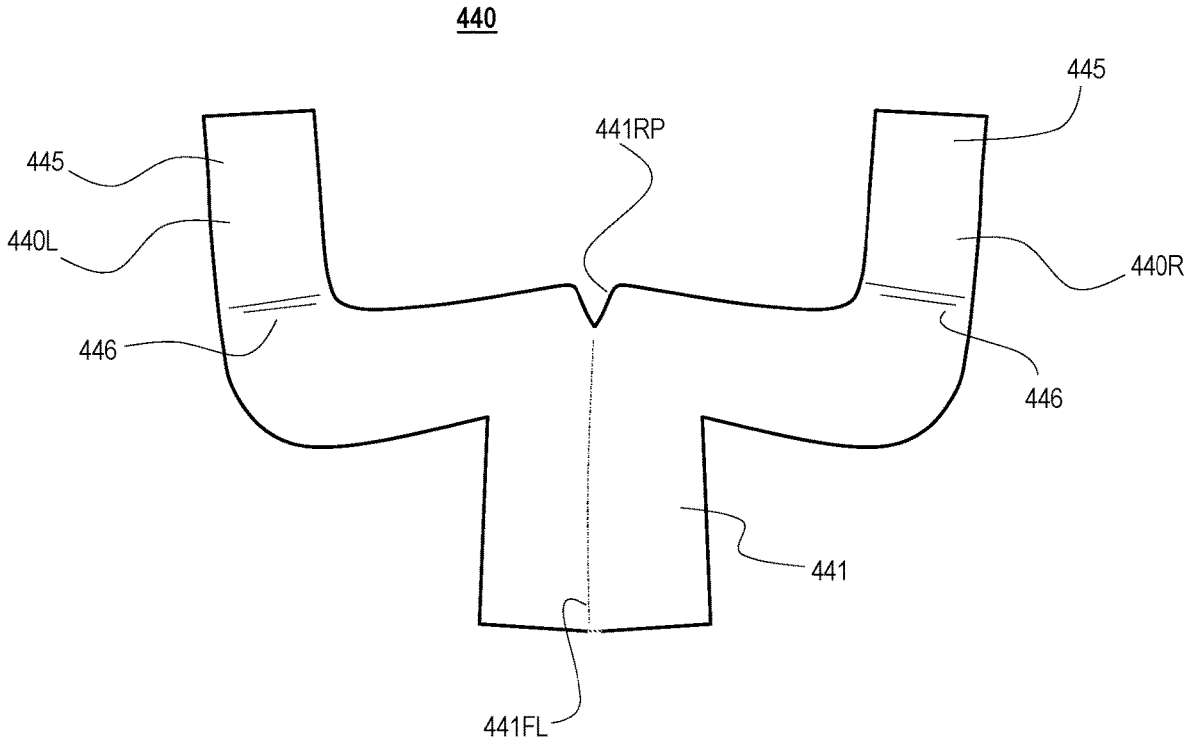
FIG. 9 is a perspective view showing a flattened upper securement device, in accordance with at least one embodiment of the disclosure.

Relatedly, FIG. 8 is a perspective view showing a further upper securement device, in accordance with at least one embodiment of the disclosure. FIG. 9 is a perspective view showing a flattened upper securement device the same as or similar to the device of FIG. 8, in accordance with at least one embodiment of the disclosure.

The upper securement device 440 may be of similar construction to the upper securement device 330 a FIG. 7. However, as described above, one distinction between such two embodiments includes construction of the attachment portion 331 versus the attachment portion 441. The attachment portion 331 may be substantially planar or flat. On the other hand, the attachment portion 441 may include a fold line 441FL. The fold line 441FL constitutes a line or bend along which the attachment portion 441 may be bent or folded. In practice of the disclosure, it is appreciated that the arrangement of FIG. 8, including the fold line 441FL, provides an arrangement which may engage or mate well with the counter or back of the shoe. Indeed, the fold or bend may be provided in manufacturer or provided by the user so as to provide a bend that matches with the back of the shoe. On the other hand, the fold or bend arrangement of FIG. 9 may provide complexities associated with connection of the upper securement device to a spine, to which the upper securement device is attached. On the other hand, the planar arrangement of FIG. 7 may provide an effective surface to attach onto a spine, but not as effectively engage or mate with the counter or back of the shoe. In general, it is appreciated that the particular shape of the attachment portion 441 may be provided so as to effectively engage and mate with the back of the shoe—as well as to effectively engage and mate with a supporting spine. In at least one embodiment, with the arrangement of FIG. 8, an effective attachment member may be utilized to provide the connection between the fold or bend portion of the attachment member vis-à-vis a surface of the spine to which the attachment portion is attached (via the attachment member). For example, the spine itself may be bent or V-shaped so as to mate or engage with the attachment portion 441.

With further reference to FIGS. 8 and 9, the upper securement device 440 may be provided with a relief portion 441RP. In similar manner to the relief portion 331RP (FIG. 7)—the relief portion 441RP may be provided to afford an opening or space from the upper counter 62 or back collar 52 of the shoe. Additionally, with the embodiment of FIG. 8 and FIG. 9, the relief portion 441RP may assist and/or be complementary to the fold line 441FL.

Accordingly, the fold line 441FL may define or demarcate a right attachment portion 441R and a left attachment portion 441L. The right attachment portion 441R and the left attachment portion 441L go to make up the attachment portion 441, in accordance with at least one embodiment of the disclosure. The upper securement device 440 may also include a side extension 440L and a side extension 440R on the left and right sides, respectively. Each of the side extensions 440L, 440R may include or be associated with an extension portion 444, a bend portion 446, and an interior engagement tab 445. The structure of such elements may correspond substantially with the structure of the upper securement device 330 of FIG. 7 described above. With reference to FIG. 8, the attachment portion 441 may be provided with a hook, to provide securement to a shoe.

Figure 10:
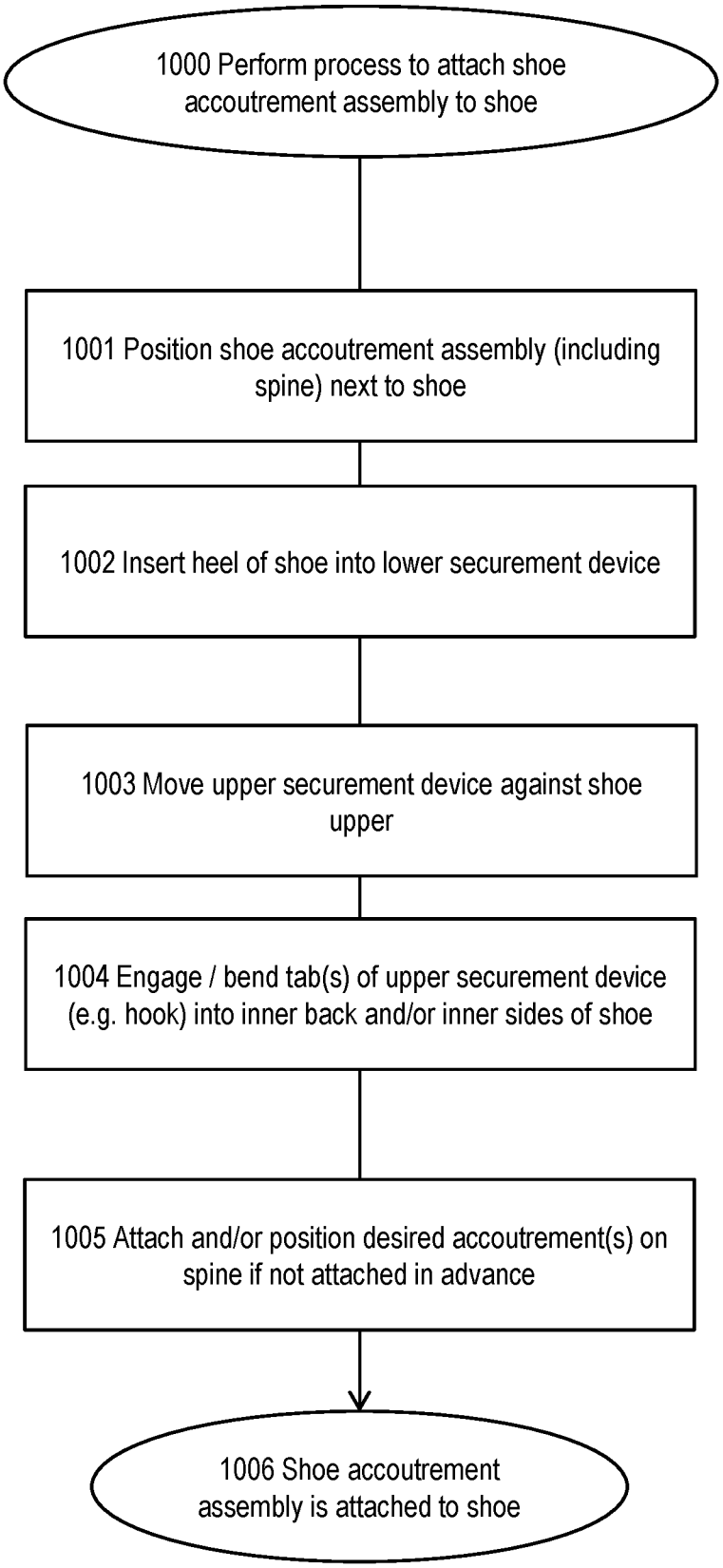
FIG. 10 is a flowchart showing a process to attach a shoe accoutrement assembly to a shoe, in accordance with at least one embodiment of the disclosure.

FIG. 10 is a flowchart showing a process to attach a shoe accoutrement assembly to a shoe, in accordance with at least one embodiment of the disclosure. Various embodiments of the shoe accoutrement assembly of the disclosure are described herein. FIG. 10 sets forth illustrative steps, in accordance with one or more embodiments, that may be implemented in conjunction with mounting a shoe accoutrement assembly, of the disclosure, to a shoe. As shown, the process starts in step 1000 and passes to step 1001. In step 1001, the user positions a shoe accoutrement assembly of the disclosure next to a shoe. In particular, step 1001 may include positioning the spine of the shoe accoutrement assembly next to the back of the shoe. Then, the process passes to step 1002. In step 1002, the user inserts the heel of the shoe into a lower securement device. For example, such processing might include insertion of the heel or top piece 71 of a shoe into the lower securement device 220 of FIG. 2, in accordance with at least one embodiment of the disclosure. However, the disclosure is not limited to the particulars of step 1002. For example, instead of insertion of the heel of a shoe into a lower securement device (of the shoe accoutrement assembly) the lower securement device might be wrapped around the heel or otherwise engaged with the heel of the shoe or other portion of the shoe.

After step 1002, the process passes to step 1003. In step 1003, the user moves or positions an upper securement device against the shoe upper. In particular, such process step might include moving an upper portion of the spine of the shoe accoutrement assembly, which is attached to the upper securement device, adjacent or next to the back counter 61 and/or upper counter 62 of the shoe. Then, the process passes to step 1004.

In step 1004, the user engages, bends, or otherwise attaches one or more tabs (or other connection mechanisms) of the upper securement device into or onto the inner back and/or inner sides of the shoe. In particular, such engagement might include engaging the upper securement device with the back collar 52 or the side collar(s) 51 of the shoe. For example, such engaging might include engaging or slipping a hook (of the upper securement device) over the upper counter 62 of the shoe. After step 1004, the process passes to step 1005.

In step 1005, the user attaches and/or positions desired accoutrements on the spine. In some embodiments of the disclosure, the positioning and/or attachment of accoutrements might occur after the spine is attached to the shoe. In other embodiments, the position and/or attachment of accoutrements might occur prior to the spine being attached to the shoe. As otherwise described herein, any number of accoutrements may be attached to the spine as may be desired. Further, each of the accoutrements may include embellishments of number, shape, design, type, or other attributes as may be desired. After the processing of step 1005, the process passes to step 1006.

Step 1006 reflects that the shoe accoutrement assembly, of the disclosure, is attached to the shoe. It is of course appreciated that the process and steps of FIG. 10 may be applied to both shoes of a pair of shoes. The process and steps of FIG. 10 are illustrative of at least one embodiment of the disclosure. It is appreciated that various other features and process assembly steps are described herein that may be used in conjunction with or in lieu of the features described in FIG. 10.

Figure 11:
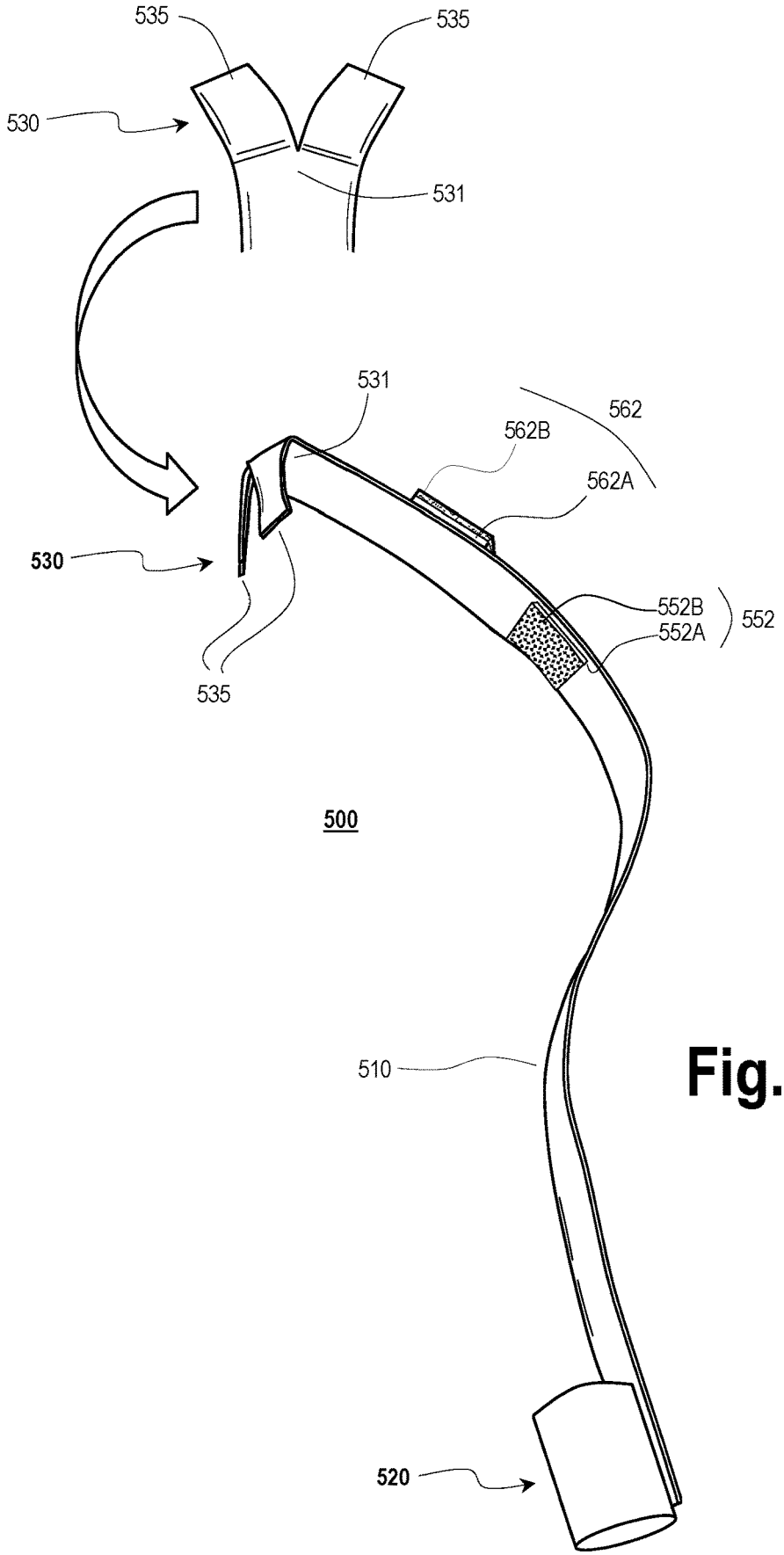
FIG. 11 is a perspective view showing a further shoe accoutrement assembly, with detail of a upper securement device, in accordance with at least one embodiment of the disclosure.

FIG. 11 is a perspective view showing a further shoe accoutrement assembly 500, with detail of a upper securement device, in accordance with at least one embodiment of the disclosure.

The shoe accoutrement assembly 500 of FIG. 11 includes spine 510, lower securement device 520 and upper securement device 530. Additionally, the shoe accoutrement assembly 500 of FIG. 11 includes mount members 552 and 562. The mount members are provided to attach accoutrements with embellishments to the spine 510 as may be desired.

The mount member 562 includes a support substrate 562A and a fastener layer 562B. The support substrate 562A might be constituted by an adhesive backing. The adhesive backing 562A may be provided to attach fastener layer 562B to the spine 510. The fastener layer 562B may be, for example, a collection of hooks (provided to attach to mating loop fasteners), OR the fastener layer 562B may be, for example, a collection of loops (provided to attach to mating hook fasteners). The mount member 552 may include similar structure to the mount member 562. Accordingly, the mount member 552 may include a support substrate 552A and a fastener layer 552B.

The shoe accoutrement assembly 500, of FIG. 11, also includes a lower securement device 520. The lower securement device serves to connect a lower end of the shoe accoutrement assembly 500 to the shoe, and in particular to the heel of the shoe, in accordance with at least one embodiment of the disclosure. Further details of the lower securement device 520 are described below.

FIG. 11 also shows details of upper securement device 530. In the embodiment of FIG. 11, the device 530 may be characterized as including an attachment portion 531 that connects to attachment members 535. The attachment portion 531 may be an end portion of the top of spine 510. The attachment member or members may be constituted by interior engagement tabs 535. The interior engagement tabs 535 may be attached to, hook onto and/or latch onto an upper counter 62 of the shoe 10, for example. The interior engagement tabs 535, in accord with one aspect of the disclosure, may be provided to be positioned about the Achilles tendon of the wearer of the shoe. It is appreciated that particular dimensions and other spatial attributes of the interior engagement tabs 535 may vary as desired. Further, as with other structure in other embodiments, the interior engagement tabs 535 may be constructed of bendable metal or other material so as to be adjustable by the user.

Figure 12:
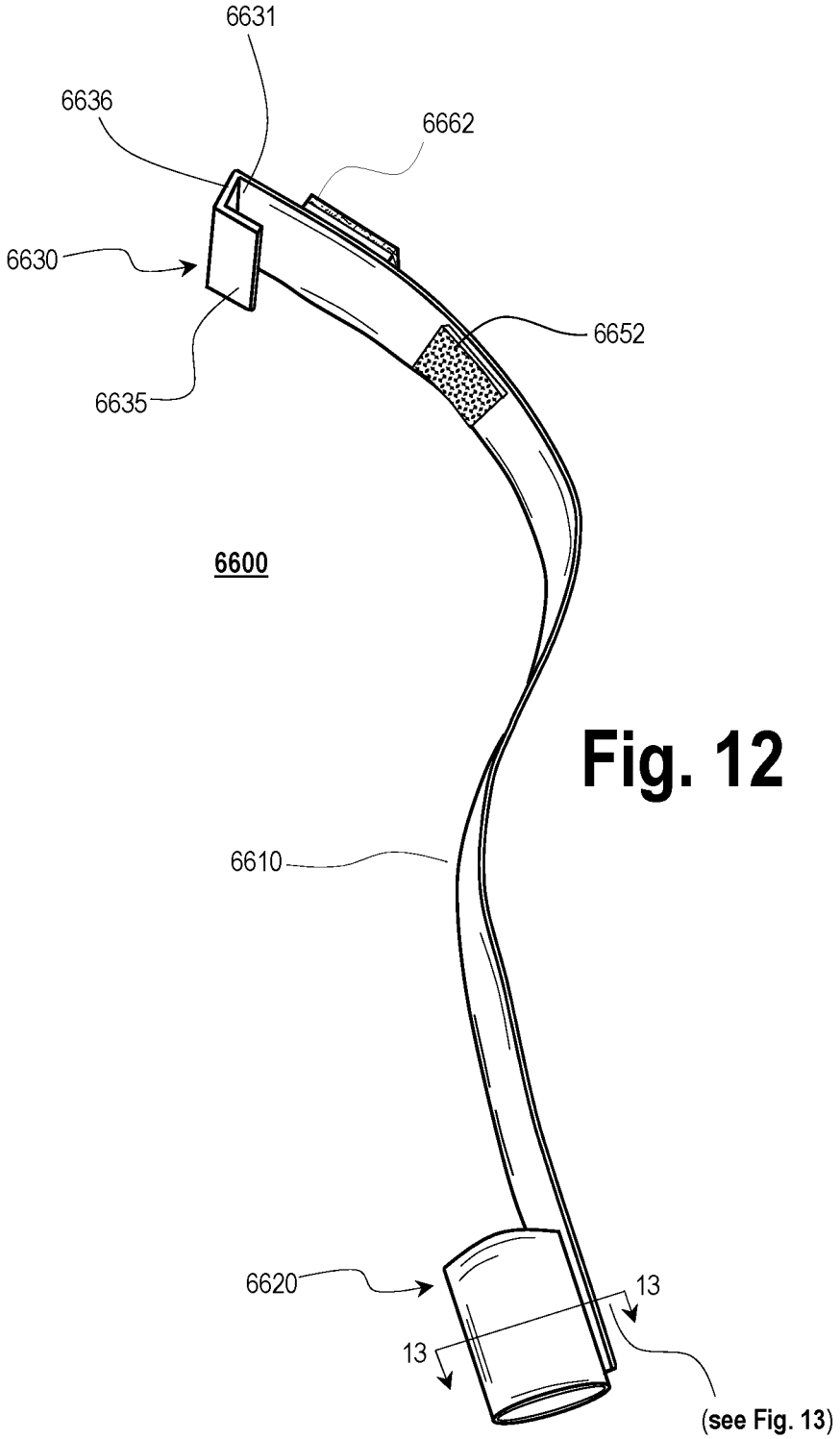
FIG. 12 is a perspective view showing a further shoe accoutrement assembly, in accordance with at least one embodiment of the disclosure.

FIG. 12 is a perspective view showing a further shoe accoutrement assembly 6600, in accordance with at least one embodiment of the disclosure. The shoe accoutrement assembly 6600 of FIG. 12 includes an upper securement device 6630 and a lower securement device 6620 that are both connected to a spine 6610. Additionally, the shoe accoutrement assembly 6600 includes a mount member 6652 and a mount member 6662. The mount members 6652, 6662 may be of similar structure to the mount members shown in FIG. 11.

The upper securement device 6630 may be attached to the spine 6610 at an attachment portion 6631. The attachment portion 6631 may be an integral portion of the top of the spine 6610.

Additionally, the upper securement device 6630 may include an extension portion 6636 and an interior engagement tab 6635. The extension portion 6636 serves to space the engagement tab 6635 from the attachment portion 6631 so as to provide a gap or opening into which the upper counter 62 of a shoe may be received. As a result, such arrangement provides for the interior engagement tab 6635 to lay smoothly against an interior of the shoe adjacent the back collar 52. In at least some embodiments, the upper securement device 6630, including in particular the interior engagement tab 6635, may be curved so as to conform to the interior shape of the interior of the shoe adjacent to the back collar 52, with further reference to FIG. 31.

The shoe accoutrement assembly 6600 of FIG. 12 also includes the lower securement device 6620. Further details of the lower securement device 6620 are described below with reference to FIG. 13.

Figure 13:
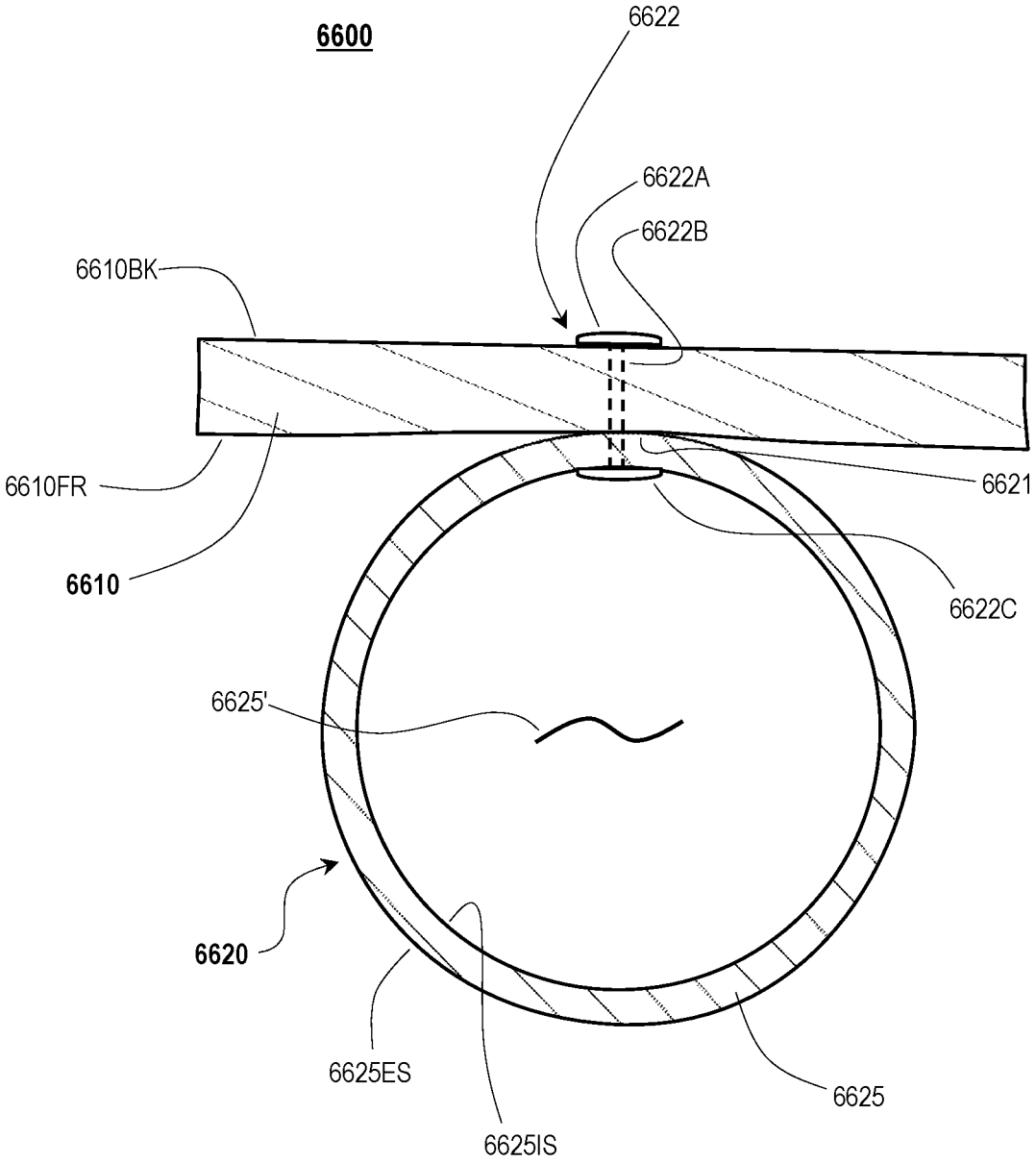
FIG. 13 is a cross-sectional view of a shoe accoutrement assembly, along line 13-13 of FIG. 12, the same as or similar to the shoe accoutrement assembly of FIG. 12, in accordance with at least one embodiment of the disclosure.

FIG. 13 is a cross-sectional view of a shoe accoutrement assembly 6600, along line 13-13 of FIG. 12, the same as or similar to the shoe accoutrement assembly of FIG. 12, in accordance with at least one embodiment of the disclosure. In particular, FIG. 13 shows the lower securement device 6620 attached to a lower portion of the spine 6610. The spine 6610 may be characterized as having a forward surface 6610FR and a back surface 6610BK. The lower securement device 6620 may be provided, so as to retain or fasten to the heel of the shoe, on (or adjacent to) the forward surface 6610FR. As shown, the lower securement device 6620 may include a sleeve 6625. The sleeve 6625 may be constituted by a tubular or cylindrical structure that defines opening 6625'. The heel 70 or top piece 71 of a shoe may be received into the opening 6625'. The sleeve 6625 may include an exterior surface 6625ES and an interior surface 66251S. The exterior surface 6625ES may be adorned or ornamented in a manner as desired. The interior surface 6625IS may be of size and dimension so as to engage with the heel 70 of the shoe. While depicted in FIG. 13 as constructed of a single material, the sleeve 6625 may be layered or constructed of different material. For example, the interior surface 6625 may be constructed of a rubber or gripping material. On the other hand, the exterior surface 6625 may be constructed of a material that is conducive to ornamentation and/or that provides protection against moisture or dirt, for example, to which the lower portion of the heel 70 may be exposed. The sleeve 6625, as shown in FIG. 13, as well as similar structure, may be constructed of materials such as rubber, rubber band, elastic, plastic, and/or metal, for example.

The shoe accoutrement assembly 6600, as shown in FIG. 13, also includes the attachment member 6622, which is disposed at an attachment portion 6621 of the sleeve 6625. The attachment member 6622 serves to connect the sleeve 6625 with the spine 6610. In this embodiment, the attachment member 6622 includes a pin or grommet type arrangement. Such arrangement may include a fastener head 6622A, a fastener shaft 6622B, and a further fastener head 6622C.

Figure 14:
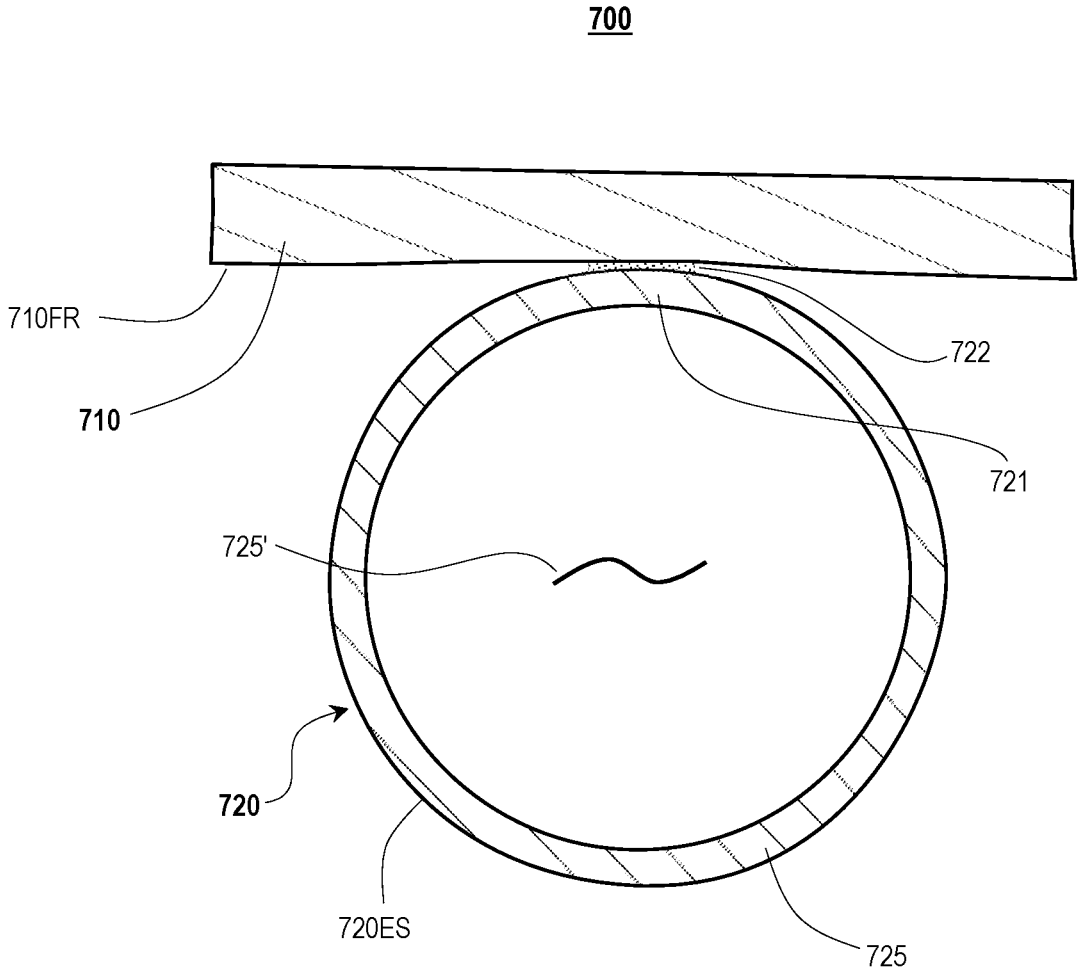
FIG. 14 is a cross-sectional view of a shoe accoutrement assembly, showing details of a lower securement device, in accordance with at least one embodiment of the disclosure.

FIG. 14 is a cross-sectional view of a shoe accoutrement assembly 700, showing details of a lower securement device 720, in accordance with at least one embodiment of the disclosure. In particular, FIG. 14 shows details of spine 710 and lower securement device 720. As shown, and similar to the lower securement device 620 of FIG. 13, the lower securement device 720 (of FIG. 14) may include a sleeve 725. The sleeve 725 may be constituted by a tubular or cylindrical structure that defines opening 625'. The heel 70 or top piece 71 of a shoe may be received into the opening 725'.

In contrast to the arrangement of FIG. 13, the lower securement device 720 is connected to the spine 710 utilizing adhesive 722. Accordingly, in this embodiment of FIG. 14, the adhesive constitutes an attachment member 722. The adhesive 722 connects an attachment portion 721 of the sleeve 725A to the forward surface 710FR of the spine 710. In particular, the adhesive 722 may be provided on an exterior surface 720ES of the attachment portion 721.

Figure 15:
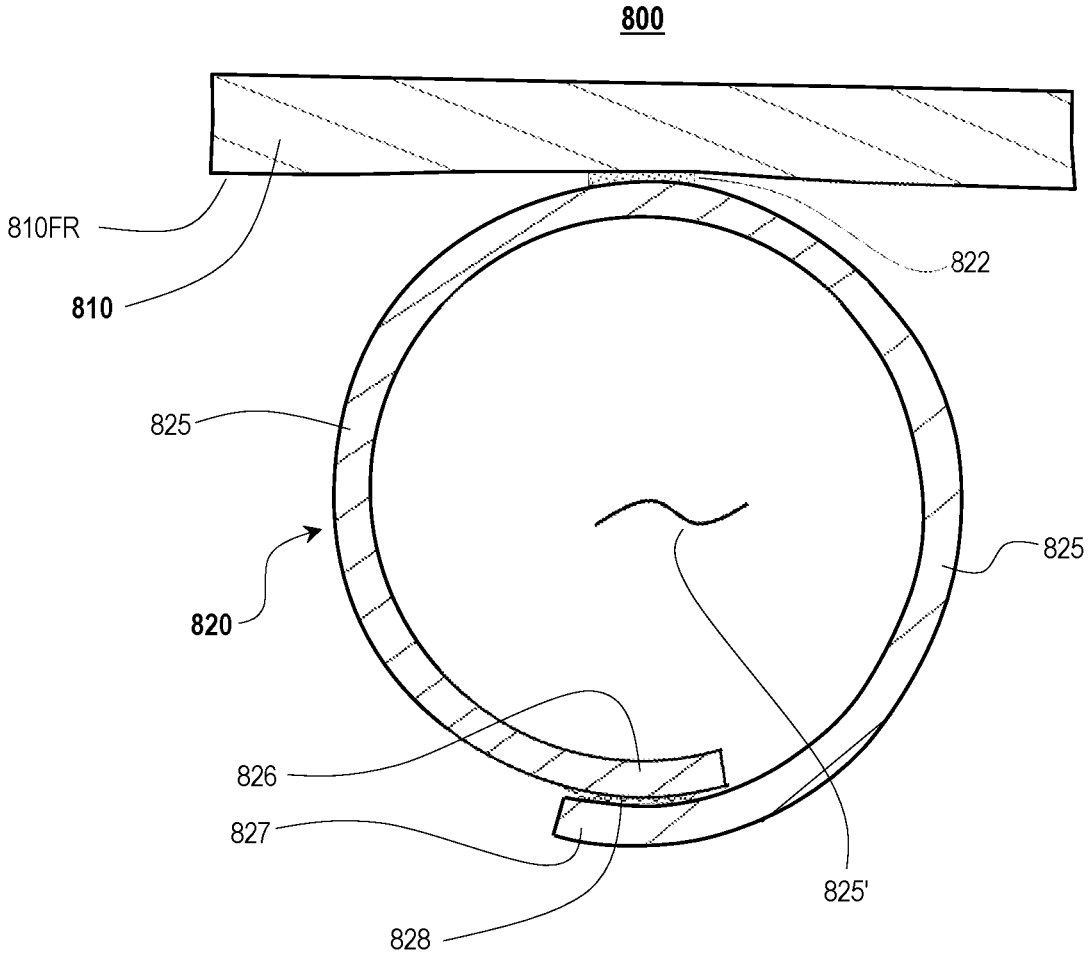
FIG. 15 is a cross-sectional view of a shoe accoutrement assembly, showing details of a lower securement device, in accordance with at least one embodiment of the disclosure.

FIG. 15 is a cross-sectional view of a shoe accoutrement assembly 800, showing details of a lower securement device 820, in accordance with at least one embodiment of the disclosure. As shown in FIG. 15, the shoe accoutrement assembly 800 includes a spine 810 and a lower securement device 820. The lower securement device 820 is connected to a forward surface 810FR of the spine 810 via adhesive 822. Accordingly, adhesive acts or functions as the attachment member 822.

As shown in FIG. 15, the lower securement device 820 includes sleeve 825 that defines opening 825'. In this embodiment, the sleeve 825 is openable on a side or portion thereof utilizing fastener 828. For example, the fasteners 828 might be hook and loop type fasteners, as well as other structure such as a snap, button structure, or clip, for example. More specifically, as shown in FIG. 15, the sleeve 825 includes a first end 826 and a second end 827. The ends 826, 827 are releasably attached together utilizing fastener 828. The position of the ends 826, 827 may be varied from the particular arrangement shown in FIG. 15. For example, it may be the case that the shoe accoutrement assembly 800 of FIG. 15 is for the right shoe—and it is desirable to position the fastener 828 on the inside. Accordingly, the arrangement of FIG. 15 may be constructed to have the fastener 828 positioned at the 3 o'clock position rather than the 6 o'clock position, as shown. In general, it is appreciated that the particular angular location or "clock-position" at which the first end 826 is joined to the second end 827 may be varied as desired.

Figure 16:
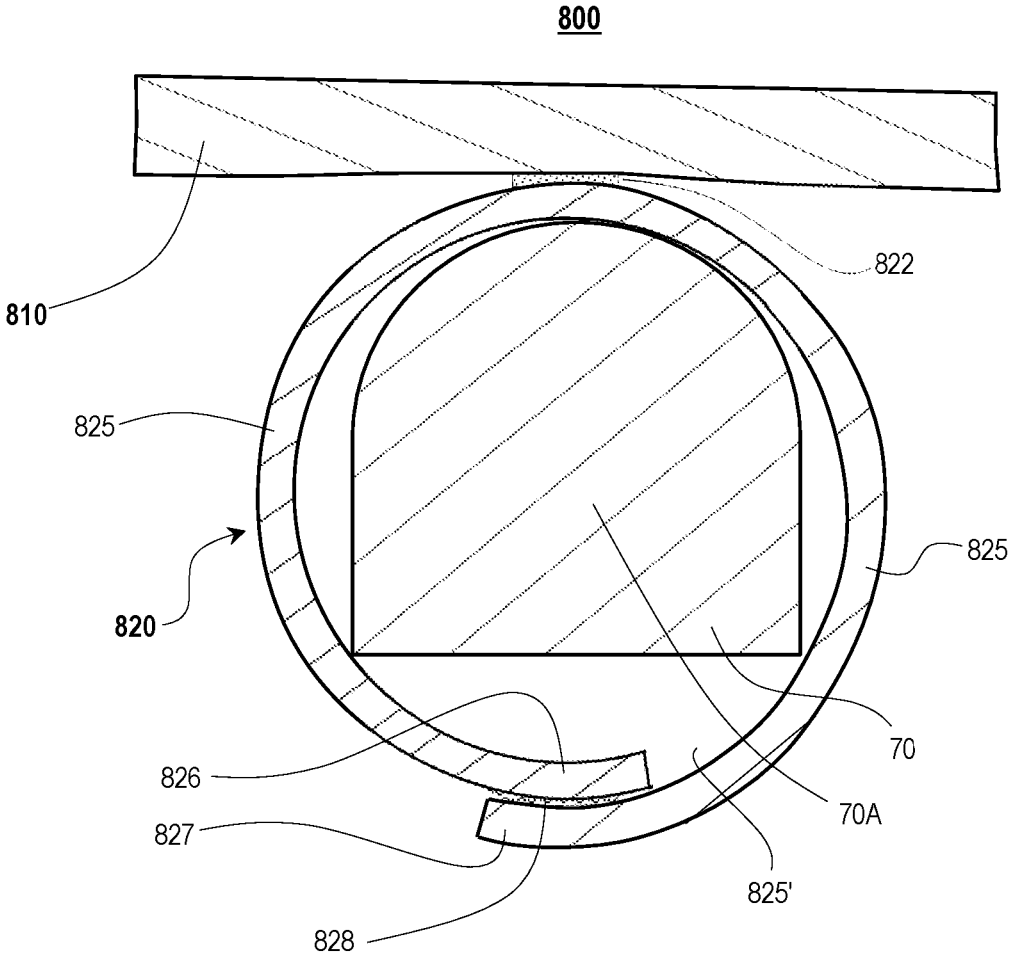
FIG. 16 is a cross-sectional view of a shoe accoutrement assembly, showing details of a lower securement device the same as or similar to that shown in FIG. 15, with a heel disposed therein, in accordance with at least one embodiment of the disclosure.

FIG. 16 is a cross-sectional view of a shoe accoutrement assembly 800, showing the lower securement device 820 the same as or similar to that shown in FIG. 15, in accordance with at least one embodiment of the disclosure.

In the arrangement of the shoe accoutrement assembly 800 shown in FIG. 15 and FIG. 16, the fastener 828 may provide adjustability in the effective diameter of the sleeve 825. In particular, such adjustability may be provided if the fastener 828 is in the form of a hook and loop fastener arrangement. Accordingly, such adjustability provides the capability to adjust to different sized heels, i.e. heels having different cross-sectional area 70A and provide a snug fit around the heel.

Figure 17:
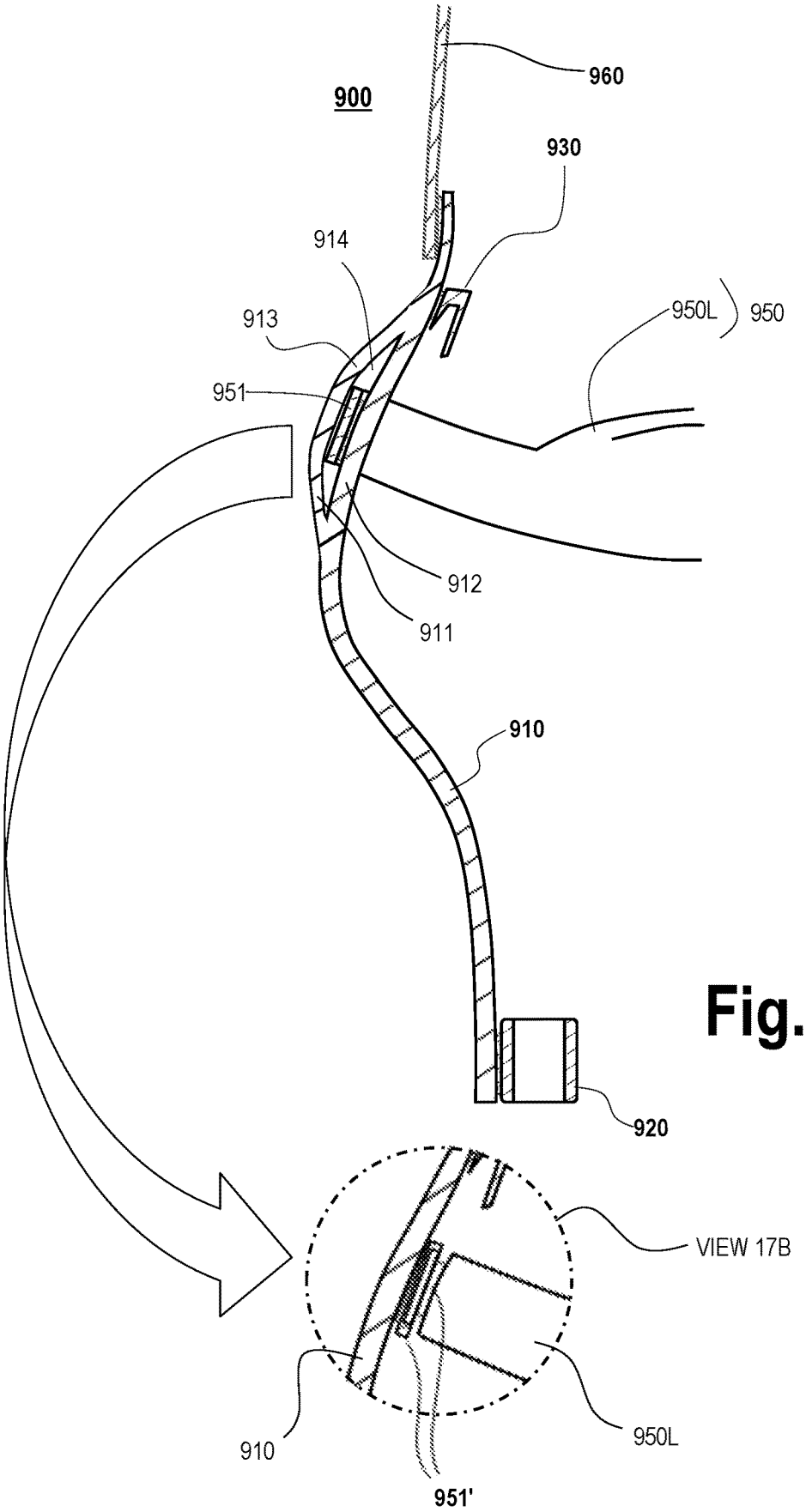
FIG. 17 cross-sectional view showing a further shoe accoutrement assembly, in accordance with at least one embodiment of the disclosure.

FIG. 17 cross-sectional view showing a further shoe accoutrement assembly 900, in accordance with at least one embodiment of the disclosure. FIG. 17 illustrates a shoe accoutrement assembly 900 that includes a spine 910, a lower securement device 920 and an upper securement device 930. The shoe accoutrement assembly 900 further includes an accoutrement 950 and an accoutrement 960. In particular, an accoutrement side part 950L is shown of the accoutrement 950. The accoutrement 950 includes a mount portion 951, which is attached to the spine 910.

The shoe accoutrement assembly 900 of FIG. 17 shows a varied embodiment of the disclosure in that the spine 910 includes a spine bifurcation 911. The spine bifurcation 911 includes structure that includes a layer 912 of the spine and a layer 913 of the spine, which defines an opening 914 therebetween. The mount portion 951, to secure the accoutrement 950 to the spine 910, may be sandwiched or otherwise provided between the layer 913 and the layer 912, i.e. in the opening 914. Accordingly, as shown in FIG. 17, it is appreciated that the spine 910 may include multilayered structure to retain a mount portion of an accoutrement and/or a multilayered structure to retain securement devices including upper securement devices and lower securement devices (to secure the spine to the shoe), for example.

FIG. 17 also shows View 17B. In such embodiment, the accoutrement 950 is attached to the spine 910 using a snap 951', in accordance with one or more embodiments. It is appreciated that other attachment mechanisms may also be utilized.

Figure 18:
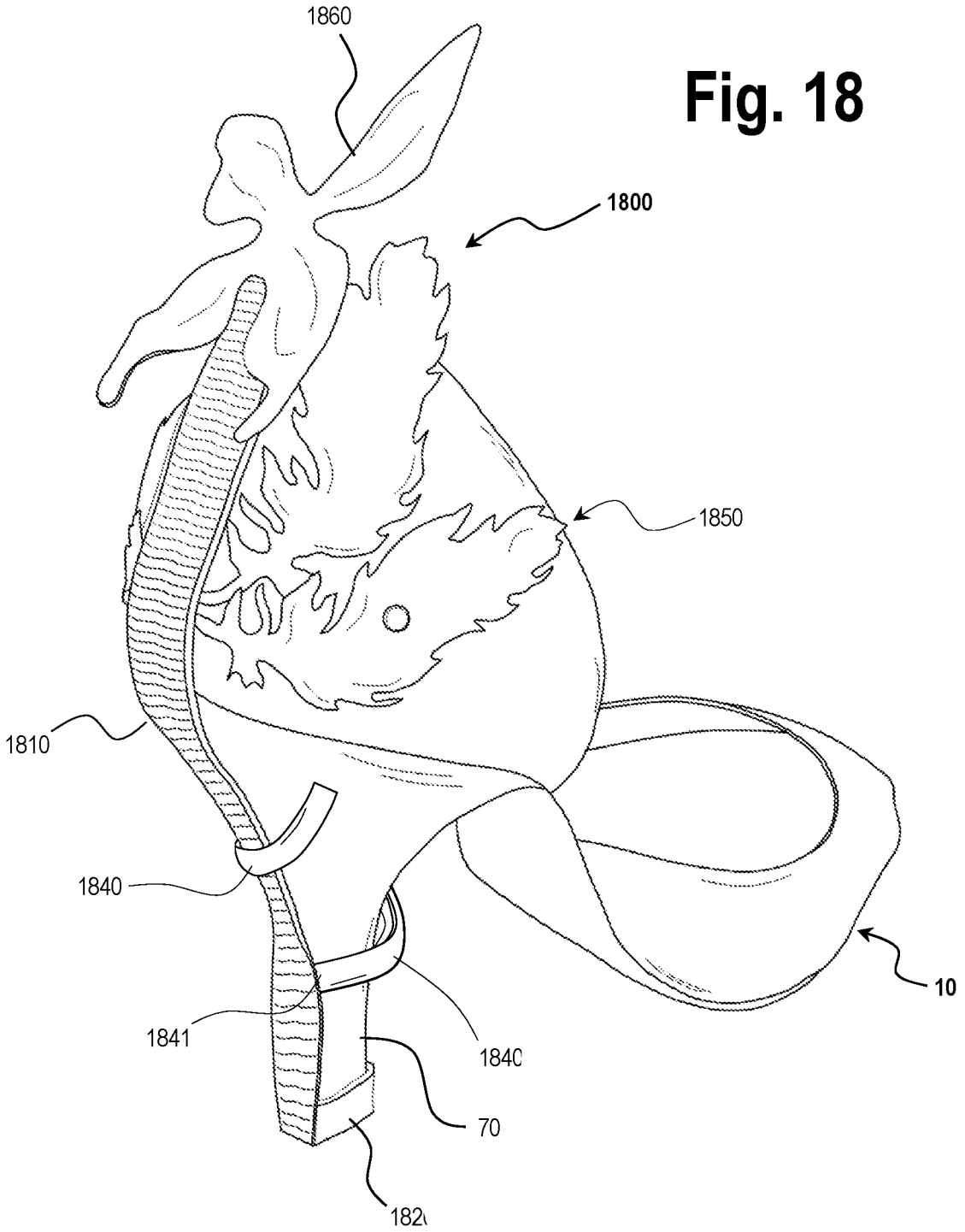
FIG. 18 is a perspective view of a further shoe accoutrement assembly, in accordance with at least one embodiment of the disclosure.

FIG. 18 is a perspective view showing a further shoe accoutrement assembly 1800, in accordance with at least one embodiment of the disclosure.

The shoe accoutrement assembly 1800 of FIG. 18 includes a spine 1810 to which is mounted a lower securement device 1820. In the illustrative manner as described above, the lower securement device 1820 may be constituted by a strap that wraps around a lower portion of the heel 70. Additionally, the shoe accoutrement assembly 1800 includes accoutrement 1850 and accoutrement 1860, both of which are attached to the spine 1810. As otherwise described herein, the size and shape of the accoutrements may be varied as desired.

The shoe accoutrement assembly 1800 (of FIG. 18) also includes a securement device 1840. As shown, the securement device 1840 may be attached to the spine 1810 at an attachment portion 1841. The attachment portion 1841 may be constituted by an end of the securement device 1840 that is connected to the spine via adhesive, hook and loop fastener, or other attachment mechanism. The securement device 1840 illustrates a feature of the disclosure that multiple securement devices may be provided at or adjacent to the lower portion of the shoe including around the heel, in accordance with one or more embodiments. Accordingly, in such arrangement with two lower securement devices, it may not be necessary or desired to have an upper securement device. As shown in FIG. 18, the securement device 1840 may wrap around the heel 70 in an ornamental and decorative manner. While a relatively simple strap 1840 is shown in FIG. 18, the securement device 1840 may be in other shapes, such as in the shape or depiction of a snake or serpent.

Figure 19:
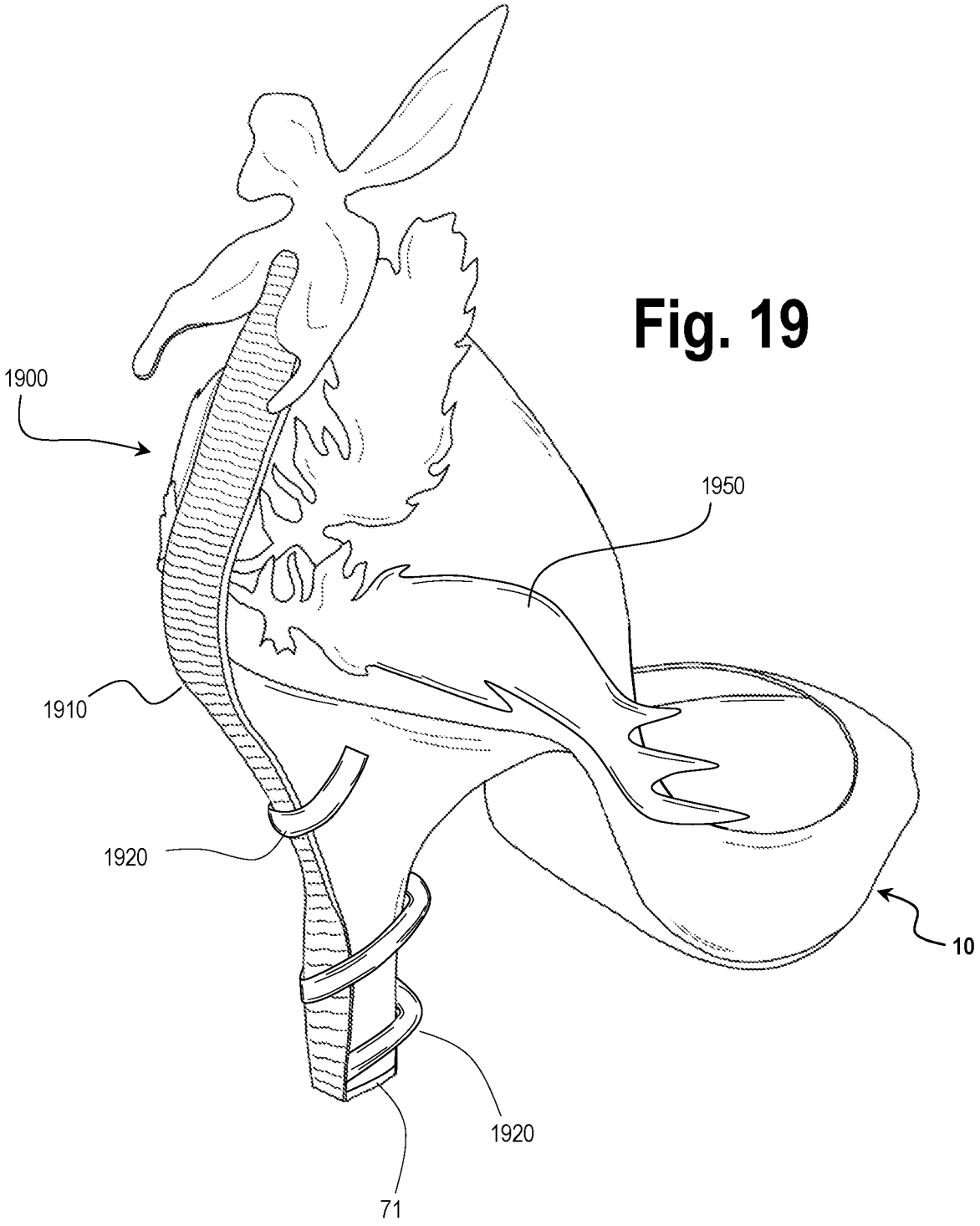
FIG. 19 is a perspective view of a further shoe accoutrement assembly, in accordance with at least one embodiment of the disclosure.

Relatedly, FIG. 19 is a perspective view of a further shoe accoutrement assembly 1900, in accordance with at least one embodiment of the disclosure. As shown, the assembly 1900 includes spine 1910 and accoutrement 1950. In this embodiment, the accoutrement 1950 may sweep along a lower portion of the shoe 10 and towards the front of the shoe. The accoutrement may be varied in size and shape. Similar structure may be provided on both sides of the shoe. Additionally, a securement device 1920 is provided in the shape of a spiral above or at the top piece 71—such as in the shape of a spiraled snake with snake head. In some embodiments, the securement device 1920 may be the only securement to attach the assembly 1900 to the shoe.

Figure 20:
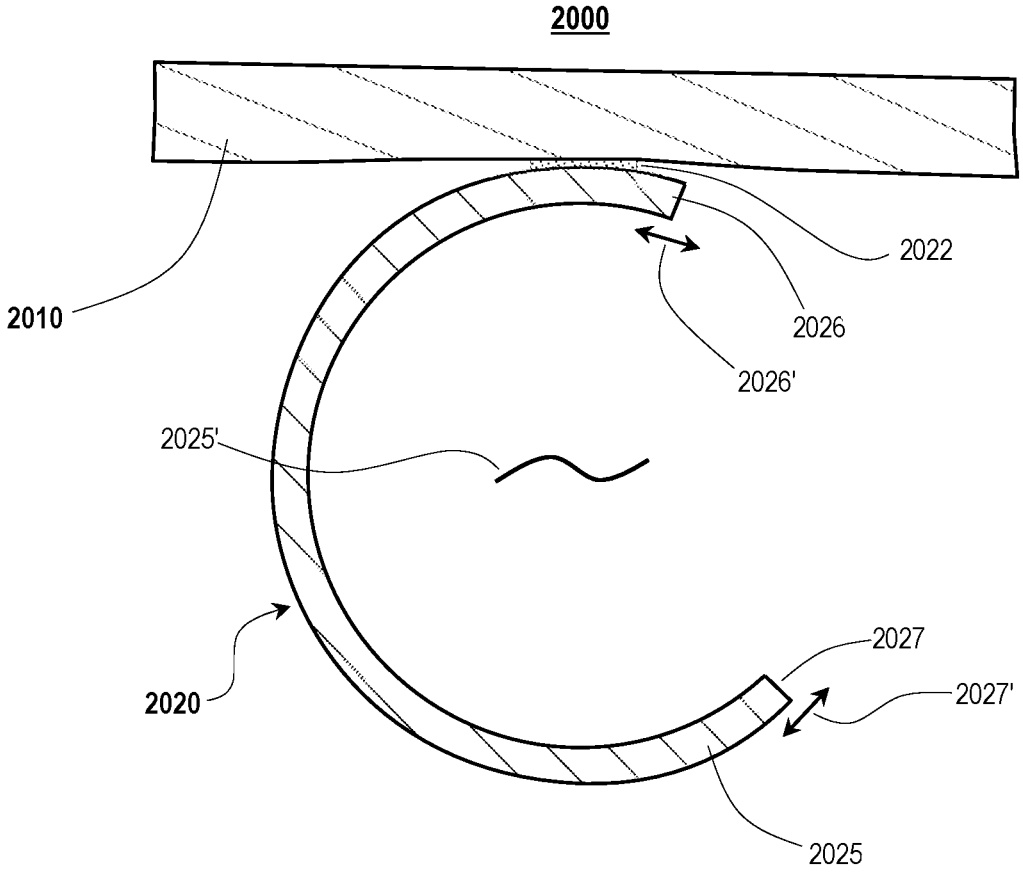
FIG. 20 is a further cross-sectional view of a shoe accoutrement assembly, showing details of a lower securement device, in accordance with at least one embodiment of the disclosure.

FIG. 20 is a further cross-sectional view of a shoe accoutrement assembly 2000, showing details of a lower securement device 2020, in accordance with at least one embodiment of the disclosure. As shown, a side of the lower securement device 2020 may be opened so as to slide over or clip over a heel of a shoe. The device 2020 includes opening 2025'. The device is attached to the spine 2010 via an attachment device 2022. The angular degree of the opening may vary as desired. Accordingly, the ends 2026 and 2027 may be varied along respective directions 2026' in 2027', for example. The lower securement device 2020 effectively provides a sleeve 2025 that engages with a shoe for securement of the shoe accoutrement assembly 2000.

Figure 21:
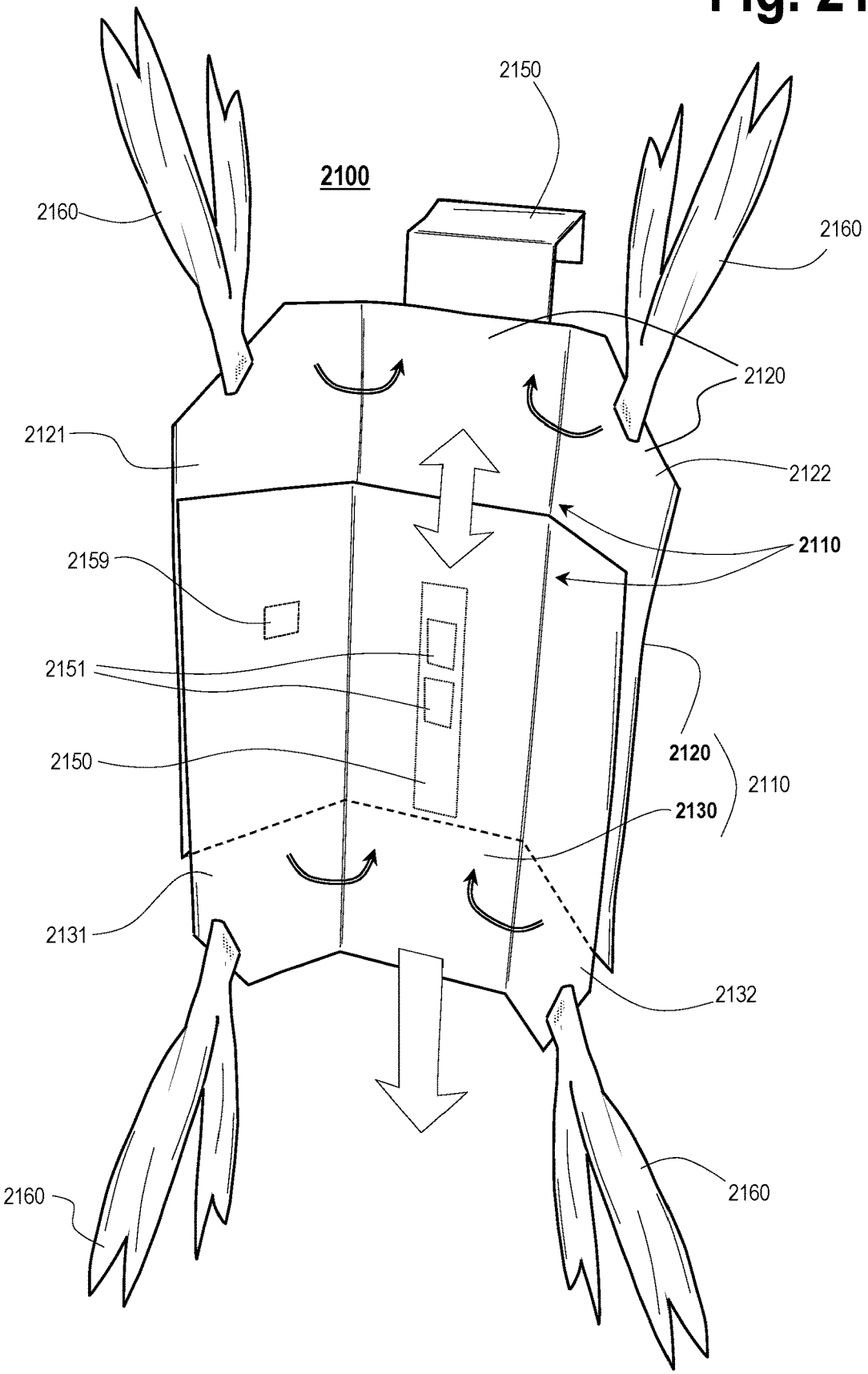
FIG. 21 is a perspective view showing a further shoe accoutrement assembly, in accordance with at least one embodiment of the disclosure.

FIG. 21 is a perspective view showing a further shoe accoutrement assembly, in accordance with at least one embodiment of the disclosure. In the shoe accoutrement assembly 2100 of FIG. 21 the spine includes structure to vary the length of the spine, as well as to provide flaps on the side of the spine so as to effectively vary the width of the spine. More specifically, the spine 2110 includes upper spine portion 2120 and lower spine portion 2130. The two spine portions 2120, 2130, may be adjustably variable to each other so as to effectively vary a vertical height of the spine 2110. For example, such variability may be afforded by hook and loop strips 2151 (on lower spine portion 2130) engaging with strip 2150 (on upper spine portion 2120) or vice-a-versa, which may be collectively constituted by Velcro, i.e. hook-and-loop fasteners.

Accordingly, the lower spine portion 2130 and the upper spine portion may be detached from each other, changed in relative position relative to each other, and re-attached to each other, i.e. so as to effectively change the length of the spine 2110.

Additionally, the spine 2110 includes upper left flap 2121 and upper right flap 2122, which both extend on respective sides of upper spine portion 2120. Additionally, the spine 2110 includes lower left flap 2131 and lower right flap 2132 which extend on respective sides of the lower spine portion 2130. As shown by the arrows in FIG. 21, these flaps may be extended outwardly or "fanned out" or spread out in one arrangement. Alternatively, the flaps may be folded upon each other in another arrangement. As a result, the effective width of the spine is varied. Illustratively, the flaps may be maintained in a folded state by a suitable connection or fastening mechanism, such as one or more adhesive pads 2159 provided on the members 2121, 2131, 2122, and/or 2132. Accoutrements 2160 may be attached to the spine 2110 as desired. With reference to FIG. 21, the spine may be constructed and manufactured to be of different size, shape, etc. to extend along a vertical back of a shoe as desired.

As shown in FIG. 21, the assembly 2100 may be attached to a shoe utilizing upper securement device 2150 or other securement device as described herein.

Figure 22:
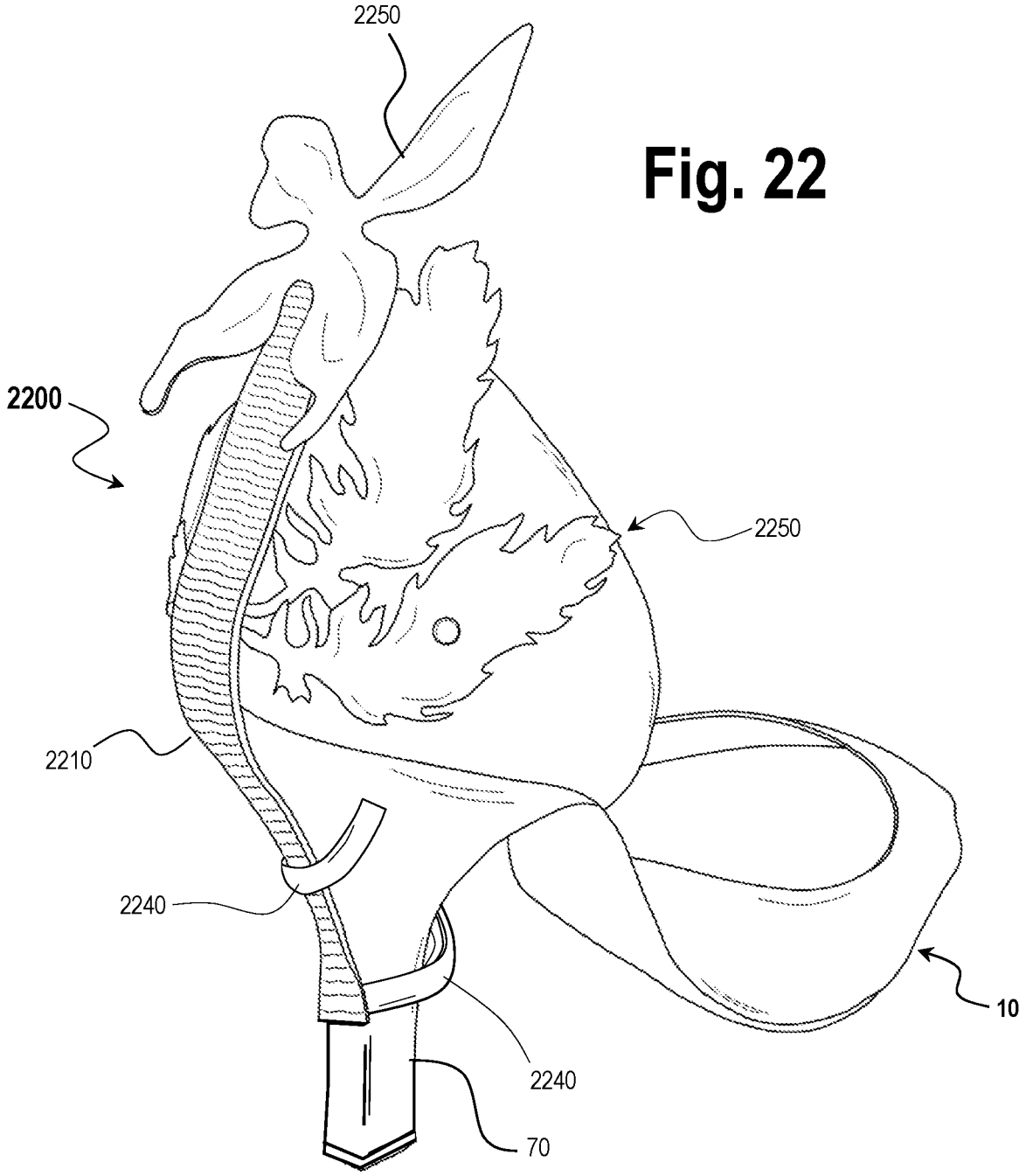
FIG. 22 is a perspective view showing a further shoe accoutrement assembly on a shoe, in accordance with at least one embodiment of the disclosure.

FIG. 22 is a perspective view showing a further shoe accoutrement assembly 2200 on a shoe 10, in accordance with at least one embodiment of the disclosure. FIG. 22 shows that height and point of attachment on a shoe of the spine 2210 may be varied as desired. Accordingly, in the embodiment of FIG. 22, the spine 2210 is raised above the lower portion of heel 70. The spine is attached to the shoe utilizing the securement device 2240 that wraps around the heel 70 of the shoe 10. Additionally, spine 2210 may be provided with a plurality of accoutrements 2250.

Figure 23:
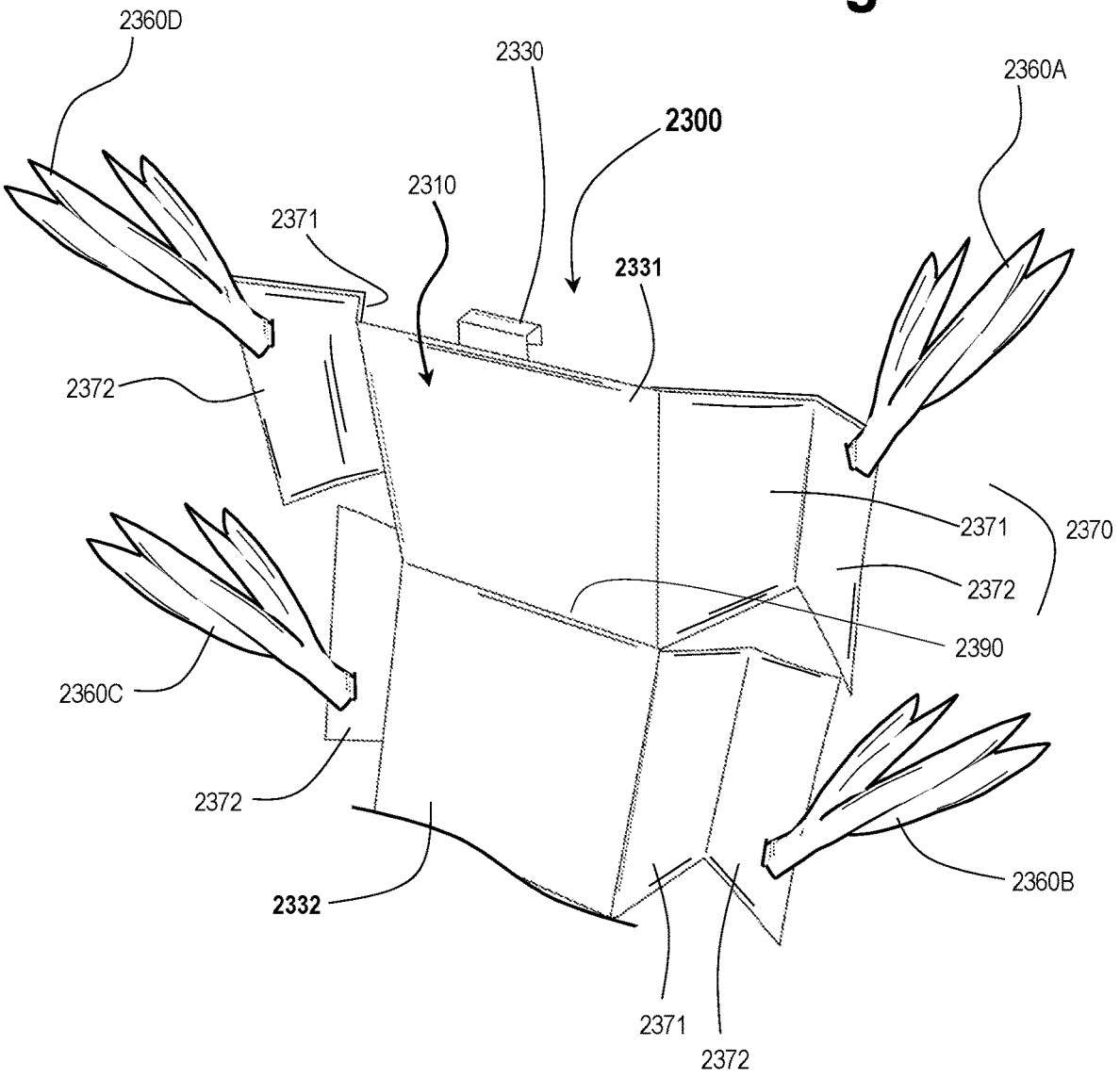
FIG. 23 is a perspective view showing a further shoe accoutrement assembly, in accordance with at least one embodiment of the disclosure.
Figure 24:
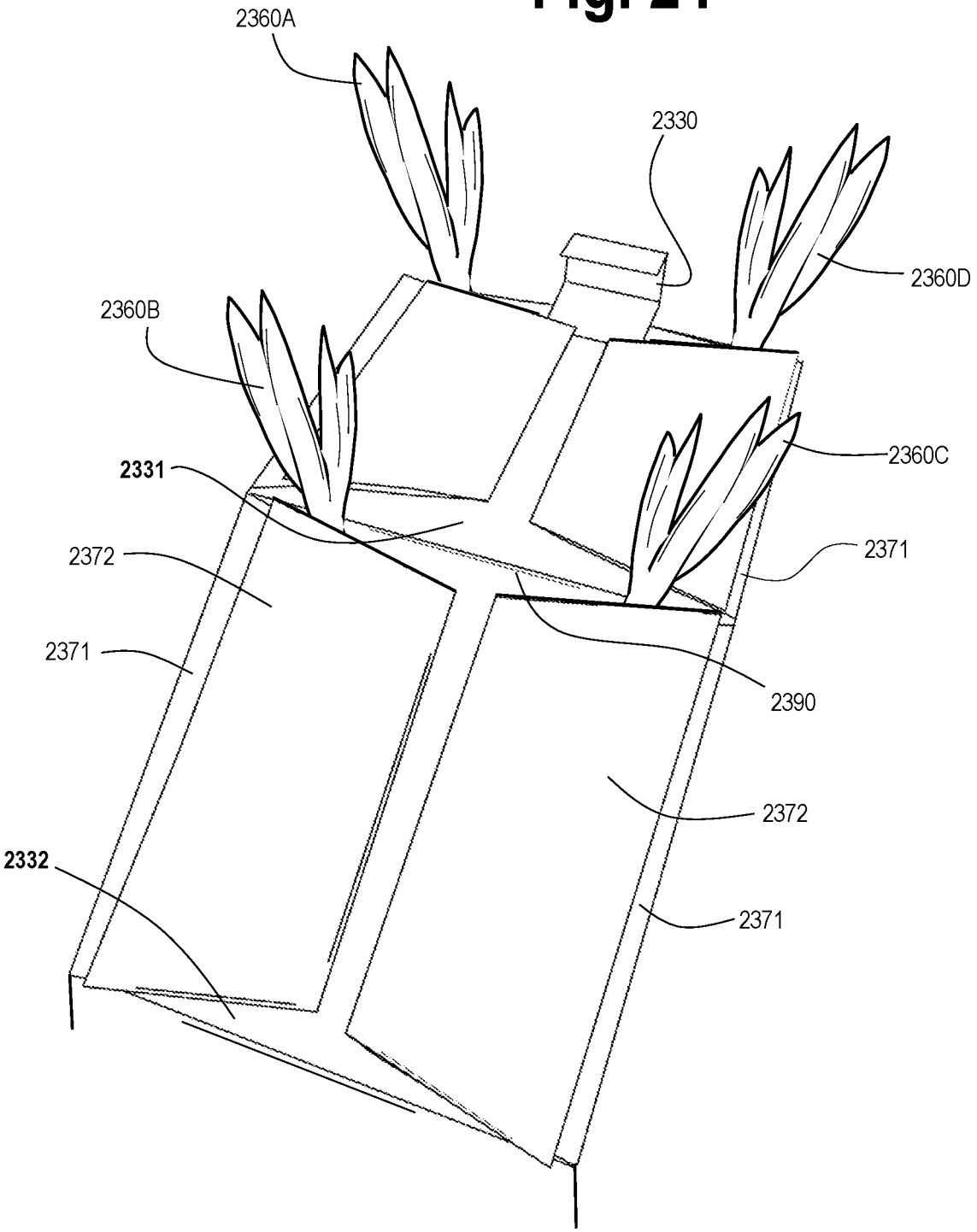
FIG. 24 is a perspective view showing the shoe accoutrement assembly, in a folded state, the same as or similar to the shoe accoutrement assembly of FIG. 23, in accordance with at least one embodiment of the disclosure.

FIG. 23 is a perspective view showing a further shoe accoutrement assembly 2300, in accordance with at least one embodiment of the disclosure. FIG. 24 is a perspective view showing a shoe accoutrement assembly, in a folded state, the same as or similar to the shoe accoutrement assembly of FIG. 23, in accordance with at least one embodiment of the disclosure.

In particular, FIG. 23 shows a further embodiment in which width of a spine 2310 may be varied. Specifically, the spine 2310 includes first spine portion 2331 and second spine portion 2332, which may be demarcated by bend or fold line 2390. On opposing sides of each of the spine portions 2331, 2332 are provided extension flaps 2370. The extension flaps 2370 include an inner extension flap 2371 and an outer extension flap 2372. These extension flaps 2371, 2372, may be provided with accoutrements 2360A, 2360B, 2360C, 2360D as desired. Such accoutrements may be provided with embellishments as may be desired. As shown in FIG. 23, the extension flaps 2371, 2372 are opened to extend opposing sides of the spine 2310. Accordingly, the arrangement provides greater width, which may be visually appealing, as opposed to the structure of FIG. 23 in a folded state. Such a folded state is shown in FIG. 24. It is of course appreciated that FIG. 23 and FIG. 24 are provided to show, in one embodiment, structure which may be utilized to vary width of the spine. Dimensions such as width, height, and spatial interrelationship may be varied as desired, as well as shape may be varied as desired. In particular, the distance or amount that the flaps 2371, 2372 fold over may be varied. Further, material as described herein including portions connected and/or connected at fold lines may be constituted by overlapping sections of materials connected together in suitable manner, such as connected together utilizing Velcro. As described above, FIG. 23 shows a first spine portion 2331 and a second spine portion 2332. It is appreciated that the particular number of spine portions may be varied as desired, and are not limited to the particular number of spine portions shown in FIG. 23 and FIG. 24. As shown, the shoe accoutrement assembly 2300 may be attached to a shoe using securement device 2330 or other securement device.

As described above, FIG. 24 is a perspective view showing a shoe accoutrement assembly, in a folded state, the same as or similar to the shoe accoutrement assembly of FIG. 23, in accordance with at least one embodiment of the disclosure.

Figure 25:
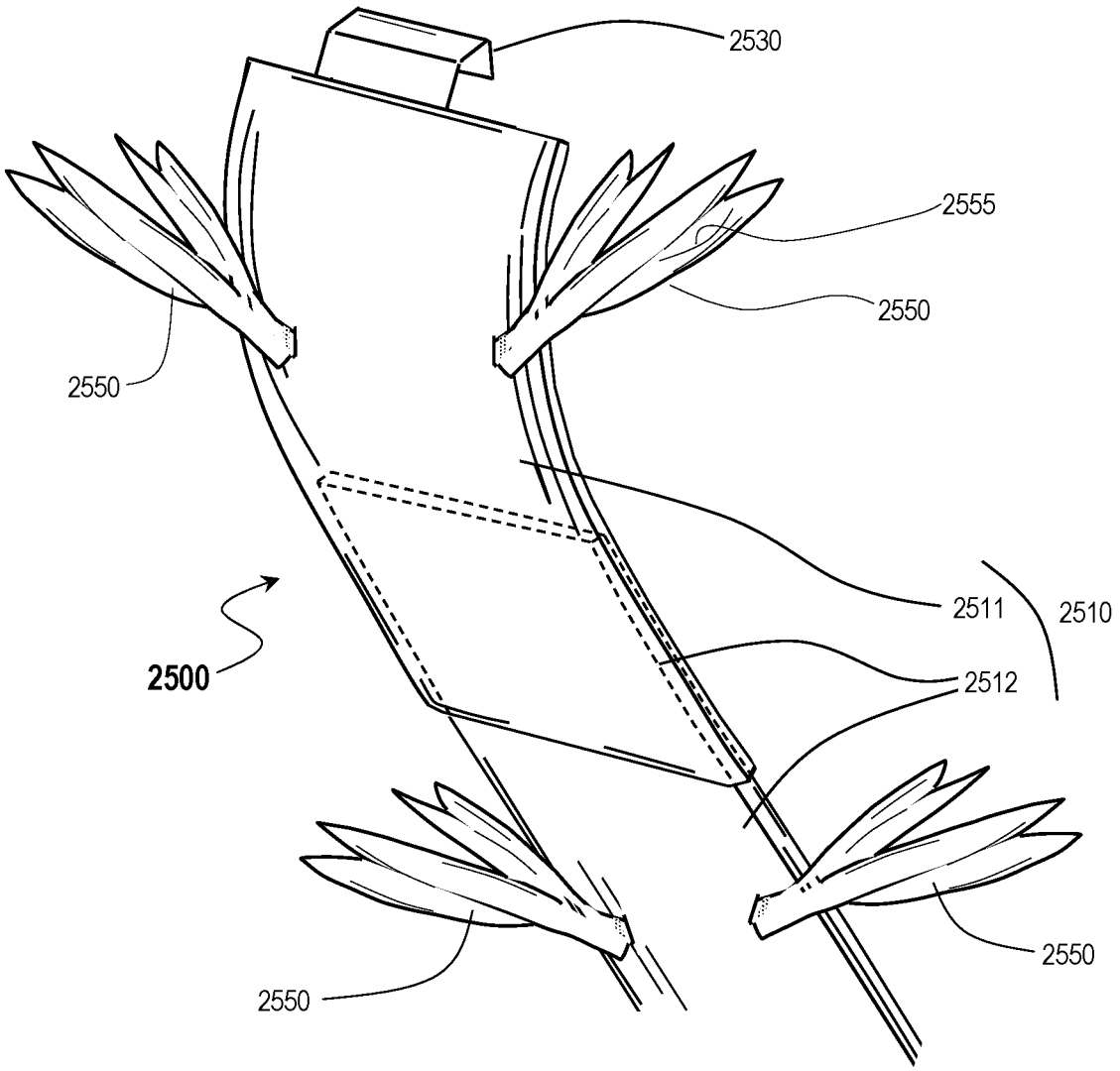
FIG. 25 is a perspective view showing a further shoe accoutrement assembly, in accordance with at least one embodiment of the disclosure.

FIG. 25 is a perspective view showing a further shoe accoutrement assembly 2500, in accordance with at least one embodiment of the disclosure. FIG. 25 shows an arrangement in which length or height of spine 2510 may be varied. As shown, spine 2510 includes outer spine sleeve 2511 and inner spine extension 2512. Inner spine extension 2512 may be telescopically received into an opening or passage, as shown, in the outer spine sleeve 2511. Accordingly, as the inner spine extension 2512 is slid further into the outer spine sleeve 2511, the effective vertical height or length of the spine 2510 is varied. Such positioning between the outer spine sleeve 2511 and the inner spine extension 2512 may be maintained via friction between the two components 2511, 2512 and/or suitable securement mechanism such as Velcro. The accoutrement assembly 2500 may be provided with accoutrements as desired, such as accoutrements 2550. Such accoutrements may be provided with embellishments 2555. The spine 2510 may be attached to the shoe via a suitable securement device such as upper securement device 2530.

Figure 26:
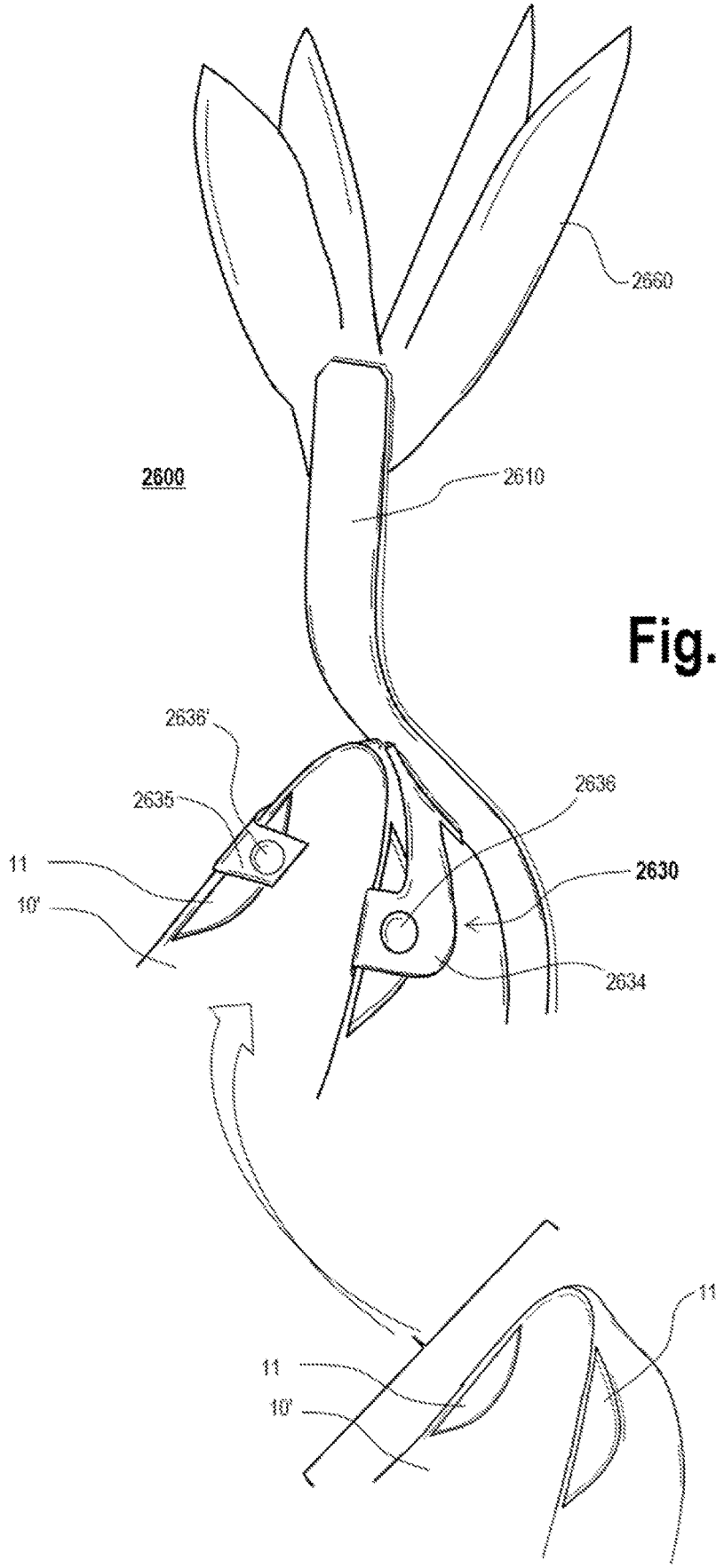
FIG. 26 is a perspective view showing a further shoe accoutrement assembly, in accordance with at least one embodiment of the disclosure.

FIG. 26 is a perspective view showing a further shoe accoutrement assembly 2600, in accordance with at least one embodiment of the disclosure. The shoe accoutrement assembly 2600 includes a spine 2610, an accoutrement 2660, and a securement device 2630. In this embodiment, the securement device 2630 includes an extension portion 2634, on both sides, that are each provided with an interior engagement tab 2635. In this embodiment, the securement device 2630 utilizes an existing or provided aperture 11 in shoe 10'. The aperture 11 might be a vertical opening, horizontal opening, or other desired shape That is, the securement device 2630, on both sides, effectively "snaps onto itself" in that the extension portion 2630 is provided with a first snap portion 2636 and the interior engagement tab 2635 is provided with a second mating snap portion 2636'. For example, the snap portion 2636 may be constituted by a "male" snap portion that snaps into a mating or complementary "female" snap portion 2636'. Other complementary snap portions or attachment mechanisms may be utilized. Such arrangement serves to secure the spine 2610 onto the shoe. It is of course appreciated that the "male" and "female" parts as described herein, as well as other complementary or mating parts, may well be reversed with regard to what part is provided on what component.

Figure 27:
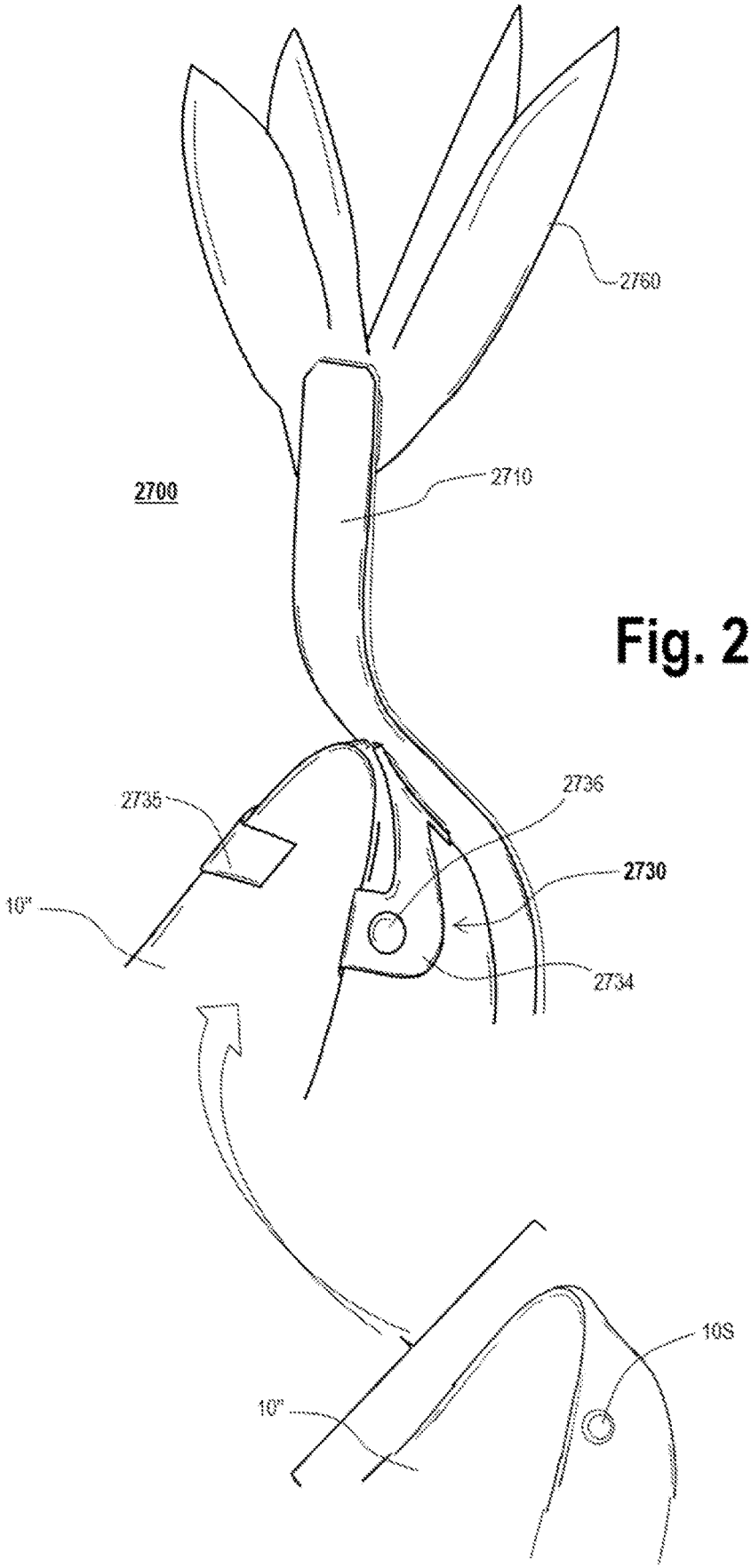
FIG. 27 is a perspective view showing a further shoe accoutrement assembly, in accordance with at least one embodiment of the disclosure.

FIG. 27 is a perspective view showing a further shoe accoutrement assembly 2700, in accordance with at least one embodiment of the disclosure. The shoe accoutrement assembly 2700 includes a spine 2710 and an accoutrement 2760. The shoe accoutrement assembly further includes upper securement device 2730. The upper securement device 2730 includes an extension portion 2734 that is provided with a snap portion 2736. In this embodiment, the shoe 10" includes a snap portion 10S, that snaps onto or connects with snap portion 2736 on the extension portion 2734. For example, the snap portion 10S may be a female snap portion that is complementary so as to connect with male snap portion 2736. Both sides of the upper securement device 2730 may be provided with such structure, as well as both sides of shoe 10" may be provided with complimentary snaps. An interior engagement tab 2735 may or may not be included. Such tab 2735 might be desired for additional stability, for example. Such arrangement, as shown in FIG. 27, serves to secure the spine 2710 upon the shoe 10".

Figure 28:
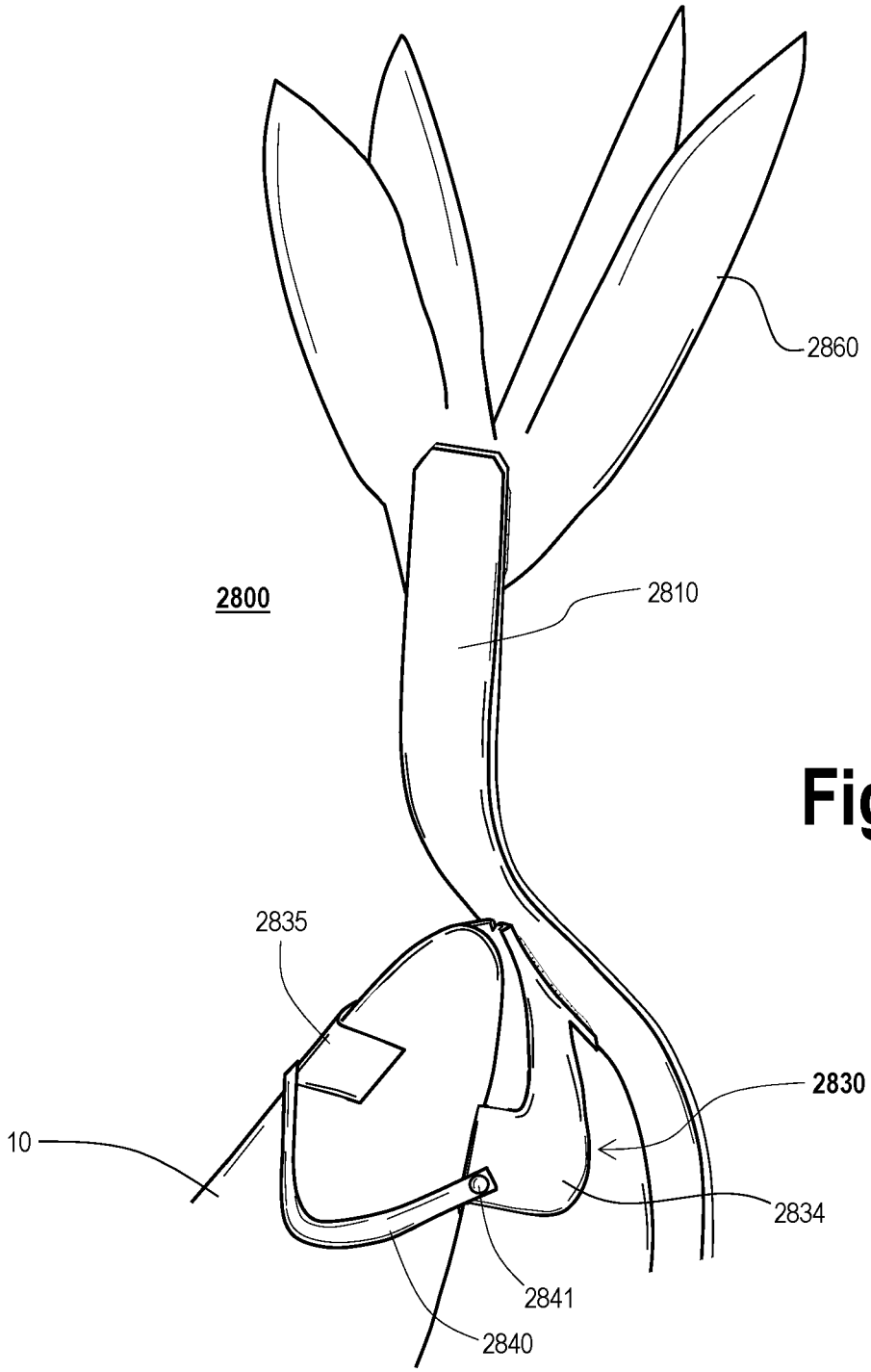
FIG. 28 is a perspective view showing a further shoe accoutrement assembly, in accordance with at least one embodiment of the disclosure.

FIG. 28 is a perspective view showing a further shoe accoutrement assembly 2800, in accordance with at least one embodiment of the disclosure. The shoe accoutrement assembly 2800 includes spine 2810 and accoutrement 2860. Additionally, the shoe accoutrement assembly 2800 includes securement device 2830. In this embodiment, the securement device 2830 may include a strap 2840 that connects to extension portions 2834, on each side, so as to secure the shoe accoutrement assembly 2800 upon the shoe 10 and to the user's foot. The strap 2840 may be detachably attached to the extension portions 2834 (at each opposing ends of the strap 2840) by snap 2841, or some other attachment mechanism such as Velcro, a clip, clasp, buckle, hook or some other suitable attachment mechanism. The arrangement may also include interior engagement tabs 2835 for further stability.

Figure 29:
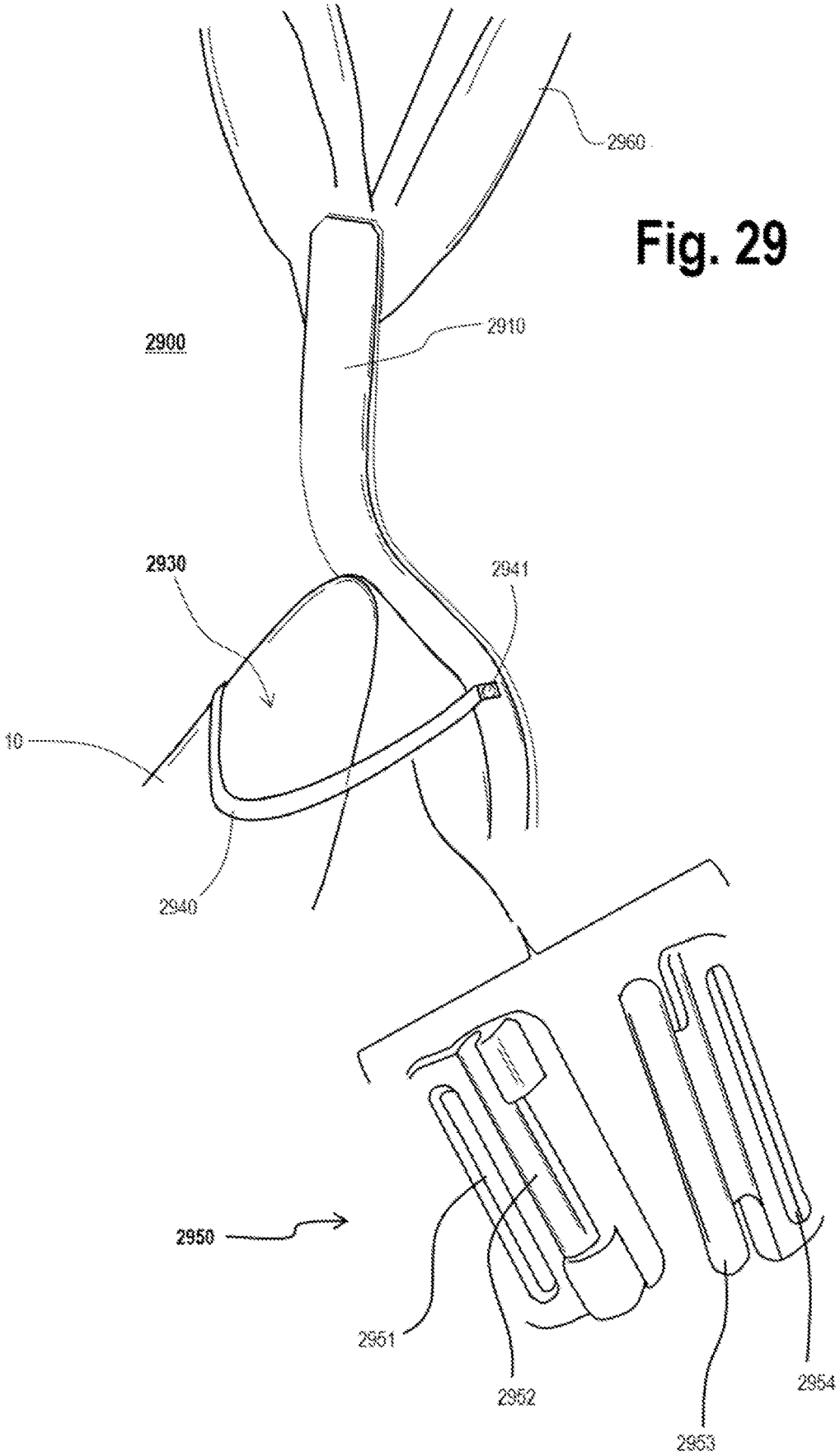
FIG. 29 is a perspective view showing a further shoe accoutrement assembly, in accordance with at least one embodiment of the disclosure.

FIG. 29 is a perspective view showing a further shoe accoutrement assembly 2900, in accordance with at least one embodiment of the disclosure. The shoe accoutrement assembly 2900 includes spine 2910 and accoutrement 2960. Additionally, the shoe accoutrement assembly 2900 includes securement device 2930. In this embodiment, the securement device 2930 may include a strap 2940 that connects to the spine 2910, on each side, so as to secure the shoe accoutrement assembly 2900 upon the shoe 10 and to the user's foot. The strap 2940 may be detachably attached to the spine 2910 (at each opposing ends of the strap 2940) by a snap 2941, or some other attachment mechanism such as Velcro, a clip, clasp, buckle, hook or some other suitable attachment mechanism.

FIG. 29 also shows a snap clip 2950 that may be used in embodiments of the invention, such as to connect two components together. For example, in an embodiment, the strap 2940 might be bifurcated (or split into two parts) and such two parts connected together using the snap clip 2950. The snap clip 2950 may include a strap slot 2951 and strap slot 2954 to connect the snap clip 2950 to adjoining components, e.g. to respective adjoining straps. The two sides of snap clip 2950 itself may be connected together via the snap bar 2953 being inserted into the snap bar receptacle 2952.

Figure 30:
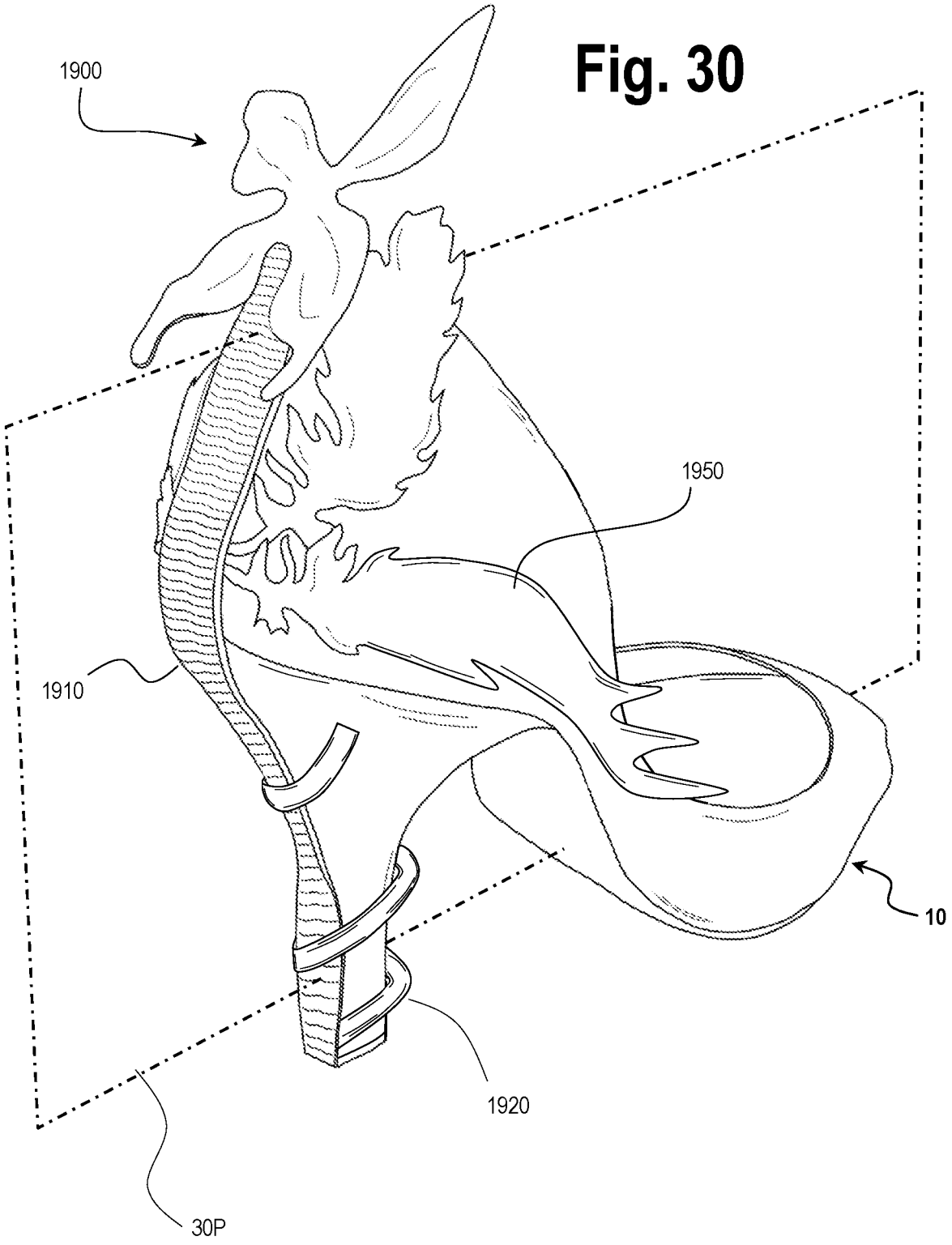
FIG. 30 is a perspective view of the shoe accoutrement assembly of FIG. 19 with a vertical anteroposterior plane provided for purposes of reference, in accordance with at least one embodiment of the disclosure.

FIG. 30 is a perspective view of the shoe accoutrement assembly of FIG. 19 with a vertical anteroposterior plane 30P provided for purposes of reference, in accordance with at least one embodiment of the disclosure. As shown, the spine 1910 may be curved within the vertical anteroposterior plane 30P (i.e. within a vertical plane extending from the front to the back of the arrangement as shown). Accordingly, components of a shoe accoutrement may be described as being on or aligned with the vertical anteroposterior plane 30P or on opposing sides of the vertical anteroposterior plane 30P. For example, the interior engagement tabs 535 of FIG. 11 might be described as being on opposing sides of the vertical anteroposterior plane 30P. On the other hand, the interior engagement tab 635 of FIG. 12 might be described as laying on and/or aligned with the vertical anteroposterior plane 30P.

Figure 31:
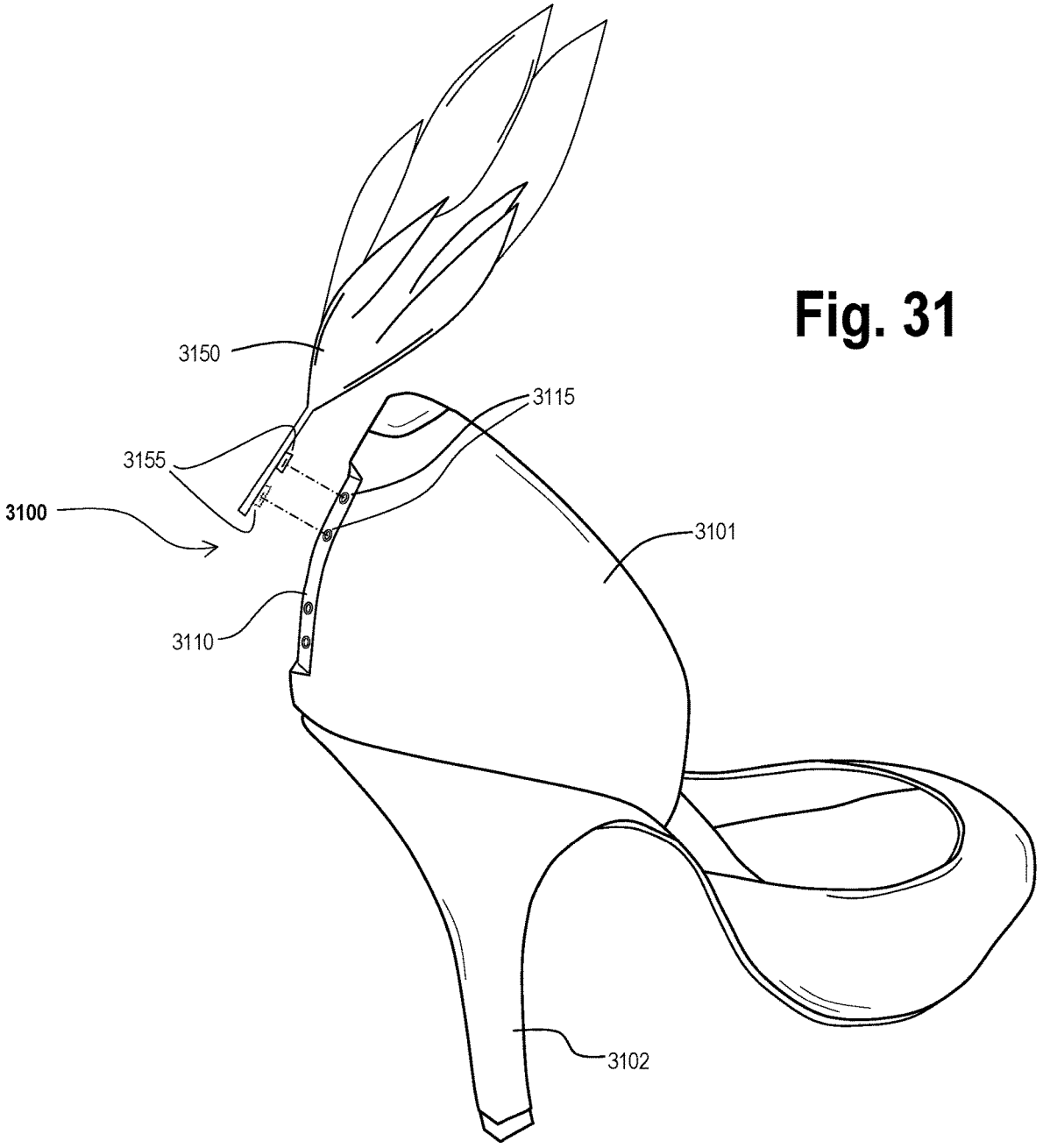
FIG. 31 is a perspective view of a shoe accoutrement assembly 3100 integrated with modified shoe 3101, in accordance with one or more embodiments of the disclosure.

FIG. 31 is a perspective view of a shoe accoutrement assembly 3100 integrated with modified shoe 3101, in accordance with one or more embodiments of the disclosure. The shoe accoutrement assembly 3100 can include an embedded spine 3110. As shown, the embedded spine 3110 can be integral with and formed with modified shoe 3101. For example, the embedded spine 3110 can be a curved, flat or substantially flat portion formed in the back of the shoe structure. As shown, a snap portion or portions 3115 can be provided on the embedded spine 3110 so as to provide an attachment mechanism for attachment to an accoutrement 3150 as desired. As otherwise described herein, the accoutrement 3150 may be of size, shape, decoration, and possess other attributes as may be desired. A snap portion 3155 can be attached and/or be a part of the accoutrement 3150—so as to attach the accoutrement 3150 to the embedded spine 3110 of the modified shoe 3101. It is appreciated that other attachment mechanisms, in lieu of snap portions 3115, 3155 may be utilized, such as Velcro or magnets, for example. Magnets can be used in place of any attachment mechanism described herein, as may be desired. As reflected in FIG. 31, the heel and other portions of the shoe may be provided with a shoe accoutrement assembly having similar structure to the shoe accoutrement assembly 3100. For example, the back of the heel 3102 may be provided with an embedded spine and a snap portion similar to the structure 3110, 3115—so as to attach to accoutrements as desired.

Figure 32:
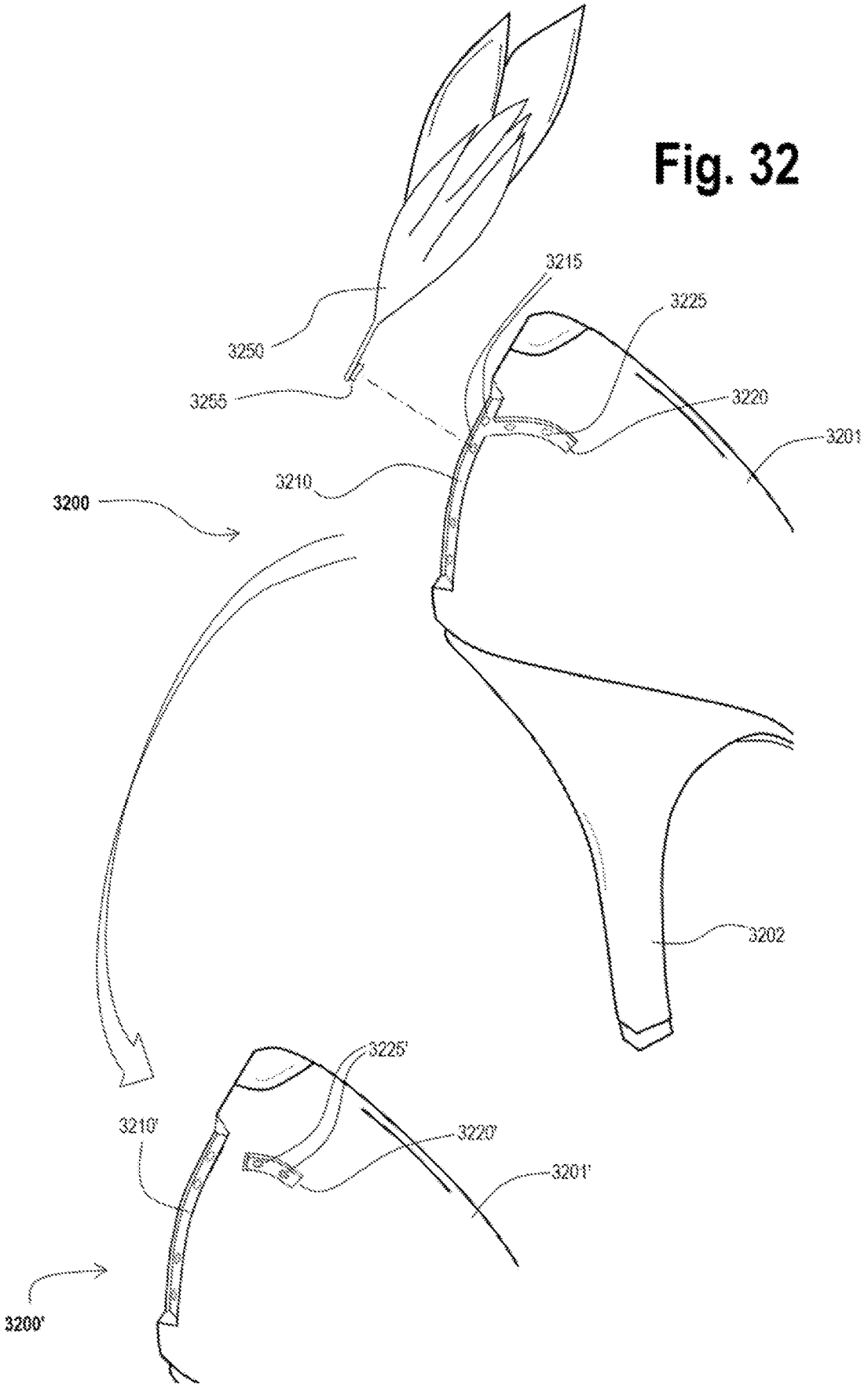
FIG. 32 is a perspective view of a further shoe accoutrement assembly 3200 integrated with modified shoe 3201, and showing a further variation 3200' of a shoe accoutrement assembly, in accordance with one or more embodiments of the disclosure.

FIG. 32 is a perspective view of a further shoe accoutrement assembly 3200 integrated with modified shoe 3201, and showing a further variation 3200' of a shoe accoutrement assembly, in accordance with one or more embodiments of the disclosure.

The shoe accoutrement assembly 3200 can include an embedded spine channel 3210 that includes a slot or channel formed in the shoe, such as in the back of the shoe, for example. As shown, the embedded spine channel 3210 can be integral with and formed with modified shoe 3201. For example, the spine channel 3210 can include a channel provided with an inner curved, flat or substantially flat portion formed in the back of the shoe structure. As shown, a snap portion or portions 3215 can be provided on the spine channel 3210 so as to provide an attachment mechanism for attachment to an accoutrement 3250 as desired. As otherwise described herein, the accoutrement 3250 may be of size, shape, decoration, and possess other attributes as may be desired. A snap portion 3255 can be attached and/or be a part of the accoutrement 3250—so as to attach the accoutrement 3250 to the spine channel 3210 of the modified shoe 3201. It is appreciated that other attachment mechanisms, in lieu of the snap portions shown in FIG. 32 may be utilized, such as Velcro, for example. In general, it is appreciated that snap, Velcro, adhesive, and other attachment mechanisms as described herein may be interchanged as desired. As shown in FIG. 32, the shoe accoutrement assembly 3200 can include an additional spine channel 3220 (with snaps or snap portions 3225) that is connected with and/or associated with the spine channel 3210. Such additional spine channel 3220 can provide a further decorative look to the shoe and can provide a further location and options to mount accoutrements upon the shoe.

Relatedly, as reflected in FIG. 32, the heel and other portions of the shoe may be provided with a shoe accoutrement assembly having similar structure to the shoe accoutrement assembly 3200. For example, the back of the heel 3202 may be provided with an embedded spine and a snap portion similar to the structure 3210, 3215—so as to attach to accoutrements as desired.

FIG. 32 also shows shoe accoutrement assembly 3200' on modified shoe 3201' that is a variation to shoe accoutrement assembly 3200. In the assembly 3200', the spine channel 3210' is separate from the spine channel 3220'. As shown, the spine channel 3220' can include snap portions 3225' so as to provide for attachment to accoutrements.

Figure 33:
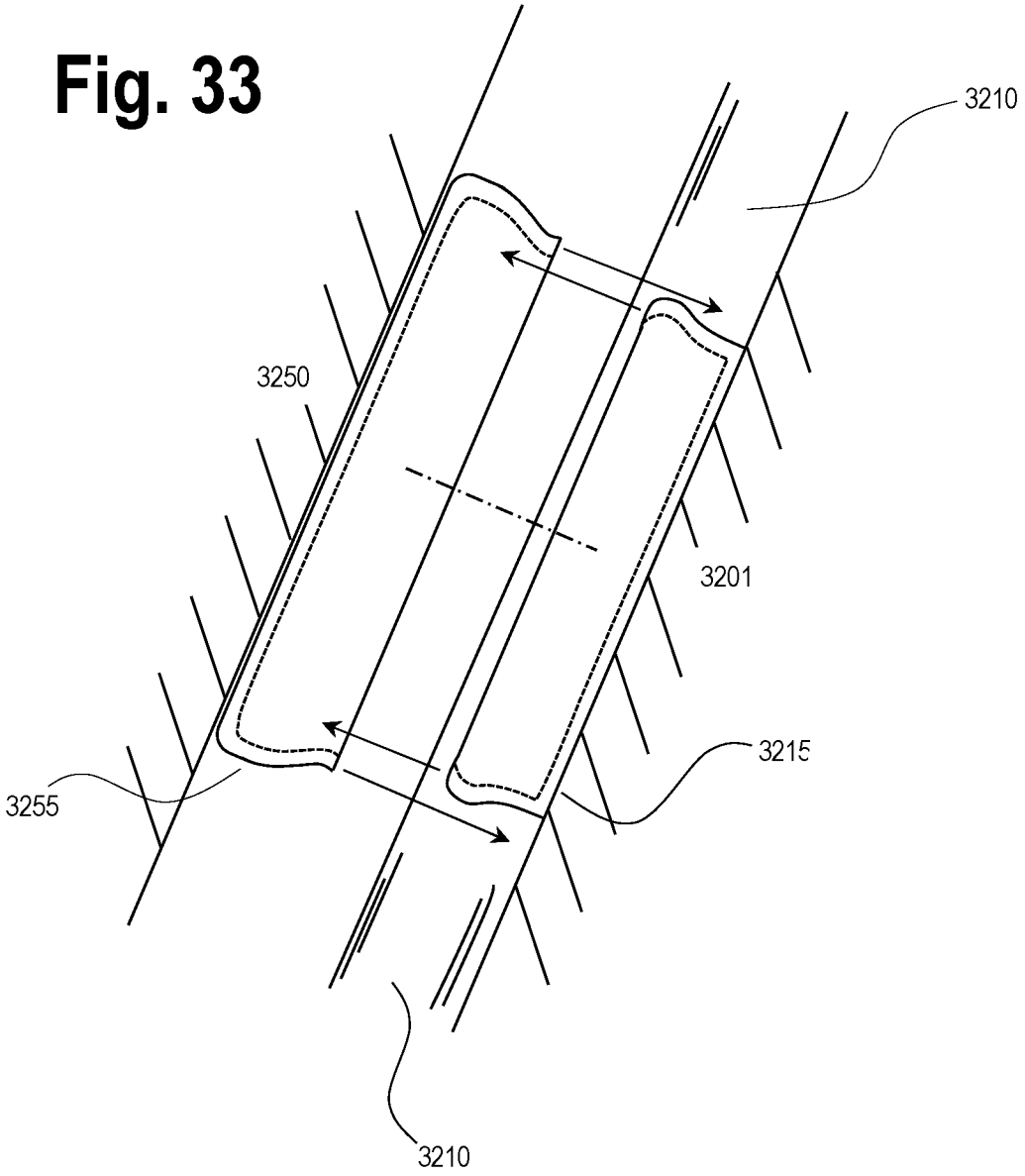
FIG. 33 is a side schematic view of a snap assembly, the same as or similar to the snap assembly shown in FIG. 32, with accoutrement 3250 and modified shoe 3201, in accordance with one or more embodiments of the disclosure.

FIG. 33 is a side schematic view of a snap assembly, the same as or similar to the snap assembly shown in FIG. 32, with accoutrement 3250 and modified shoe 3201, in accordance with one or more embodiments of the disclosure. As shown, a female snap 3255 may be attached to accoutrement 3250. A male snap 3215 may be attached to shoe 3201. The male snap 3215 may be disposed in the spine channel 3210. An outer diameter of the male snap 3215 may engage with an inner diameter of the female snap 3255. Structural attributes of the snaps 3215, 3255 can provide for deformation under force so as to allow connection of the snap 3255 to the snap 3215—yet have sufficient structural rigidity so as to resist separation of the snap 3255 from the snap 3215, i.e. once the snap 3255 is connected to the snap 3215. Relatedly, the snaps 3255, 3215 can be provided with curved walls so as to assist with both ease of connection and securement (of the snap 3255 to the snap 3215). The snaps 3215, 3255 may be reversed as desired.

Figure 34:
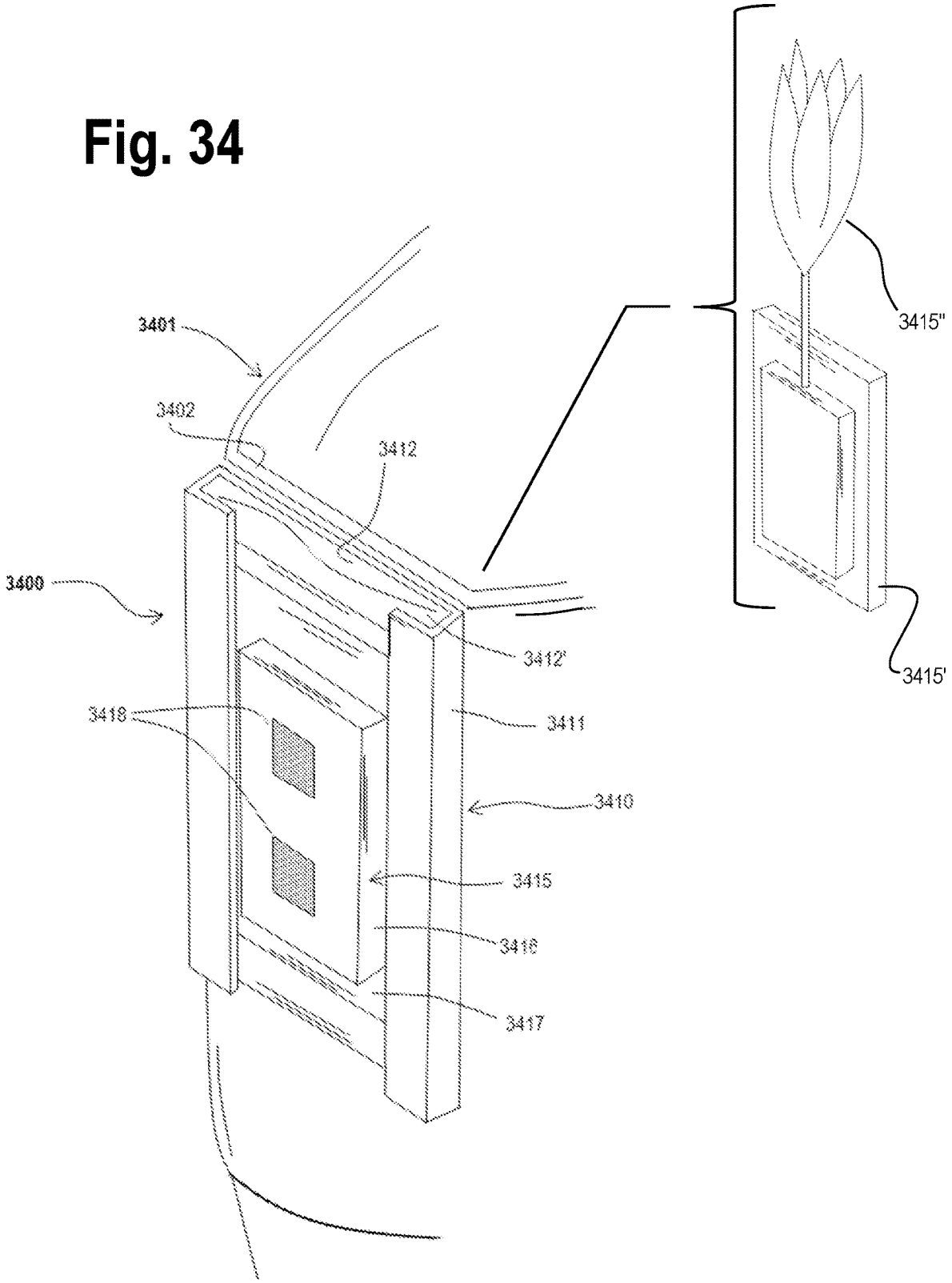
FIG. 34 is a perspective view of a further shoe accoutrement assembly 3400 integrated with modified shoe 3401, in accordance with one or more embodiments of the disclosure.

FIG. 34 is a perspective view of a further shoe accoutrement assembly 3400 integrated with modified shoe 3401, in accordance with one or more embodiments of the disclosure. As shown, a rail 3410 is attached to shoe 3401 or is an integral part of shoe 3401. The rail 3410 may be positioned on a shoe back collar 3402, which may be a modified portion of the shoe. The rail 3410 includes rail sides 3411 on opposing sides of the rail 3410. The rail sides 3411 form a rail channel 3412 that defines a channel opening 3412'.

A slider 3415 is received into the rail channel 3412. The slider 3415 may include a slider base 3417 that is frictionally held and retained in the rail channel 3412. A slider body 3416 may be attached to or integrally formed with the slider base 3417. Accoutrement attachments 3418, such as Velcro, may be provided on the slider 3415. The accoutrement attachments 3418 affords attachment to accoutrements as desired. In one embodiment of the invention, the slider 3415 may be integrally formed with an accoutrement, such that a user may readily slide the slider 3415 with integral accoutrement out of the rail 3410 and readily replace such slider/accoutrement with another slider/accoutrement option.

Further aspects of the assembly 3400 are hereinafter described with reference to FIG. 34, in accordance with one or more embodiments of the disclosure. A slider 3415' shown in FIG. 34, may be a part of the accoutrement, with the slider 3415' slidably attaching to the rail/shoe, i.e. the slider 3415' may be integrally formed with the accoutrement. Rail 3410 may be a component of a spine and/or attached to the shoe, OR the rail may be integrally formed into the shoe. The components may be reversed with the slider 3415 serving as the component attached/integral to the shoe and with the rail 3410 attached to the slider (i.e. with the rail 3410 positioned between the slider 3415 and the accoutrement). The rail 3410 may be embedded into the shoe.

Figure 35:
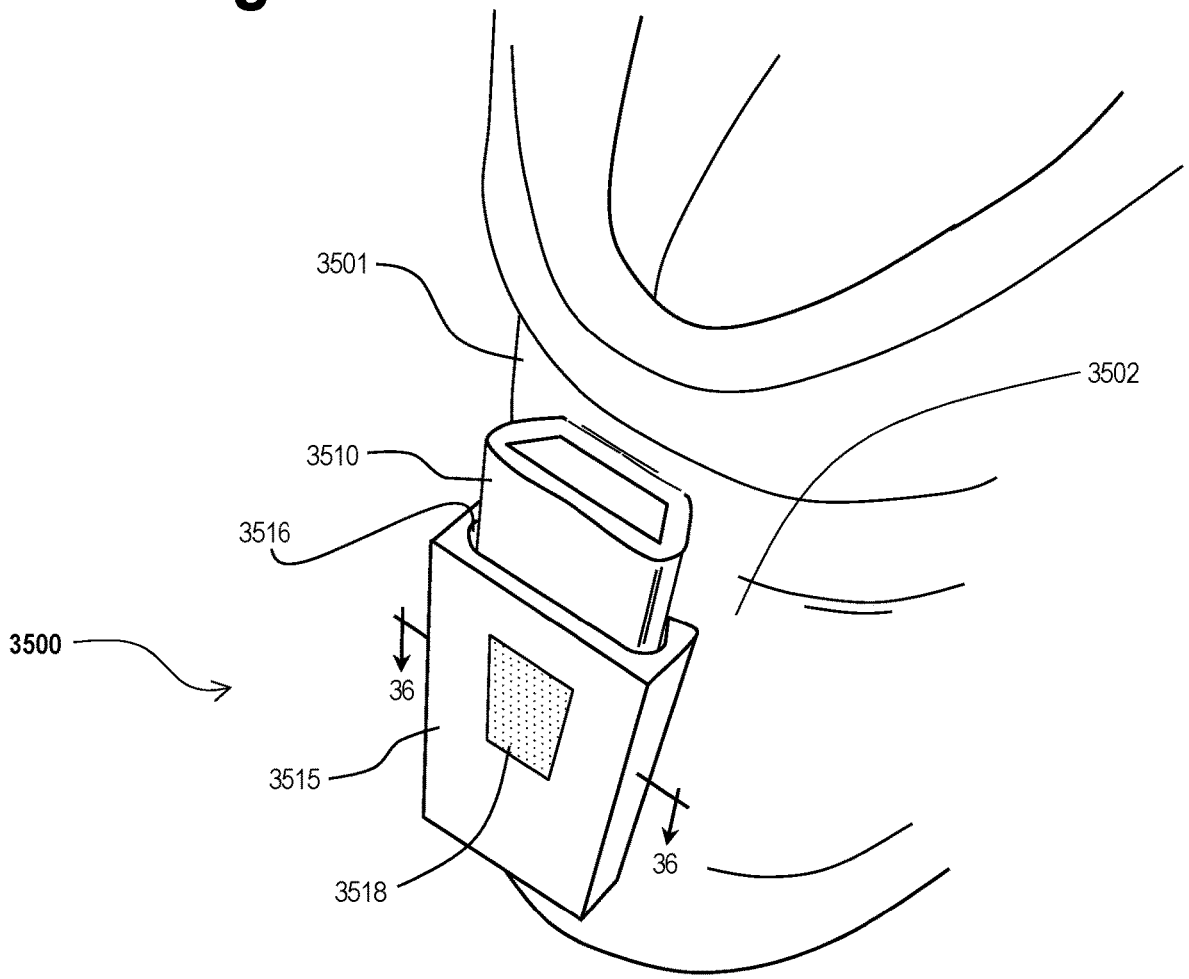
FIG. 35 is a perspective view of a further shoe accoutrement assembly 3500 integrated with modified shoe 3501, in accordance with one or more embodiments of the disclosure.

FIG. 35 is a perspective view of a further shoe accoutrement assembly 3500 integrated with modified shoe 3501, in accordance with one or more embodiments of the disclosure.

As shown, a rail 3510 is attached to shoe 3501 or is an integral part of shoe 3501. The rail 3510 may be positioned on a shoe back portion 3502, which may be a modified portion of the shoe.

The shoe accoutrement assembly 3500 also includes slider 3515. The slider 3515 includes opposing sidewalls so as to form a channel opening 3516. The rail 3510 is frictionally held and retained within the channel opening 3516, i.e. such that the slider 3515 is frictionally held and supported by the rail 3510.

Accoutrement attachments 3518, such as Velcro, may be provided on the slider 3515. The accoutrement attachments 3518 affords attachment to accoutrements as desired. In one embodiment of the invention, the slider 3515 may be integrally formed with an accoutrement, such that a user may readily slide the slider 3515 with integral accoutrement upwardly and "off" of the rail 3510 and readily replace such slider/accoutrement with another slider/accoutrement option.

Further aspects of the assembly 3500, of FIG. 35, are hereinafter described with reference to FIG. 35, in accordance with one or more embodiments of the disclosure. An attached accoutrement may be a separate piece from the slider 3515 and attached by the user. Alternatively, the slider 3515 may be built with the accoutrement and/or the slider 3515 may be integral to the accoutrement. The rail 3510 may be integrally formed with the shoe and/or embedded into the shoe, with the slider 3515 integrally formed and/or a part of the accoutrement. The slider 3515 may be integrally formed with the shoe and/or embedded into the shoe, with the rail 3510 integrally formed and/or a part of the accoutrement. The rail 3510 may be integral with the shoe (i.e. the shoe may be built with the rail); OR the rail may be a separate piece from the shoe, and attached to the shoe. The components may be reversed with the slider 3515 serving as the component attached/integral to the shoe and with the rail 3510 attached to the slider (i.e. with the rail 3510 positioned between the slider 3515 and the accoutrement).

Figure 36:
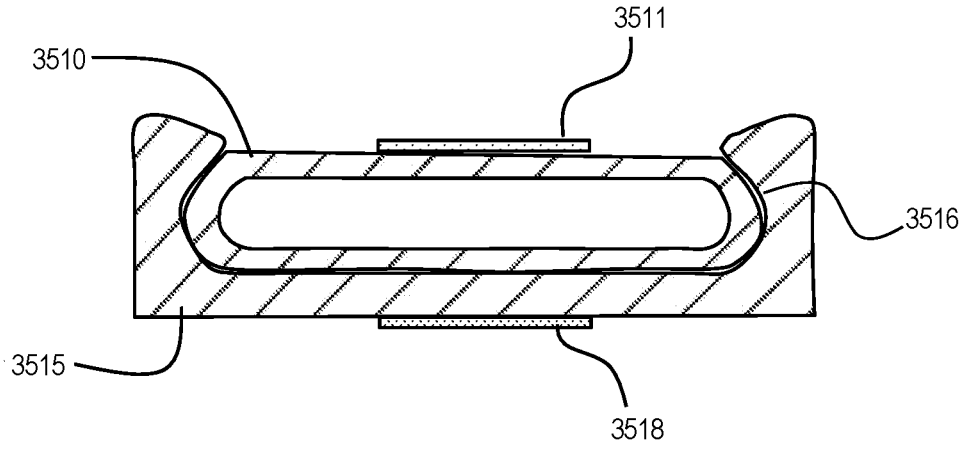
FIG. 36 is a cross-sectional view of rail 3510 with slider 3515, the same as or similar to that shown in FIG. 35 along line 36-36 of FIG. 35, in accordance with one or more embodiments of the disclosure.

FIG. 36 is a cross-sectional view of rail 3510 with slider 3515, the same as or similar to that shown in FIG. 35 along line 36-36 of FIG. 35, in accordance with one or more embodiments of the disclosure. FIG. 36 further illustrates structure the same as or similar to that shown in FIG. 35. Additionally, FIG. 36 shows that rail 3510 can include a shoe attachment 3511, such as adhesive, that serves to connect the rail 3510 to the shoe. Alternatively, the rail 3510 may be integrally formed as a structural component of the shoe 3501.

Figure 38:
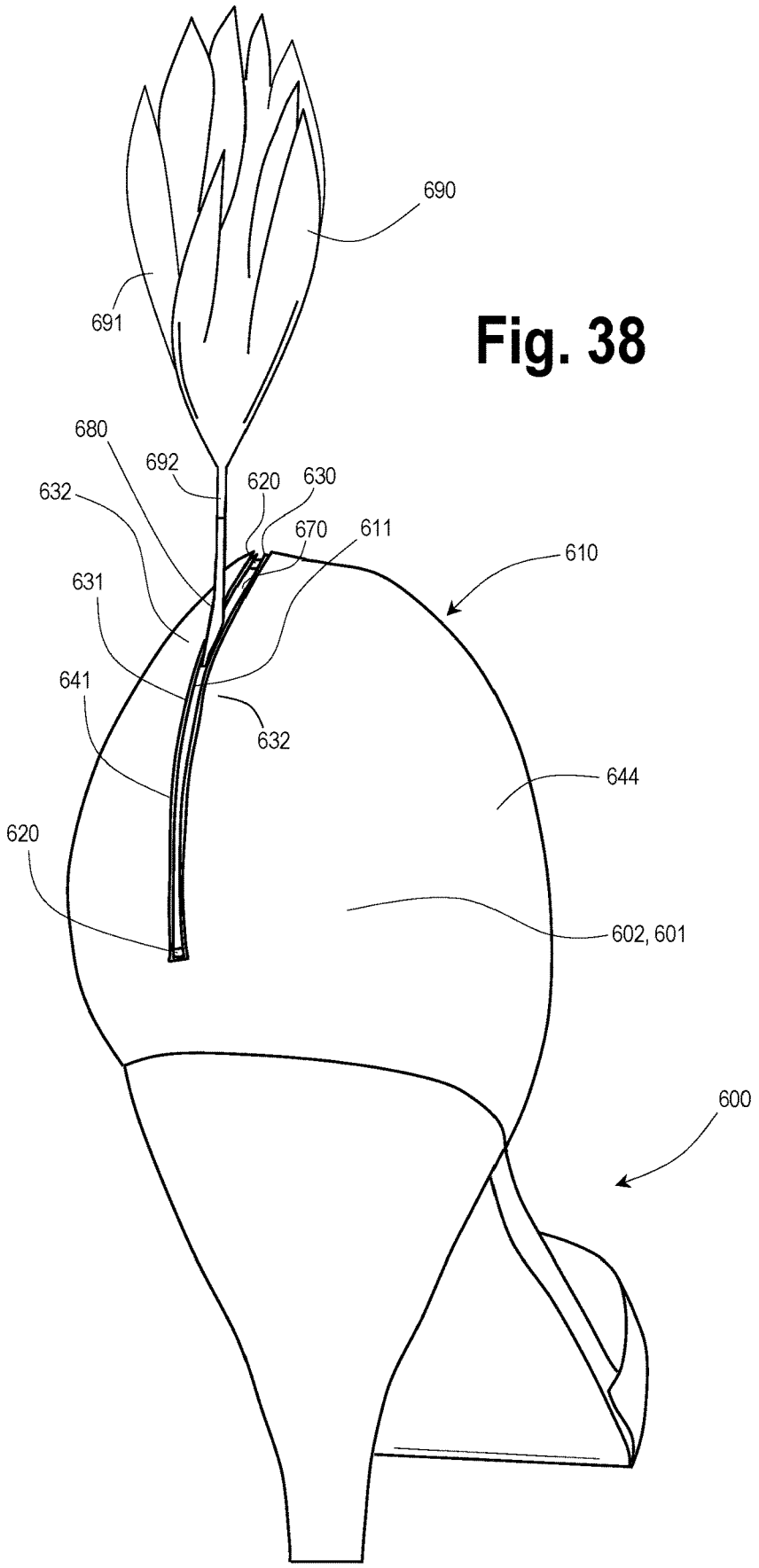
FIG. 38 is a rear perspective view of a shoe including shoe assembly, in accordance with principles of the disclosed subject matter.
Figure 39:
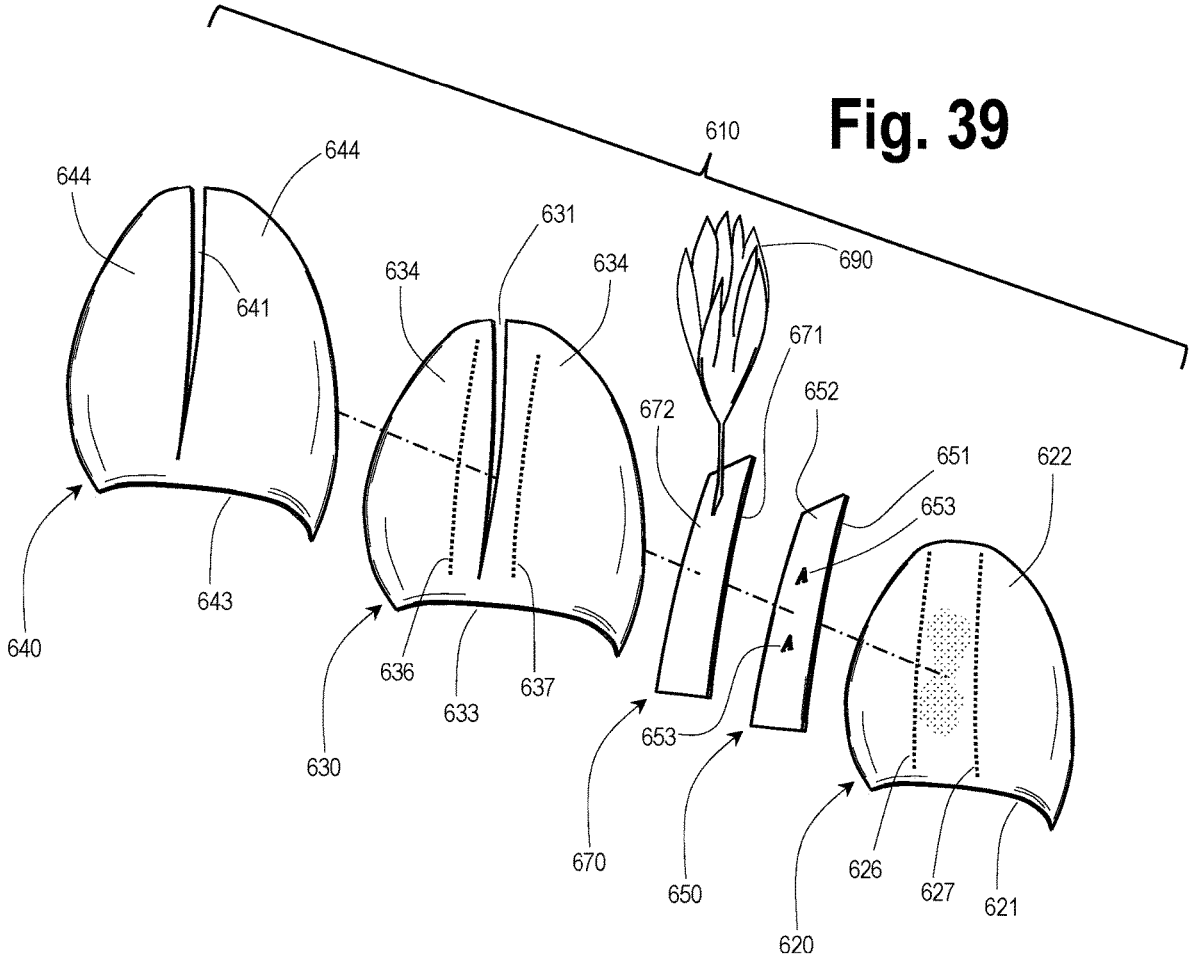
FIG. 39 is an exploded view of a shoe assembly the same as or similar to the shoe assembly of FIG. 38, in accordance with principles of the disclosed subject matter.
Figure 40:
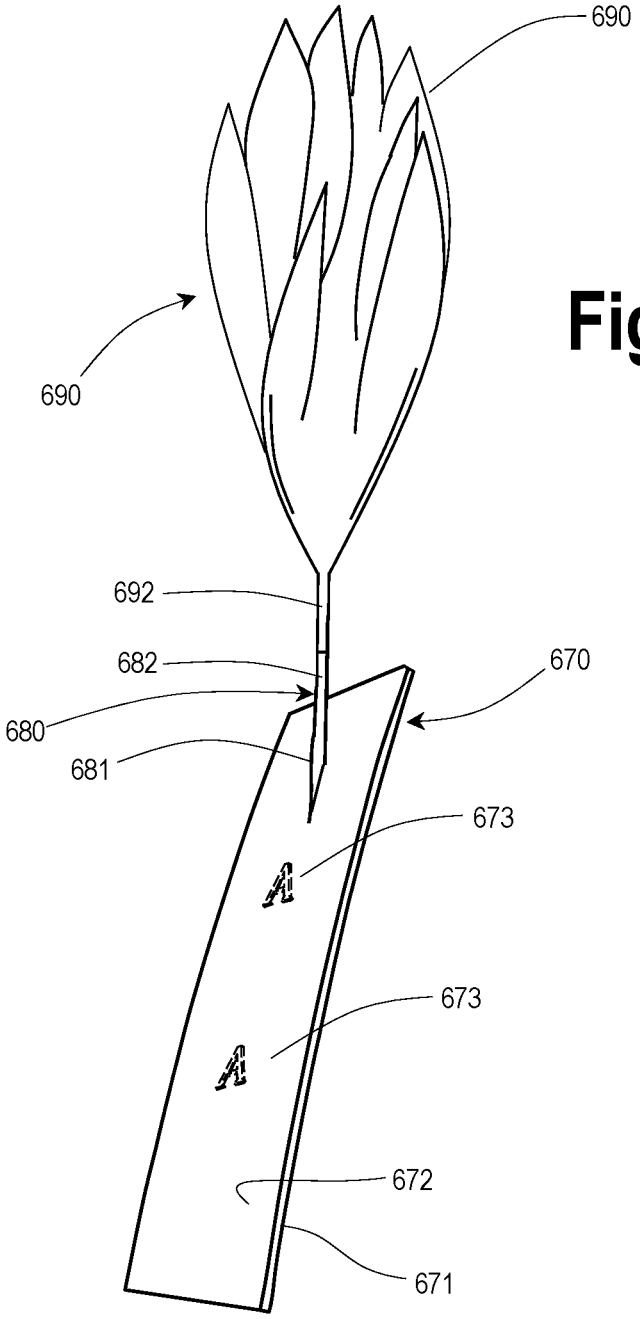
FIG. 40 is a rear perspective view of a second attachment plate with accoutrement assembly the same as or similar to that of FIG. 38, in accordance with principles of the disclosed subject matter.
Figure 41:
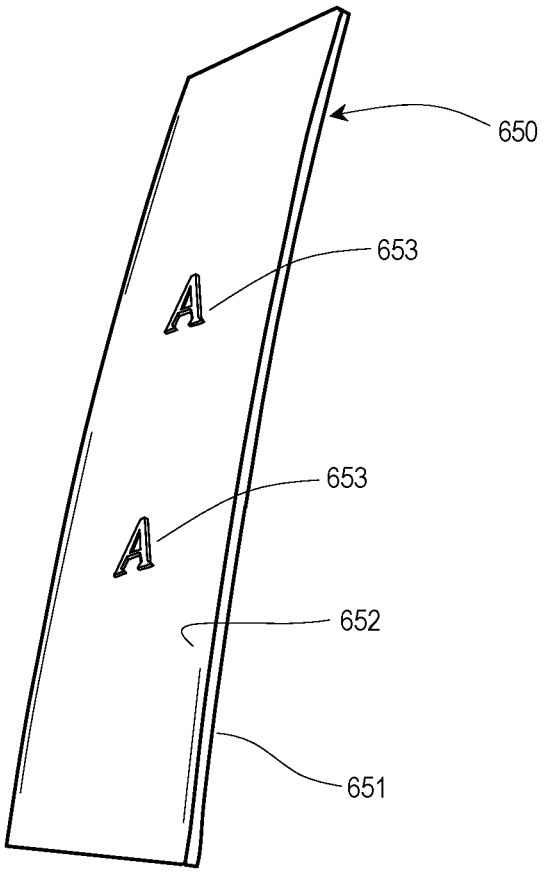
FIG. 41 is a rear perspective view of a first attachment plate the same as or similar to that of FIG. 38, in accordance with principles of the disclosed subject matter.
Figure 42:
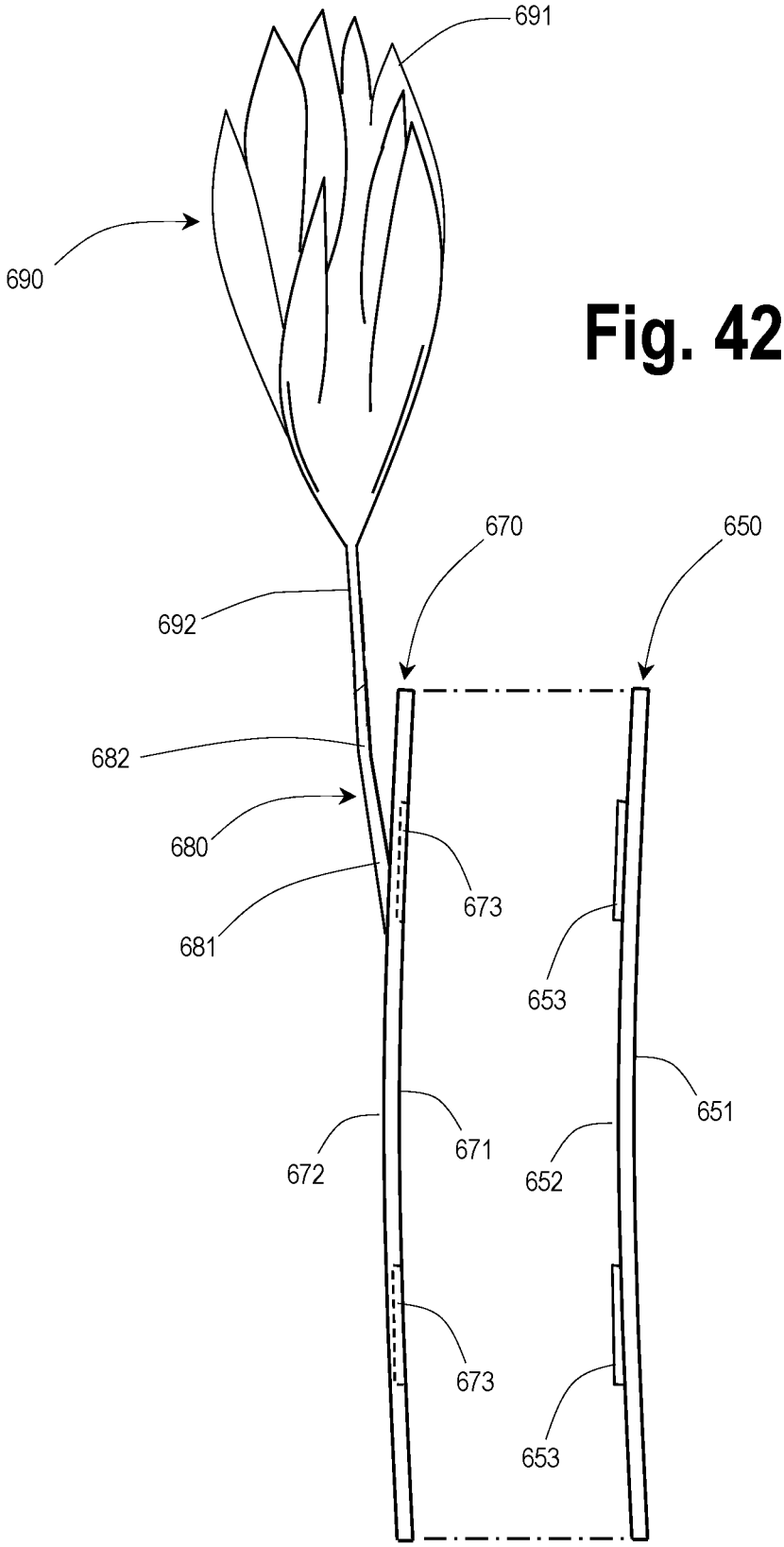
FIG. 42 is an exploded side view of a portion of the shoe assembly including the first attachment plate, the second attachment plate, and an accoutrement the same as or similar to FIG. 38, in accordance with principles of the disclosed subject matter.

FIG. 38 is a rear perspective view of a shoe including shoe assembly, in accordance with principles of the disclosed subject matter. FIG. 39 is an exploded view of a shoe assembly the same as or similar to the shoe assembly of FIG. 38, in accordance with principles of the disclosed subject matter. FIG. 40 is a rear perspective view of a second attachment plate with accoutrement assembly the same as or similar to that of FIG. 38, in accordance with principles of the disclosed subject matter. FIG. 41 is a rear perspective view of a first attachment plate the same as or similar to that of FIG. 38, in accordance with principles of the disclosed subject matter. Also, FIG. 42 is a side view of a portion of the shoe assembly including the first attachment plate, the second attachment plate, and an accoutrement the same as or similar to FIG. 38, in accordance with principles of the disclosed subject matter.

Figure 44:
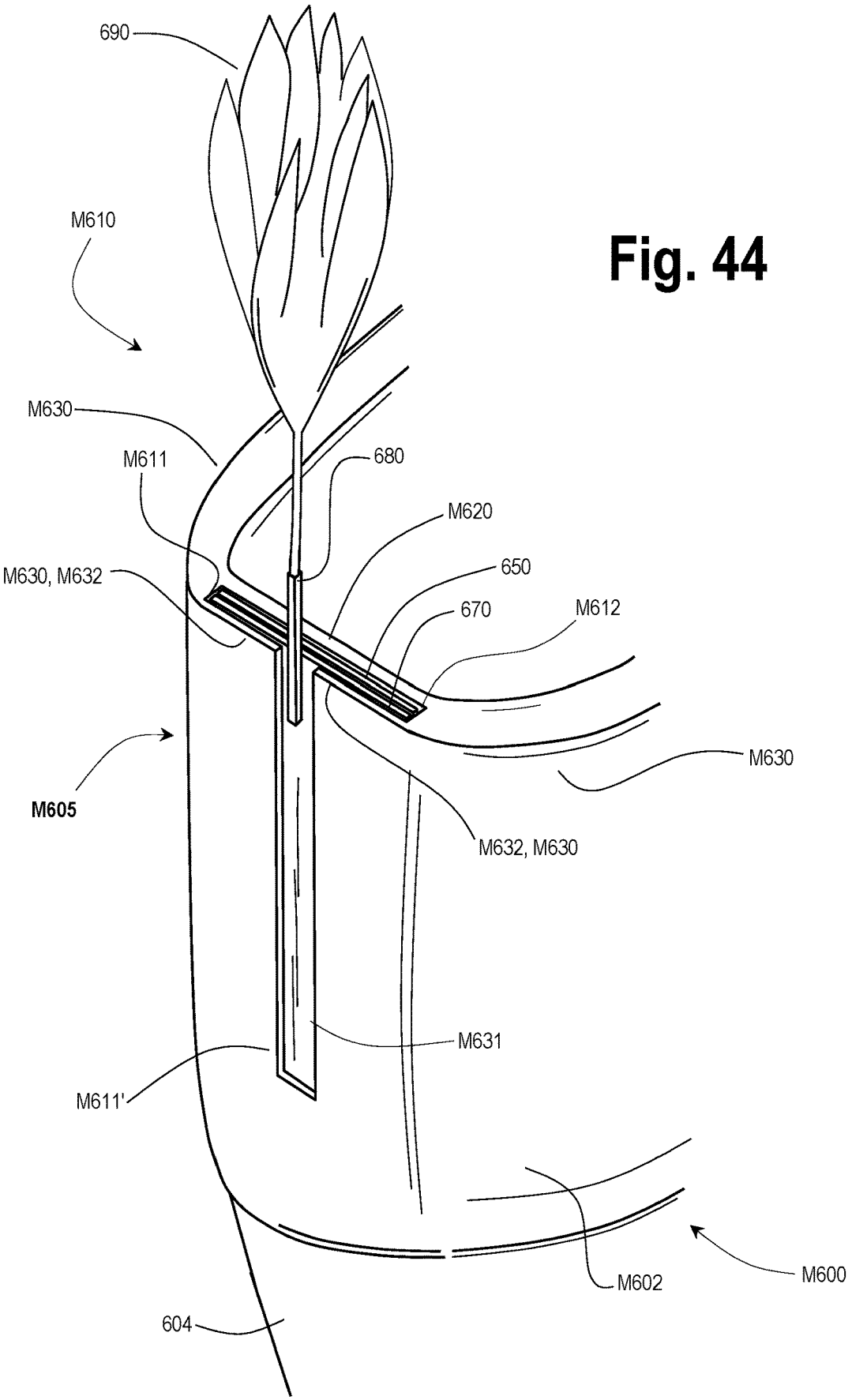
FIG. 44 is a rear perspective view of a further shoe assembly with shoe module, in accordance with principles of the disclosed subject matter.

As shown in FIG. 38, a shoe assembly 610 can be integrated into a shoe 600. For example, the shoe assembly 610 can provide a "counter" to the shoe 600. That is, the shoe assembly of the disclosure can provide a counter or counter portion for integration into a shoe. The counter portion can be provided for cradling and supporting the heel of a wearer of the shoe. In this description, it is understood that a "quarter" of a shoe can include the "counter" of a shoe. In some embodiments, the shoe assembly 610 can provide only the counter 602. In some embodiments, the shoe assembly 610 can provide the entire quarter 601 of the shoe. It should be appreciated that the particular shape of the shoe assembly can vary widely depending on the particular shoe design. It is envisioned that the shoe assembly 610 (or M610M as shown in FIG. 44), for example, could be prefabricated. Such prefabricated shoe assembly 610, might then be integrated into shoes of various different designs. For example, the same shoe assembly 610 might be integrated into shoes having different heel shapes, different upper shapes, and different vamp shapes. See related FIG. 37, showing parts of a shoe, described above.

As noted above, FIG. 38 is a rear perspective view of a shoe was shoe assembly 610. FIG. 39 is an exploded view of a shoe assembly 610. The shoe assembly 610 can include an inner layer 620, a support or middle layer 630, and a finish layer or outer layer 640. The shoe assembly 610 can also include a first attachment plate 650 and a second attachment plate 670. A connection assembly 680 can attach the second attachment plate 670 to an accoutrement assembly 690. The accoutrement assembly can include feathers 691, for example.

The inner layer 620 can be constructed of a first material. The inner layer 620 can include an inner surface 621 and a rear surface 622. The inner surface 621 can engage with the heel of a wearer, i.e. a user. The rear surface 622 can support and be attached to the first attachment plate 650. Adhesive can be used to attach the rear surface 622 with the first attachment plate 650.

The shoe assembly 610 can also include a support layer or middle layer 630. The support layer 630 can be constructed of a second material. The second material can be the same as the first material. The support layer 630 can include a slit as shown in FIGS. 38 and 39, for example. The slit 631 can extend from a top edge of the back of the shoe downward as desired. The slit can extend downward the entire distance so as to extend from the top of the shoe to the heel seat. The slit 631 can extend only a portion down the back of the shoe. The slit 631 can extend 50%, 60%, 70%, 80%, or 90% down the back of the shoe from the top of the shoe, i.e. downwardly from the back collar of the shoe. The support layer can include a forward surface 633. The forward surface 633 can be in contact with the rear surface 622. Such two surfaces can be adhesively attached to each other, i.e. about a pocket 611. The support layer 630 can also include a rear surface 634. The support layer 630 can form flaps 632 on opposing sides of the slit 631. The flaps 632 can be described as extending outwardly from the slit 631 a quarter inch or a half inch, for example. The flaps 632 can be an integral part of the support layer 630. The flaps 632 can be flexible, to some degree, while providing support.

In accordance with at least one embodiment of the disclosed subject matter, support layer 630 can be stitched or otherwise mechanically connected to the inner layer 620. As shown in FIG. 39, a stitch line 636 (of layer 630) can be attached to stitch line 626 (of layer 620). Also, stitch line 637 (of the layer 630) can be attached to stitch line 627 (of layer 620). Accordingly, such stitching of the layers 620, 630, can form a pocket 611. It is this pocket 611 that the first attachment plate 650 can be secured into. Additionally, the second attachment plate 670 can be slid in and out of the pocket 611, by inserting the plate 670 in from the top of the pocket 611, so as to switch out accoutrement assemblies that are attached to the different second attachment plates 670. The layers 620, 630 can be adhesively attached about the pocket 611.

Figure 39B:
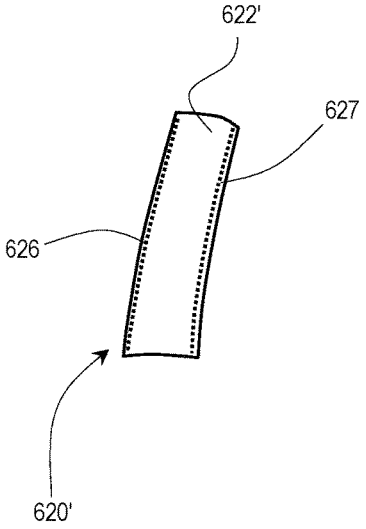
FIG. 39B is a diagram showing an alternative inner layer 620', in accordance with principles of the disclosed subject matter.

Relatedly, FIG. 39B is a diagram showing an alternative inner layer 620', in accordance with principles of the disclosed subject matter. The alternative inner layer 620' can include the stitch line 626 and the stitch line 627. A rear surface 622' can be provided, to which the first attachment plate 650 can be attached. The inner layer 620 shown in FIG. 39 (which wraps around the back of the shoe) can be replaced, in manufacture, with the strip of material 620', shown in FIG. 39B. The material 622' can be elastic material, for example. The strip of material 620' can be attached to the layer 630, via stich lines 626, 627, so as to form the pocket 611. The strip of material 620' can thus provide the inner layer 620'. Relatedly, it is appreciated that the support layer 630 can be in contact with the user's heel "outboard" of outer edges of the inner layer 620' of FIG. 39B.

In accordance with at least one embodiment of the disclosed subject matter, the first attachment plate 650 might be omitted. Accordingly, the second attachment plate could be retained in the pocket 611 by gravity and by friction force of the surrounding material.

With further reference to FIG. 39, the flaps 632 can be flexible so as to allow the second attachment plate 670 to be inserted into the slit (by inserting the second attachment plate 670 in from the top and pushing downwardly)—so that the second attachment plate 670 is positioned between the support layer 630 and the inner layer 620 in what can be described as the pocket 611. The flaps 632 should also be flexible enough for removal of the second attachment plate 670. Accordingly, flexibility of the flaps 632 can provide for ease in "switching out" one second attachment plate 670 for another attachment plate 670. That is, for example, the two different second attachment plates might be attached to different types of accoutrements 690. Accordingly, in use of the shoe assembly, a user can switch out different accoutrements by switching out two different, respective, second attachment plates. That is, a first second attachment plate 670, with accoutrement assembly, can be slipped out the top of the pocket 611—and a replacement second attachment plate 670, with accoutrement assembly, be slipped into the top of the pocket 611. The plates 650, 670 can be curved or possess curvature, as shown in FIG. 42 and in other figures.

In some embodiments, it is appreciated that there may be the inner layer 620 and the support layer 630. In such arrangement, the rear surface 634 of the support layer 630 can be aesthetically pleasing since such surface may be exposed. However, in other embodiments, a finish layer or outer layer 640 can be provided. The finish layer 640 can cover-up the support layer 630. The finish layer 640 can be constructed of more aesthetically pleasing material, in particular on an outer finished surface 644 thereof, and can be constructed of more expensive material. For example, the support layer 630 might be constructed of a plastic material. The finish layer or outer layer 640 can be constructed of leather, for example. The finish layer 640 can be adhesively attached to the support layer 630. Specifically, a forward surface 643 of the finish layer 640 can be attached to the rear surface 634 of the support layer 630.

The finish layer 640 can include a slit 641. The dimensions and geometry of the slit 641 can be similar to the dimensions and geometry of the slit 631 of the support layer 630. Accordingly, the slit 641 can run up and down the back of the shoe as desired. Also, it is appreciated that there could be additional layers, i.e. in addition to the inner layer 620, the support layer 630, in the finish layer 640. Other layers could be provided for aesthetic reasons, for weather resistant reasons, for comfort and/or to provide further support, for example. It is appreciated that in some embodiments of the disclosure, the slit running up the back of the shoe assembly, such as slit 631, might be omitted. If the slit is omitted, the attachment plates 650, 670 would not be visible. Accordingly, logos or other indicia on the plates 650, 670 would not be visible. However, the second attachment plate 670 could still be slid in from the top and slid out of the top.

FIG. 40 is a rear perspective view of a second attachment plate with accoutrement assembly the same as or similar to that of FIG. 38, in accordance with principles of the disclosed subject matter. As shown in FIG. 40, the second attachment plate can include a forward surface 671 and a rear surface 672. The forward surface 671, i.e. toward the front of the shoe, is a surface that makes contact with the rear surface 652 of the first attachment plate 650. The rear surface 672 provides an outer surface that can be viewed through the slits 631, 641. Accordingly, the rear surface or outer surface 672 could be constructed of some aesthetically pleasing material. For example, the rear surface 672 could be burnished. The plate 670 can include recesses 673 on forward side 671. The recesses are shown in phantom in FIG. 40, i.e. since such recesses are on the side of the plate 670 not visible in FIG. 40.

FIG. 41 is a rear perspective view of a first attachment plate the same as or similar to that of FIG. 38, in accordance with principles of the disclosed subject matter. The first attachment plate 650 can be described as an inner plate 650. The first attachment plate 650 can include the rear surface 652 and the forward surface 651. The forward surface 651 can be adhesively attached onto the rear surface 622 of inner layer 620. For example, adhesive 623 can be used to attach the forward surface 651 onto the rear surface 622. However, other mechanisms could be used for such attachment, such as heat bonding or stitching, for example. For example, the first attachment plate 650 could be provided with holes through which stitches are run—with such stitches extending through the inner layer 620. In general, it is appreciated that adhesive, stitching, heat bonding, or other attachment mechanisms can be used so as to attach the various components of the shoe assembly 610.

The first attachment plate 650 and the second attachment plate 670 can be magnetically attracted. For example, one of the plates can be a magnet and the other plate be metal. Both of the plates 650, 670 can be magnetized.

Also, FIG. 42 is a side view of a portion of the shoe assembly including the first attachment plate, the second attachment plate, and an accoutrement the same as or similar to FIG. 38, in accordance with principles of the disclosed subject matter. As shown in FIG. 42, the first attachment plate 650 can be provided with one or more protuberances 653. The protuberances 653 can extend outwardly from the rear surface 652. Additionally, the forward surface 671 of the second attachment plate 670 can include one or more recesses 673. The recesses 673 can engage with or mate with the protuberances 653. Such arrangement can serve to accurately orient and position the first attachment plate 650 vis-à-vis the second attachment plate 670. In general, such arrangement can provide a more stable and secure attachment between the plates 650, 670. For example, the protuberances 653 can be a ridge. The protuberances 653 can be any geometrical shape as desired. The protuberances 653 could be a logo, characters, alpha characters, numerical characters, or any other geometrical shape. In matching in similar manner, the recesses 673 can be any geometrical shape as desired. Further, it is appreciated that the structure could be "flipped" between the first attachment plate 650 and the second attachment plate 670. That is, the protuberances could be provided in the second attachment plate 670 and the recesses provided in the first attachment plate 650. The first attachment plate and/or the second attachment plate (on either side thereof) can be provided with decorative indicia and/or logos, for example, as desired. Such decorative indicia and/or logos may be viewed through the slit, for example.

FIG. 42 also shows a connection assembly 680. The connection assembly 680 can include an attachment base 681 and a rod or shaft 682. The connection assembly 680 can be integrally formed with the second attachment plate 670. The rod or shaft 682 can extend into a hole or aperture in the second attachment plate 670. The shaft 682 could be threaded into an aperture in the second attachment plate 670. Other mechanical attachment mechanisms, such as soldering or welding, could be used so as to attach the connection assembly 680 onto the second attachment plate 670.

As shown, the accoutrement assembly 690 can include an attachment portion 692. The attachment portion 692 can attach onto the rod or shaft 682 of the connection assembly 680. For example, the attachment portion 692 could be telescopically or threadably attached onto the rod or shaft 682. Alternatively, the connection assembly 680 and the attachment portion 692 could be integrally formed. The second attachment plate 670, the connection assembly 680, and the attachment portion 692 of the accoutrement assembly all could be integrally formed. Alternatively, any component thereof could be formed in pieces and the components be connected using any suitable mechanical attachment mechanism. The connection assembly 680 can be attached onto the rear surface 672 of the second attachment plate 670. The connection assembly 680 can extend out or from the top of the attachment plate 670, and may be parallel and aligned with the attachment plate 670. Accordingly, it may be that the connection assembly 680 does not extend through the slit 631, but rather simply extends out the top of the pocket 611.

Figure 43:
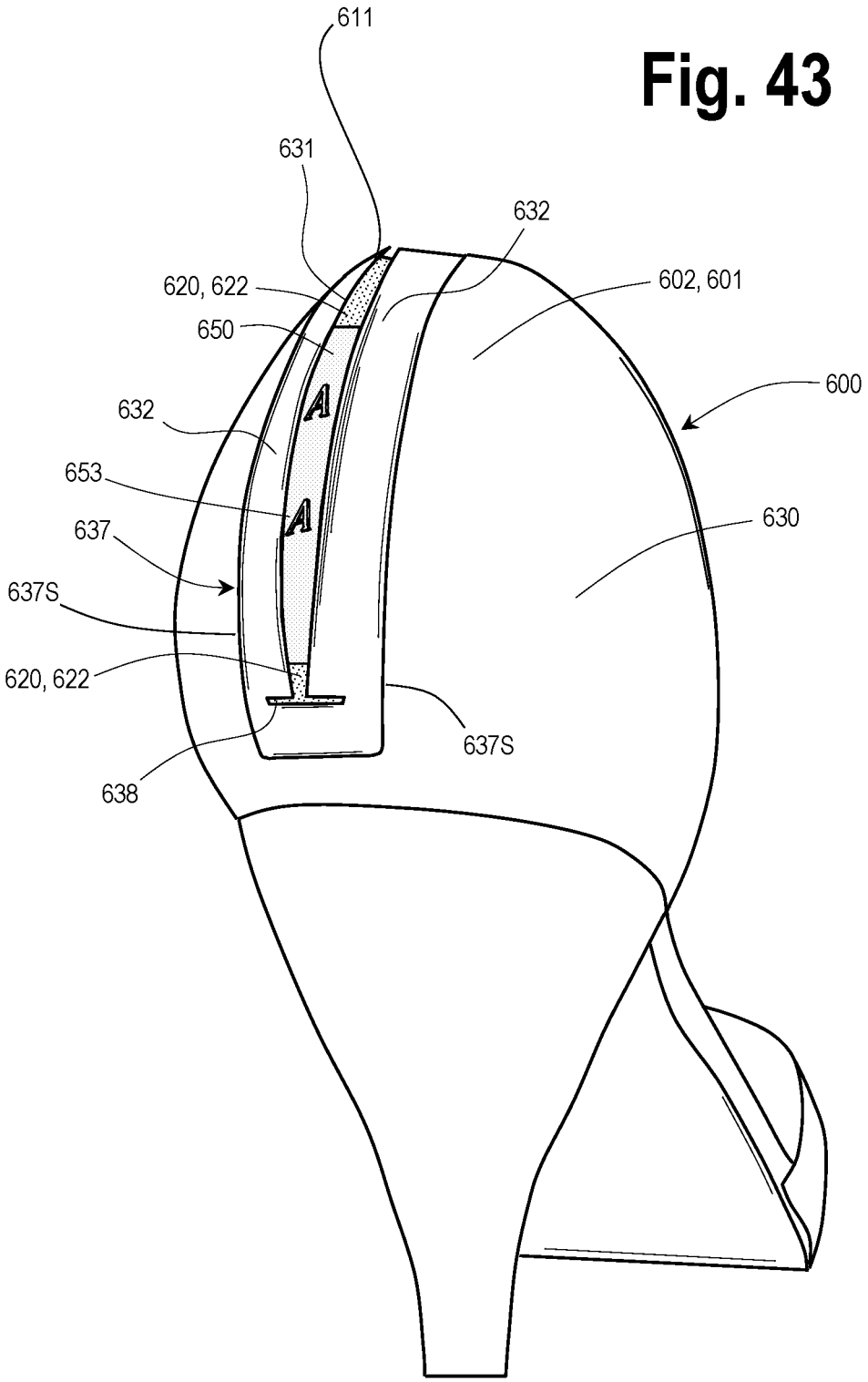
FIG. 43 is a rear perspective view of a shoe including a further shoe assembly with variations as compared to the shoe assembly of FIG. 38, in accordance with principles of the disclosed subject matter.

FIG. 43 is a rear perspective view of a shoe including a further shoe assembly with variations as compared to the shoe assembly of FIG. 38, in accordance with principles of the disclosed subject matter. FIG. 43 is provided to show variations of a shoe assembly 610. As shown in FIG. 43, no finish layer or outer layer 640 is provided. Rather, the support layer 630 is the outer layer. Relatedly, the outer layer 630 can include an inset portion 637. The inset portion 637 can form a part of the outer layer 630. The inset portion 637 can span across the shoe back. The inset portion 637 can provide an aesthetically pleasing appearance in conjunction with the slit 631. The inset portion 637 can be defined by a seam 637S. The seam 637S can include stitching or threading. Such stitching can serve to attach and secure the inset portion 637 to the material that surrounds the inset portion 637. In at least one embodiment, the inset portion 637 and the material that surrounds the inset portion 637 can be considered to collectively form the support layer 630. FIG. 43 also shows the inner layer 620. The inner layer 620 can be attached to the support layer 630 utilizing the stitching 637S. As a result, a pocket 611 can be formed between the support layer 630 and the inner layer 620. It is this pocket 611 that can serve to house or contain the first attachment plate 650 and serve to removably contain the second attachment plate 670. The user can "switch out" the second attachment plate 670 so as to switch accoutrements.

Also, FIG. 43 shows that the first attachment plate 650 need not run the entire vertical length of the slit 631. The first attachment plate 650 has alpha character protuberances 653. In FIG. 43, the second attachment plate 670 with accoutrement assembly 690 is not shown. Accordingly, in use of the shoe assembly 610, a user can select a second attachment plate 670 with accoutrement assembly 690 that the user desires. Such choice could be amongst different accoutrement assemblies that are attached to respective second attachment plate 670. Once the user has chosen the second attachment plate 670 with accoutrement assembly 690, the user can separate the flaps 632, as shown in FIG. 43, and position the second attachment plate 670 up against the first attachment plate 650. As result of the magnetic attraction, the plates are attracted to each other and the second attachment plate snaps or clicks onto the first attachment plate. The second attachment plate 670 can be provided with recesses that match the protuberances 653 as shown in FIG. 43. Also, FIG. 43 shows that the rear surface 622 of the inner layer 620 can be provided with a pattern or roughened surface. Such might be aesthetically pleasing in some uses of the shoe assembly 610. Any of the components of the shoe assembly 610 can be provided with any surface as desired. Also, FIG. 43 shows a relief slit 638. The relief slit 638 can be provided for aesthetic reasons and/or to decrease the possibility of tearing the bottom and of the slit 631.

FIG. 44 is a rear perspective view of a further shoe assembly M610, in accordance with principles of the disclosed subject matter. The shoe assembly M610 of FIG. 44 can be similar in overall structure to that shown in FIG. 39. However, the shoe assembly M610 can include a shoe module M605. The shoe module can be constructed of plastic. The shoe assembly M610 and/or the shoe module M605 can be in the form of a prefabricated piece or pieces. Such prefabricated piece(s) can then be integrated into different design shoes as desired. Such prefabricated piece can be attached to different heels, different uppers, and/or provided with different coverings, as may be desired. For example, the shoe module M605 shown in FIG. 44 can be prefabricated and attached to different heels, different uppers, and/or provided with different coverings, as may be desired.

The shoe module can include an inner layer M620 and a support layer M630. Accordingly, the inner layer M620 and the support layer M630 can be integrally formed, such as by injection molding and constructed of plastic. The support layer M630 can include opposing flaps or flanges M632. The opposing flaps M632 can define a slit M631. The dimensions and geometry of the slit M631 can vary as with the slit 631 described above. Accordingly, the length and/or width of the slit M631 can vary as desired. The inner layer M620 and the support layer M630 (including flaps M632) can define or form a pocket M611. In accordance with at least one embodiment of the disclosed subject matter, the inner layer M620 can extend along the back of the pocket M611. Accordingly, the width of the inner layer M620 can be substantially the same as the width of the pocket M611. The inner layer M620 can be connected at opposing sides onto the support layer M630, as shown in FIG. 44. FIG. 44 shows back side of pocket M611 at M611'.

The pocket M611 can house the first attachment plate 650 and the second attachment plate 670. As shown in FIG. 44, a connection assembly 680 can be attached onto the second attachment plate, such as by bonding, adhesive, welding, or soldering. The connection assembly 680 can be attached and support an accoutrement assembly 690. As shown, the support layer M630 and the inner layer M620 can be integrally formed as a unit, so as to form the shoe module M605. As shown, the interior surface of the shoe module M605 and the exterior surface of the shoe module M605 can be smooth and continuous.

The first attachment plate can be glued or otherwise attached to the inner layer M620. The second attachment plate 670 can be removably inserted downwardly into the pocket M611 through a top opening M612. The inner dimensions of the pocket M611 can be provided so as to accommodate or house the first attachment plate 650 and the second attachment plate 670. In use, one second attachment plate 670 with accoutrement assembly 690 can be "switched out" with another attachment plate 670 with accoutrement assembly 690. For example, such two accoutrement assemblies might be of different color. The magnetic attraction of the second attachment plate to the first attachment plate can assist in keeping the second attachment plate securely inserted into the pocket M611. When the user wishes to remove the second attachment plate 670 (with accoutrement) the user can simply pull up on the second attachment plate 670 and/or the accoutrement assembly 690. Such pressure can overcome the magnetic force and the second attachment plate 670 can be pulled up and out of the pocket M611. Thereafter, an alternative second attachment plate 670, with a different accoutrement, can be inserted into the pocket M611.

As shown, the shoe module M605 can be integrated so as to be part of a shoe M600. The shoe M600 can include heel 604. The shoe module M605 can provide the counter or heel cup of the shoe, for example.

With reference to FIG. 44, the interior of the shoe module can be provided with a layer to engage the user's heel. For example, the layer might be sheepskin or other material that is comfortable to the skin. The exterior of the shoe module can be provided with a layer of finishing material, such as leather. Leather and other material can also be provided to line the inside of the pocket M611. In general, any material can be provided to line or cover any surface of the shoe assembly M610 as may be desired.

It is appreciated that the various components of embodiments of the disclosure may be made from any of a variety of materials including, for example, plastic, plastic resin, nylon, composite material, foam, rubber, elastic material, wood, metal, leather, cardboard and/or ceramic, for example, or any other material as may be desired. For example, the device(s) of this disclosure may be produced from a plastic resin, such as polyethylene, and be injection molding.

A variety of production techniques may be used to make the apparatuses as described herein. For example, suitable textile fabrication, suitable injection molding and other molding techniques and other manufacturing techniques might be utilized. Also, the various components of the apparatuses may be integrally formed, as may be desired, in particular when using molding construction techniques. Also, the various components of the apparatuses may be formed in pieces and connected together in some manner, such as with suitable adhesive and/or heat bonding.

The various apparatuses and components of the apparatuses, as described herein, may be provided in various sizes and/or dimensions, as desired.

It will be appreciated that features, elements and/or characteristics described with respect to one embodiment of the disclosure may be variously used with other embodiments of the disclosure as may be desired.

It will be appreciated that the effects of the present disclosure are not limited to the above-mentioned effects, and other effects, which are not mentioned herein, will be apparent to those in the art from the disclosure and accompanying claims.

Although the preferred embodiments of the present disclosure have been disclosed for illustrative purposes, those skilled in the art will appreciate that various modifications, additions and substitutions are possible, without departing from the scope and spirit of the disclosure and accompanying claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present.

It will be understood that when an element or layer is referred to as being "onto" another element or layer, the element or layer can be directly on another element or layer or intervening elements or layers. Examples include "attached onto", secured onto", and "provided onto". In contrast, when an element is referred to as being "directly onto" another element or layer, there are no intervening elements or layers present. As used herein, "onto" and "on to" have been used interchangeably.

It will be understood that when an element or layer is referred to as being "attached to" another element or layer, the element or layer can be directly attached to the another element or layer or intervening elements or layers. In contrast, when an element is referred to as being "attached directly to" another element or layer, there are no intervening elements or layers present. It will be understood that such relationship also is to be understood with regard to: "secured to" versus "secured directly to"; "provided to" versus "provided directly to"; and similar language.

As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper", "top", "bottom", "left", "right" and the like, may be used herein for ease of description to describe the relationship of one element or feature to another element(s) or feature(s) as illustrated in the drawing figures. It will be understood that spatially relative terms are intended to encompass different orientations of structures in use or operation, in addition to the orientation depicted in the drawing figures. For example, if a device in the drawing figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein should be interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "including", "comprises" and/or "comprising," and variations thereof, for example, when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to diagrams and/or cross-section illustrations, for example, that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of components illustrated herein but are to include deviations in shapes that result, for example, from manufacturing or fabrication.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, as otherwise noted herein, when a particular feature, structure, or characteristic is described in connection with any embodiment, it is submitted that it is within the purview of one skilled in the art to effect and/or use such feature, structure, or characteristic in connection with other ones of the embodiments.

Embodiments are also intended to include or otherwise cover methods of using and methods of manufacturing any or all of the elements disclosed above.

While the subject matter has been described in detail with reference to exemplary embodiments thereof, it will be apparent to one skilled in the art that various changes can be made, and equivalents employed, without departing from the scope of the disclosure. All related art references discussed herein are hereby incorporated by reference in their entirety. All documents referenced herein are hereby incorporated by reference in their entirety.

In conclusion, it will be understood by those persons skilled in the art that the present disclosure is susceptible to broad utility and application. Many embodiments and adaptations of the present disclosure other than those herein described, as well as many variations, modifications and equivalent arrangements, will be apparent from or reasonably suggested by the present disclosure and foregoing description thereof, without departing from the substance or scope of the disclosure.

Accordingly, while the present disclosure has been described here in detail in relation to its exemplary embodiments, it is to be understood that this disclosure is only illustrative and exemplary of the present disclosure and is made to provide an enabling disclosure of the disclosure. Accordingly, the foregoing disclosure is not intended to be construed or to limit the present disclosure or otherwise to exclude any other such embodiments, adaptations, variations, modifications and equivalent arrangements.

What is claimed is:

1. A shoe assembly for a shoe, the shoe assembly configured to be attached to a back of the shoe, the shoe assembly comprising:

an inner layer of first material;

a support layer of second material, and the support layer including opposing flaps that include a left flap, with a first inner edge, and a right flap, with a second inner edge, and a slit defined by the first inner edge and the second inner edge, with the slit extending up the back of the shoe, the slit extending in a vertical manner such that a top of the slit is opened proximate a top of the back of the shoe, and a pocket being provided between the inner layer and the support layer, and the pocket is accessible via the slit with the pocket being open at a top of the pocket;

a first attachment plate attached to the inner layer; and a second attachment plate, and the second attachment plate being magnetically attracted to the first attachment plate and positioned on the first attachment plate, and the second attachment plate being slidably removable out the top of the pocket, and the slit running along a back side of the pocket; and the support layer including the right flap and the left flap on opposing sides of the slit such that the opposing flaps serve to enclose and secure the second attachment plate in position against the first attachment plate.

2. The shoe assembly of claim 1, the inner layer of first material and the support layer of second material (a) are integrally formed with each other and (b) collectively form a shoe module.

3. The shoe assembly of claim 2, the shoe module is molded of a plastic material.

4. The shoe assembly of claim 1, the first attachment plate is in the form of a rectangular plate.

5. The shoe assembly of claim 4, the first attachment plate is attached to the inner layer with adhesive.

6. The shoe assembly of claim 4, the second attachment plate is in the form of a rectangular plate.

7. The shoe assembly of claim 6, the first attachment plate and the second attachment plate are sandwiched between the inner layer and the support layer.

8. The shoe assembly of claim 1, the first attachment plate includes a recess or a protuberance; and the second attachment plate includes the other of the recess or the protuberance, and the protuberance being received into the recess so as to provide engagement between the first attachment plate and the second attachment plate.

9. The shoe assembly of claim 8, the recess includes a groove; and the protuberance includes a ridge.

10. The shoe assembly of claim 8, the recess is in the form of a character; and the protuberance is in the form of a matching character that matches the character forming the recess.

11. The shoe assembly of claim 1, the support layer is attached onto the inner layer by adhesive.

12. The shoe assembly of claim 1, further including a finish layer, and the finish layer attached onto the support layer, and the finish layer including a slit, and the slit of the finish layer matching with the slit of the support layer.

13. The shoe assembly of claim 12, the finish layer is attached onto the support layer by adhesive.

14. The shoe assembly of claim 12, the finish layer is leather.

15. The shoe assembly of claim 12, the finish layer is leather, and the support layer is plastic.

16. The shoe assembly of claim 1, the first attachment plate is attached to the inner layer with adhesive.

17. The shoe assembly of claim 1, further including a connection assembly attached to the second attachment plate; and an accoutrement, and the accoutrement supported by the connection assembly with the connection assembly extending through the slit and extending out of the slit, and the accoutrement is in the form of a decorative element, such that the decorative element is supported by the second attachment plate.

18. The shoe assembly of claim 1, the shoe assembly forming a counter portion for integration into a shoe, and the counter portion for cradling and supporting the heel of a wearer of the shoe.

19. A shoe including the shoe assembly of claim 1.

20. The shoe assembly of claim 1, the left inner edge and the right inner edge being substantially parallel to each other, with the slit, defined by the first inner edge and the second inner edge, extending up the back of the shoe.

* * * * *